US012258172B1

(12) United States Patent
Borse

(10) Patent No.: US 12,258,172 B1
(45) Date of Patent: Mar. 25, 2025

(54) TRAY FOR USE WITH OVERWRAPPING

(71) Applicant: Michael R. Borse, Western Springs, IL (US)

(72) Inventor: Michael R. Borse, Western Springs, IL (US)

( * ) Notice: Subject to any disclaimer, the term of this patent is extended or adjusted under 35 U.S.C. 154(b) by 0 days.

(21) Appl. No.: 18/582,336

(22) Filed: Feb. 20, 2024

(51) Int. Cl.
*B65D 1/34* (2006.01)
*B65D 77/00* (2006.01)

(52) U.S. Cl.
CPC ..... *B65D 1/34* (2013.01); *B65D 77/003* (2013.01)

(58) Field of Classification Search
CPC ..... B65D 1/34; B65D 43/16; B65D 43/162; B65D 77/00; B65D 77/003
USPC ..... 206/557–565; 220/213, 309.1
See application file for complete search history.

(56) References Cited

U.S. PATENT DOCUMENTS

| | | | | |
|---|---|---|---|---|
| 3,096,546 | A | 7/1963 | Edwards | |
| 3,192,565 | A | 7/1965 | Rukavina | |
| 3,355,536 | A | 11/1967 | Midgley et al. | |
| 4,228,121 | A | 10/1980 | Meadors | |
| 5,098,751 | A | 3/1992 | Tamura et al. | |
| 5,758,773 | A | 6/1998 | Clements | |
| 6,960,316 | B2 | 11/2005 | Brown et al. | |
| 7,862,318 | B2 * | 1/2011 | Middleton | B65D 77/2032 425/398 |
| 8,012,521 | B2 | 9/2011 | Garwood | |
| 9,908,281 | B1 | 3/2018 | Wallace | |
| 10,189,624 | B2 | 1/2019 | Wallace | |
| 10,562,222 | B2 | 2/2020 | Wallace | |
| 10,562,680 | B2 | 2/2020 | Wallace | |
| 2011/0086141 | A1 | 4/2011 | Strilich et al. | |
| 2011/0311688 | A1 | 12/2011 | Becraft et al. | |
| 2012/0225171 | A1 | 9/2012 | Garwood | |
| 2012/0279895 | A1 * | 11/2012 | Middleton | B29C 45/14336 206/557 |
| 2013/0064998 | A1 | 3/2013 | Wnek | |
| 2020/0140132 | A1 | 5/2020 | Arnold et al. | |

FOREIGN PATENT DOCUMENTS

| | | | |
|---|---|---|---|
| WO | 9601179 | A1 | 1/1996 |
| WO | 2012064203 | A1 | 5/2012 |

OTHER PUBLICATIONS

Helmke, Rob; "Common Plastics for Thermoforming", Plastic Ingenuity blog; Aug. 4, 2022.

* cited by examiner

*Primary Examiner* — Bryon P Gehman
(74) *Attorney, Agent, or Firm* — Mcdonnell Boehnen Hulbert & Berghoff LLP

(57) ABSTRACT

A tray comprising: a base having a base perimeter and a wall extending upward from the base perimeter. The wall is continuous around the base perimeter. The wall includes an inner wall surface and an outer wall surface. The wall includes a first end at the base perimeter and a second end opposite the first end. The tray also includes a flange extending outward from the second end of the wall. The flange includes one or more hinges, a top flange surface, a bottom flange surface, and a trim edge. The flange and the one or more hinges extend continuously around the second end of the wall. At least a portion of the flange is configured to be folded downward such that at least a portion of the bottom flange surface is closer to the outer wall surface after being folded.

28 Claims, 44 Drawing Sheets

TRAY FOR USE WITH OVERWRAPPING

BACKGROUND

The present application generally relates to the field of containers. Plastic and foamed plastic containers and trays are used to hold various food items, such as meat, poultry, bakery items, fruit, vegetables, etc., as well as other products. Often, plastic or foamed plastic trays are covered with a transparent plastic wrapping (herein referred to as "overwrapping" or an "overwrap") to protect the food or other items on the tray. Foamed plastic, often foamed polystyrene, is in widespread use as a tray or food container. However, for environmental reasons, it is anticipated that the use of foamed plastic, or foamed polystyrene, for use as a tray or container is likely to be phased out over time. Hard plastic trays and containers have also been used to contain food and other items. Unfortunately, the edges of hard plastic trays and containers are prone to cut the overwrapping during or after the overwrapping is placed over the tray or container, resulting in a "leaker" which allows oxygen to enter and spoil food placed in the tray or container.

In view of the foregoing, it would be desirable to provide a tray or container having outer edges that do not cut the overwrapping during or after the overwrapping has been placed over the tray or container.

OVERVIEW

The present embodiments relate to a tray or container that is made of a material other than foamed plastic, or foamed polystyrene, having outer edges that are not prone to cut through the overwrapping placed over the tray or container during or after the overwrapping is placed over the tray or container.

In one aspect, a tray is described. The tray comprises a base having a base perimeter. The tray also comprises a wall extending upward from the base perimeter. The wall is continuous around the base perimeter. The wall includes an inner wall surface and an outer wall surface. The wall includes a first end at the base perimeter and a second end opposite the first end. The tray further includes a flange extending outward from the second end of the wall. The flange includes one or more hinges, a top flange surface, a bottom flange surface, and a trim edge. The flange and the one or more hinges extend continuously around the second end of the wall. At least a portion of the flange is configured to be folded downward such that at least a portion of the bottom flange surface is closer to the outer wall surface after being folded.

In another aspect, a method of manufacturing a tray is described. The method comprises forming a base having a base perimeter and a wall extending upward from the base perimeter. The wall is continuous around the base perimeter. The wall includes an inner wall surface and an outer wall surface. The wall includes a first end at the base perimeter and a second end opposite the first end. The method also includes forming a flange extending outward from the second end of the wall. The flange includes one or more hinges, a top flange surface, a bottom flange surface, and a trim edge. The flange and the one or more hinges extend continuously around the second end of the wall. At least a portion of the flange is configured to be folded downward such that at least a portion of the bottom flange surface is closer to the outer wall surface after being folded.

Other implementations will become apparent to those of ordinary skill in the art by reading the following detailed description, with reference where appropriate to the accompanying drawings.

BRIEF DESCRIPTION OF THE DRAWINGS

Example embodiments are described herein with reference to the drawings.

Figure 1:
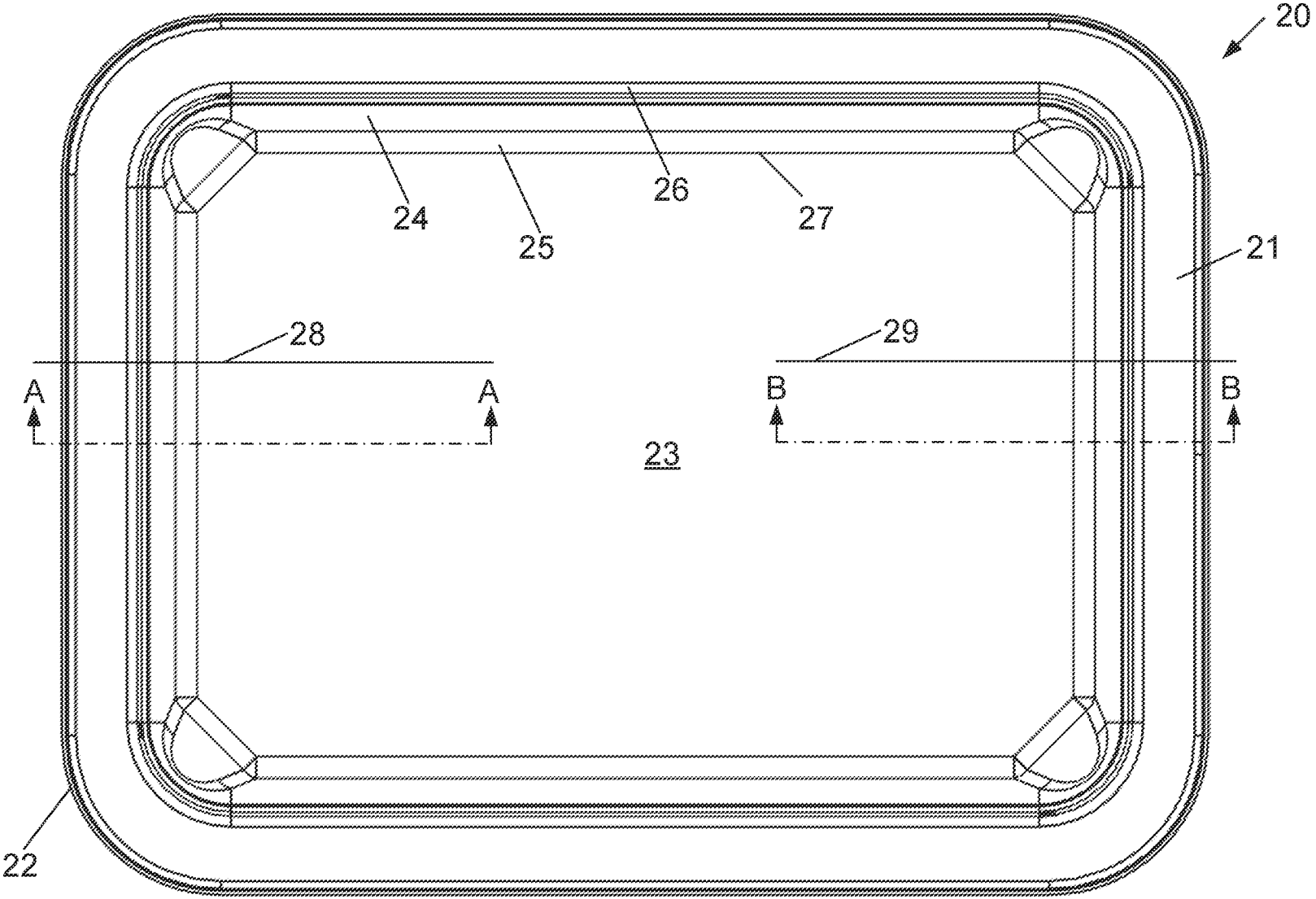
FIG. 1 shows a top view of a hinge-less tray.

All the figures are schematic, not necessarily to scale, and generally show parts which are necessary to explain example embodiments, wherein other parts may be omitted or merely suggested.

DETAILED DESCRIPTION

I. Introduction

This description describes aspects and example embodiments (i.e., implementations) of and/or pertaining to a tray (i.e., an article of manufacture).

The trays of the example embodiments can be formed using various processes, such that the trays of the example embodiments comprises a thermo-formed tray, an injection molded tray, or a compression molded tray.

The trays of the example embodiments is made of a material. As an example, the material used to make the tray comprises polyethylene terephthalate (PET), amorphous polyethylene terephthalate (APET), crystalline polyethylene terephthalate (CPET), recycled polyethylene terephthalate (RPET), polyethylene terephthalate glycol-modified (PETG), polylactic acid (PLA), polypropylene, high impact polystyrene sheet (HIPS), or pulp fiber. Other examples of the material are possible.

At least some of the trays described in this description includes one or more hinges. The one or more hinges can be formed by coining the material, creasing the material, contacting the material with a serrated blade, contacting the material with a heated serrated blade, thinning the material, contacting the material with a creasing knife, contacting the material with a heated creasing knife, or contacting the material with a punch and die. Other examples of a process or step for forming a hinge on a tray of the example embodiments are also possible. In accordance with at least some embodiments including multiple hinges within a flange, at least one of the hinges is continuous (i.e., a continuous hinge) and at least one of the hinges is non-continuous (i.e., a non-continuous hinge).

A hinge can have a uniform width. Alternatively, a hinge can have a width that varies. As an example, a hinge can have a first width within the straight portions of the hinge and a second width within curved portions of the hinge. The curved portions (i.e., transition portions or transition hinge portions) can join two straight portions of the hinge and vice versa. In accordance with the foregoing example, the first width can be wider than the second width or vice versa. Additionally, in accordance with the foregoing example, the curved (transition) portions can be disposed at a corner of the flange. In at least some embodiments, a width of the transition hinge portion is wider than a width of a first hinge portion (e.g., a first straight portion of the hinge) and a width of a second hinge portion (e.g., a second straight portion of the hinge).

A hinge can have a uniform depth. Alternatively, a hinge can have a depth that varies. As an example, a hinge can have a first depth within the straight portions of the hinge and a second depth within curved portions of the hinge. In accordance with the foregoing example, the first depth can be deeper than the second depth or vice versa. In at least some examples, the depth of the hinge formed in trays can be varied by varying how far a knife moves within the flange of those trays.

A hinge of the example embodiments can include interrupted cuts within the material. A hinge of a hinged tray can abut an end of a wall of the tray. The interrupted cuts can be formed using a serrated knife or via some other means. A hinge of a hinged tray can abut a trim end of the tray. A hinge of a hinged tray can abut a pocket of the tray. A hinge of a hinged tray can abut a step of a pocket of the tray.

The trays of the example embodiments can have any of a variety of a shapes. For example, a tray of the example embodiments can be rectangular, square, circular, oval, heart-shaped or some other shape.

In this description, the articles "a," "an," and "the" are used to introduce elements and/or functions of the example embodiments. The intent of using those articles is that there is one or more of the introduced elements and/or functions.

Figure 2:
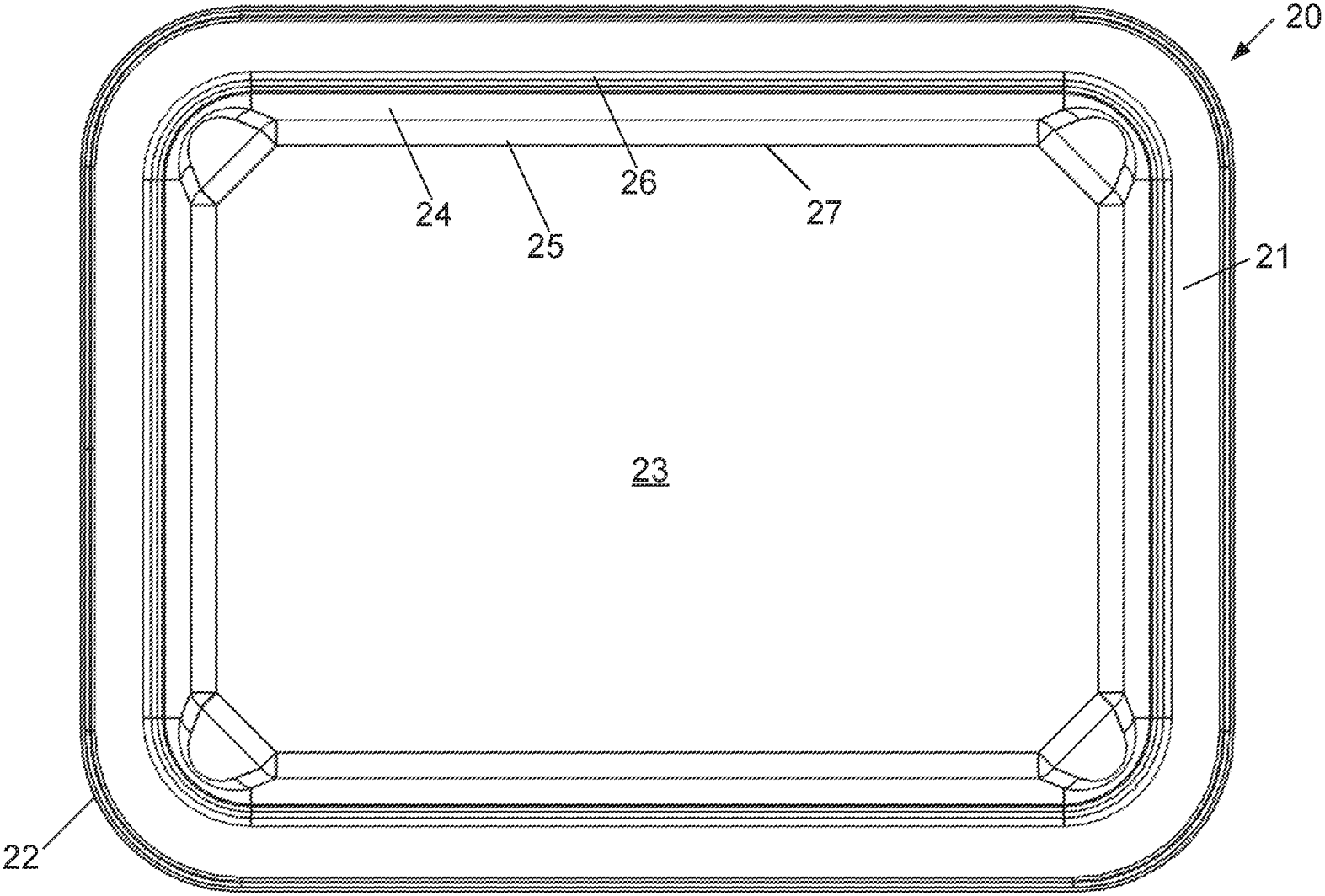
FIG. 2 shows a bottom view of the hinge-less tray shown in FIG. 1.
Figure 3:
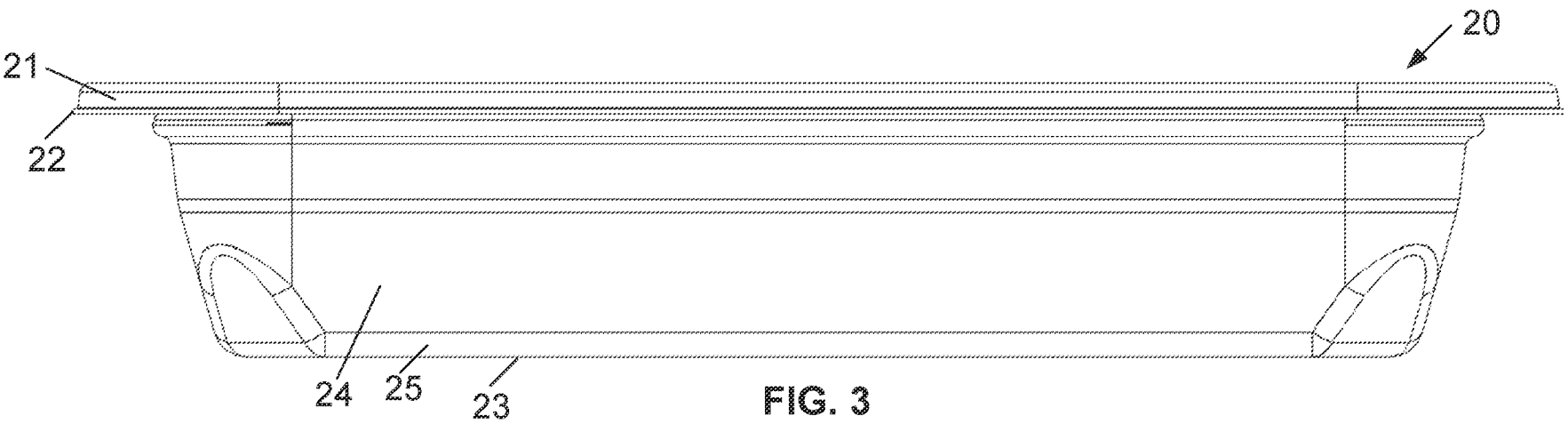
FIG. 3 and FIG. 4 show an elevation view of the hinge-less tray shown in FIG. 1.
Figure 4:
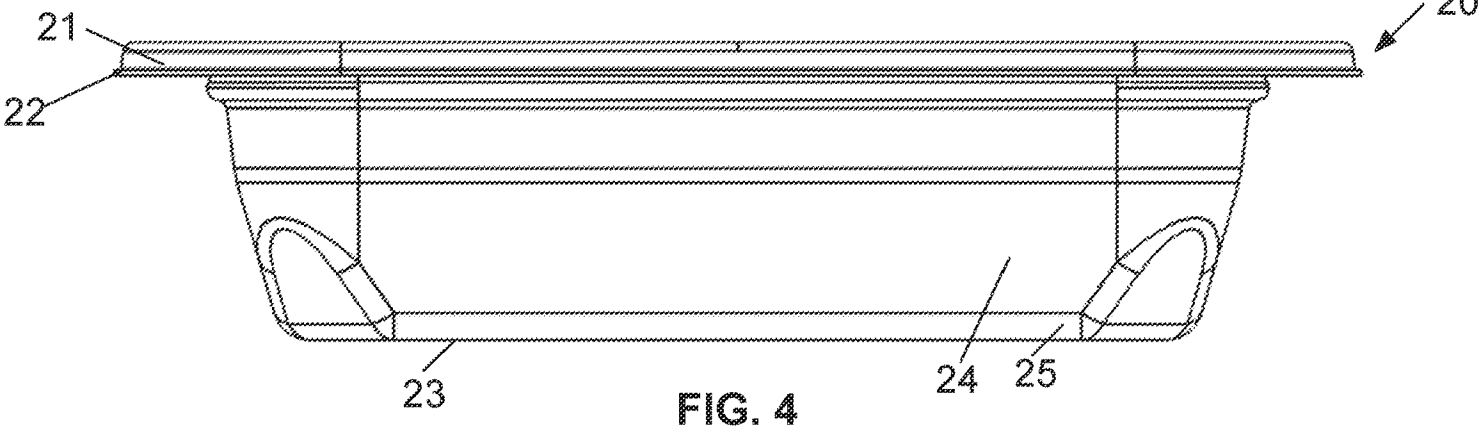
Figure 6:
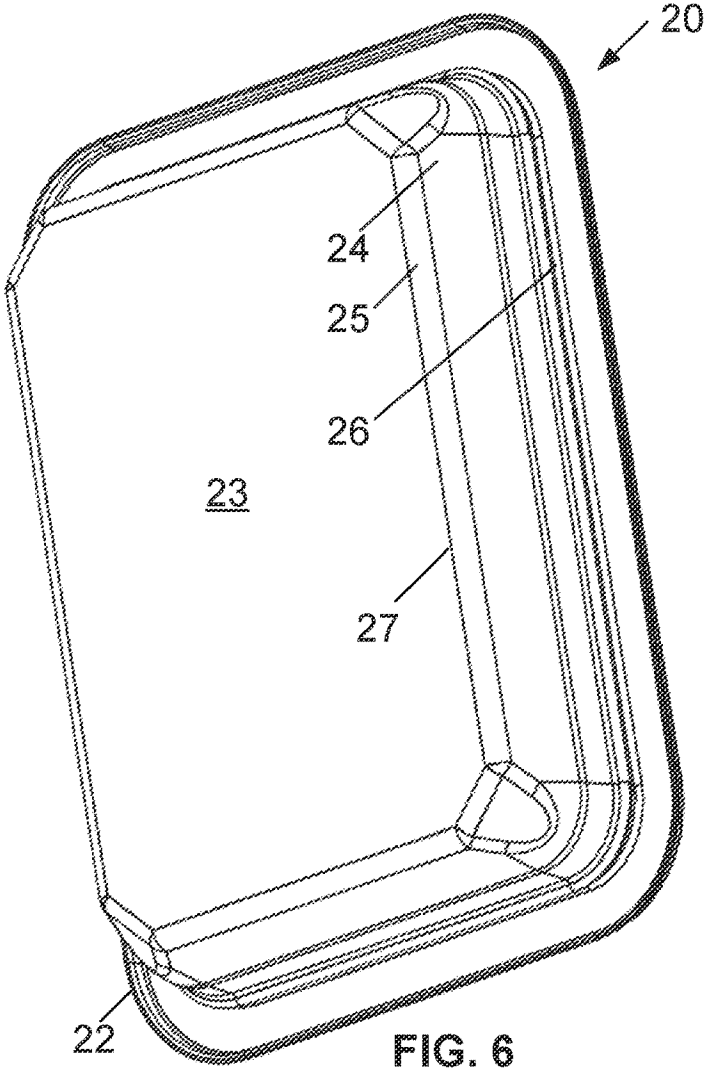
FIG. 5 and FIG. 6 show a perspective view of the hinge-less tray shown in FIG. 1.
Figure 5:
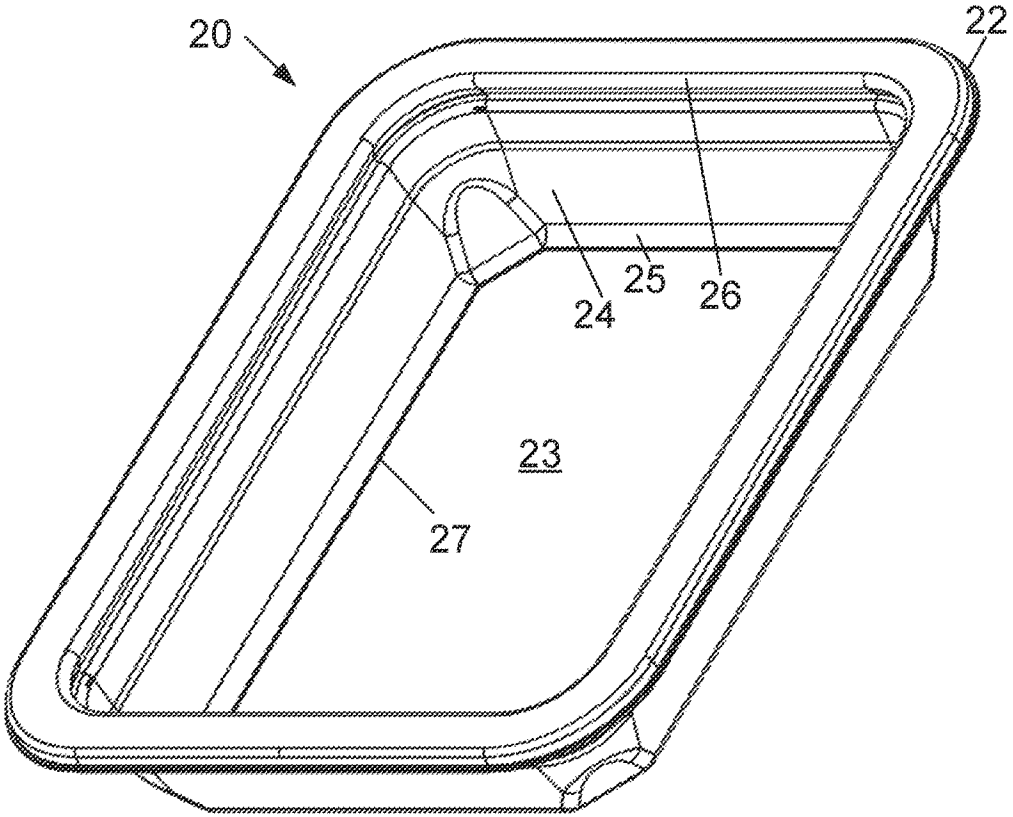

FIG. 1 to FIG. 6 show different views of a tray 20. In particular, FIG. 1 shows a top view of the tray 20, FIG. 2 shows a bottom view of the tray 20, FIG. 3 shows an elevation view of the tray 20, FIG. 4 shows another elevation view of the tray 20, FIG. 5 shows a perspective view of the tray 20, and FIG. 6 shows a perspective view of the tray 20. Based on the top view of the tray 20, a top of the tray 20 has a substantially rectangular shape with rounded corners, but can be arranged with a different shape.

The tray 20 is a hinge-less tray (i.e., a tray without a hinge). As shown in one or more of FIG. 1 to FIG. 6, the tray 20 includes a flange 21, a trim edge 22, a base 23, and a wall 24. The wall 24 includes a first end 25 and a second end 26. The first end 25 and the second end 26 are at opposite ends of the wall 24. The wall 24 extends continuously around the base 23. The flange 21 extends continuously around an entirety of the second end 26 of the wall 24. The trim edge 22 extends continuously around the flange 21. The base 23 includes and/or is defined by a base perimeter 27. As shown in FIG. 1, FIG. 2, and FIG. 6, the base perimeter 27 has an irregular octagon shape, but could be arranged with a different shape.

The base 23 has an interior surface and an exterior surface. FIG. 1 shows the interior surface of the base 23. FIG. 2 shows the exterior surface of the base 23. The wall 24 has an inner wall surface and an outer wall surface. FIG. 1 shows the inner wall surface of the wall 24. FIG. 2 shows the outer wall surface of the wall 24. A base of a tray, such as the base 23 or any other base of a tray, can have a portion that is flat and/or a portion that is rounded, or can be flat or rounded.

FIG. 1 includes a section line A-A, a section line B-B, a line 28 to indicate where a section view based on the section line A-A ends, and a line 29 to indicate where a section view based on the section line B-B ends. Those section views are shown in FIG. 7.

Figure 7:
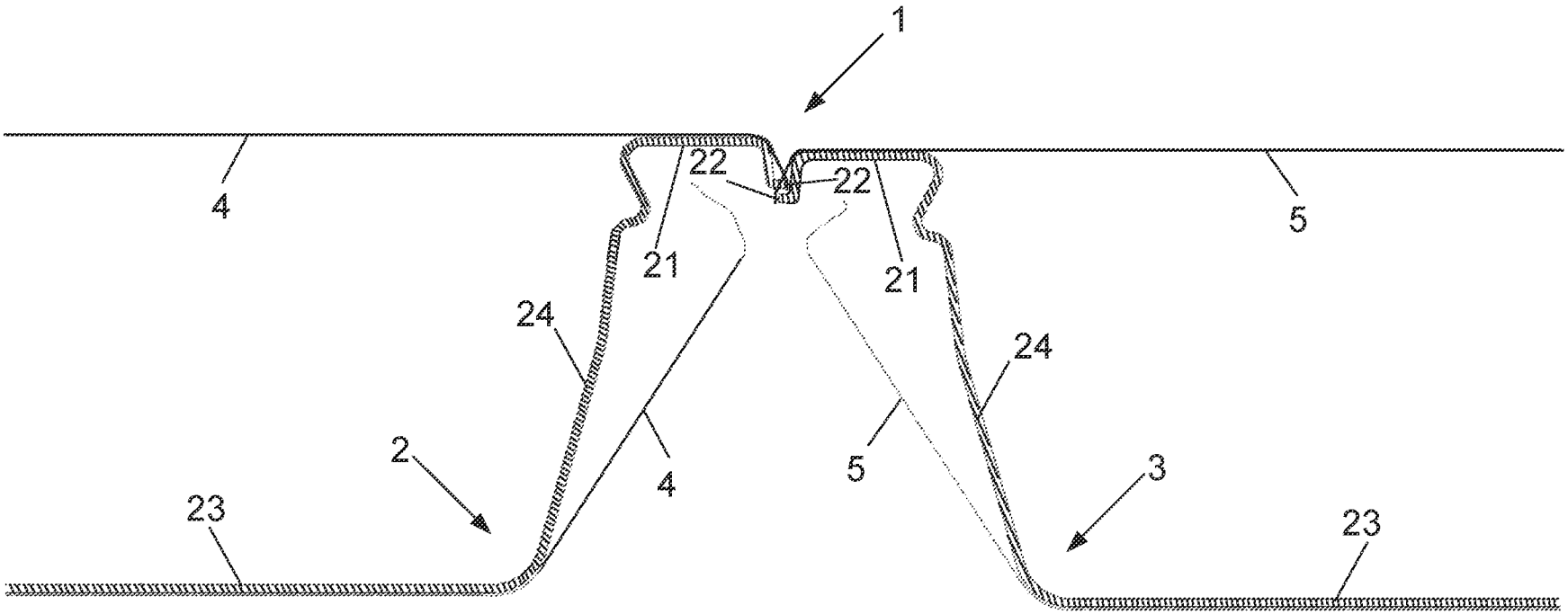
FIG. 7 shows an arrangement of hinge-less trays.

Next, FIG. 7 shows an arrangement 1 showing portions of a first instance 2 of the tray 20 based on section line B-B, and a second instance 3 of the tray 20 based on section line A-A. The arrangement 1 also includes an overwrap 4 corresponding to the first instance 2 of the tray 20 and an overwrap 5 corresponding to the second instance 3 of the tray 20. The overwrap 4 can be applied to the first instance 2 of the tray 20 to protect a content of that instance of the tray. The overwrap 5 can be applied to the second instance 3 of the tray 20 to protect a content of that instance of the tray. The overwrap 4, 5 are not shown in FIG. 1. The first instance 2 of the tray 20 and the second instance 3 of the tray 20 each includes the flange 21, the trim edge 22, the base 23, the wall 24.

As noted above, a tray can be made using polyethylene terephthalate (PET) or another material that results in a trim edge having a sharp tear point with respect to an overwrap applied to the tray or to an overwrap applied to another tray proximate the trim edge. The trim edge of a tray made of PET is more rigid/stiff than the trim edge of a traditional foam trays made of polystyrene. In many cases, the trim edge is more likely to act as a sharp tear point when tray has been packed with content, such as a pound of fruit, vegetables, or meat.

In that regard, FIG. 7 shows the overwrap 4, 5 is torn. As an example, the overwrap 4 can be torn as a result of the trim edge 22 of the second instance 3 of the tray 20 making contact and piercing the overwrap 4, and the overwrap 5 can be torn as a result of the trim edge 22 of the first instance 2 of the tray 20 making contact and piercing the overwrap 5. In some instances, an overwrap and trim edge of two trays can contact one another during shipment of the trays via a vehicle traveling on a bumpy road or at some other point during the shipment.

II. Example Embodiments

Figure 8:
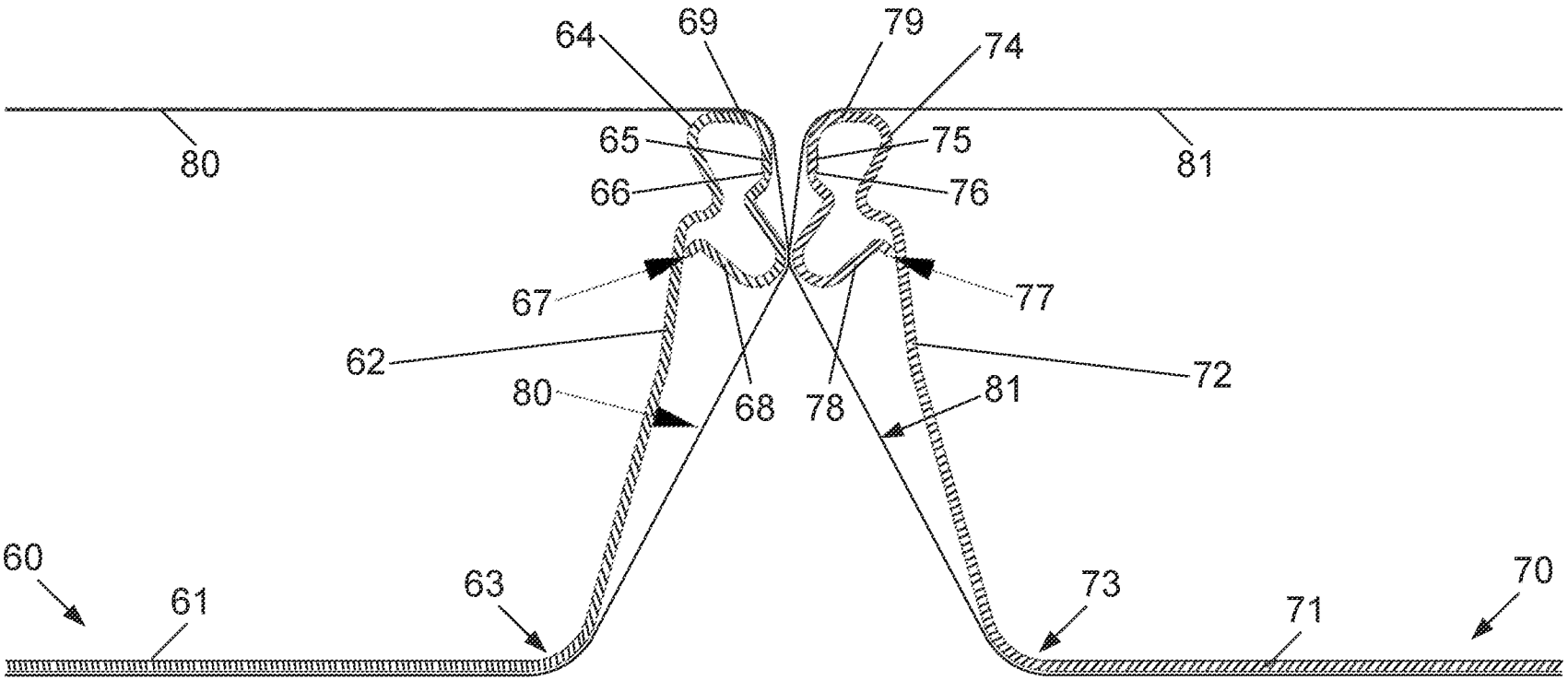
FIG. 8 shows an arrangement of hinged trays.

Next, FIG. 8 shows aspects of a tray 60 and a tray 70. The tray 60 includes a base 61, a wall 62, a first end 63 of the wall 62, a second end 64 of the wall 62, a flange 65 having a hinge 66 and a trim edge 67. Similarly, the tray 70 includes a base 71, a wall 72, a first end 73 of the wall 72, a second end 74 of the wall 72, a flange 75 having a hinge 76 and a trim edge 77.

A portion 68 of the flange 65 between the hinge 66 and the trim edge 67 is folded (e.g., bent) at and/or via the hinge 66. As an example, the portion 68 of the flange 65 can be folded prior to placement of an overwrap 80 onto the tray 60. As another example, the portion 68 of the flange 65 can be folded due to placement of the overwrap 80 onto the tray 60. In at least some embodiments, a portion 69 of the flange 65 between the hinge 66 and the second end 64 of the wall 62 is not folded as a result of folding the flange 65 at and/or via the hinge 66. In that regard, the portion 69 of the flange 65 remains unfolded (i.e., unbent).

Similarly, a portion 78 of the flange 75 between the hinge 76 and the trim edge 77 is folded (e.g., bent) at and/or via the hinge 76. As an example, the portion 78 of the flange 75 can be folded prior to placement of an overwrap 81 onto the tray 70. As another example, the portion 78 of the flange 75 can be folded due to placement of the overwrap 81 onto the tray 70. In at least some embodiments, a portion 79 of the flange 75 between the hinge 76 and the second end 74 of the wall 72 is not folded as a result of folding the flange 75 at and/or via the hinge 76. In that regard, the portion 79 of the flange 75 remains unfolded (i.e., unbent).

With the portion 68 of the flange 65 folded, a sharp tear point of the trim edge 67 is disposed away from the overwrap 80 and the overwrap 81. Similarly, with the portion 78 of the flange 75 folded, a sharp tear point of the trim edge 77 is disposed away from the overwrap 80 and the overwrap 81. As a result, movement of the tray 60 and the tray 70 relative to one another significantly reduces the likelihood that the trim edge 67 or the trim edge 77 will tear the overwrap 80, 81 applied to the tray 60, 70, respectively.

In accordance with at least some example embodiments in this description, the flange is configured to be folded via an application of an overwrap material to the tray, and the trim edge does not contact the overwrap material during or after application of the overwrap material to the tray. In accordance with at least some example embodiments in this description, the flange is configured to be pre-folded before an overwrap material is applied to the tray. In accordance with at least some example embodiments in this description, the flange is configured to be folded downward so that the trim edge contacts the outer wall surface. In accordance with at least some example embodiments in this description, the flange can also be folded upward.

Figure 9:
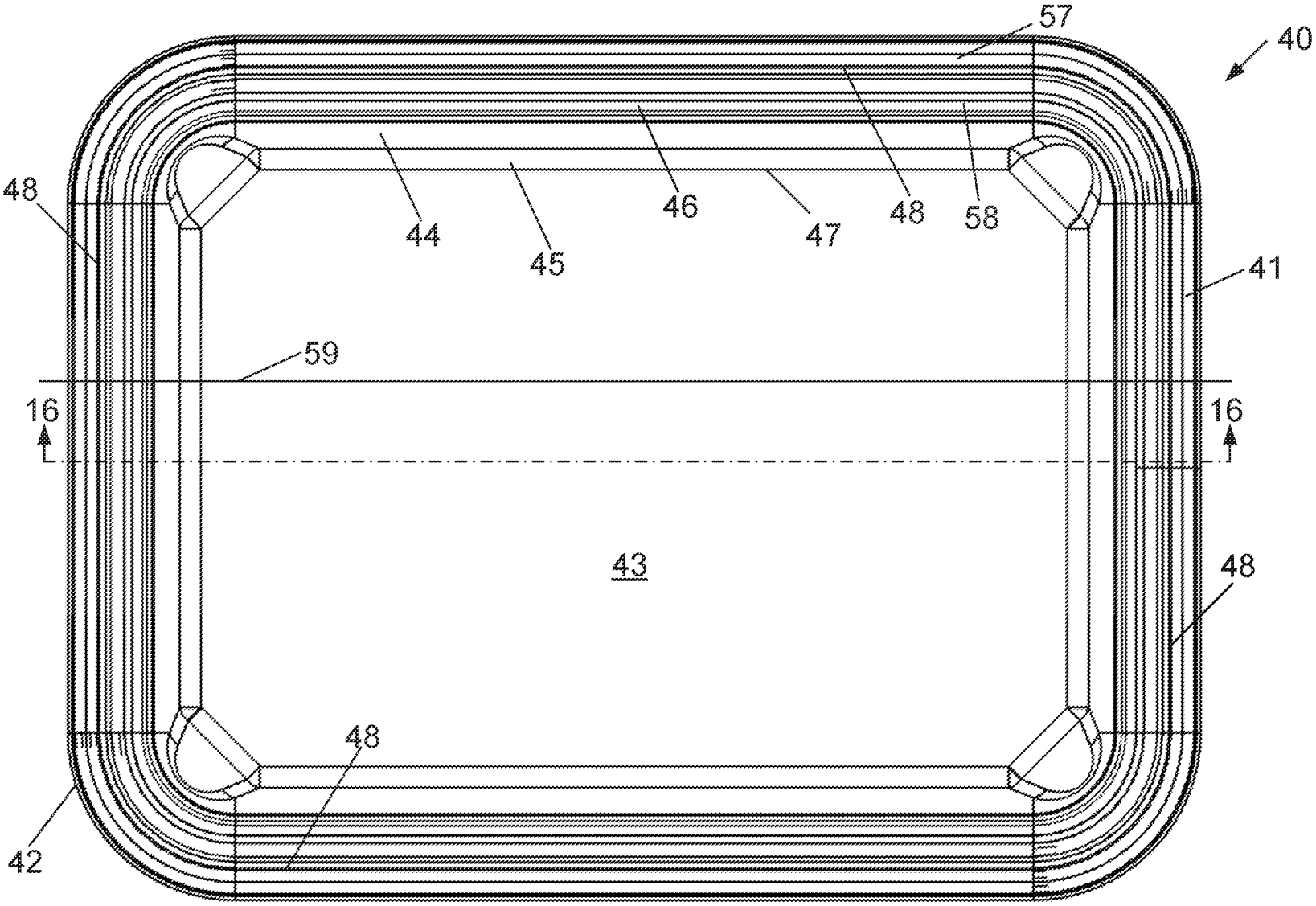
FIG. 9 shows a top view of a tray in accordance with the example embodiments.
Figure 10:
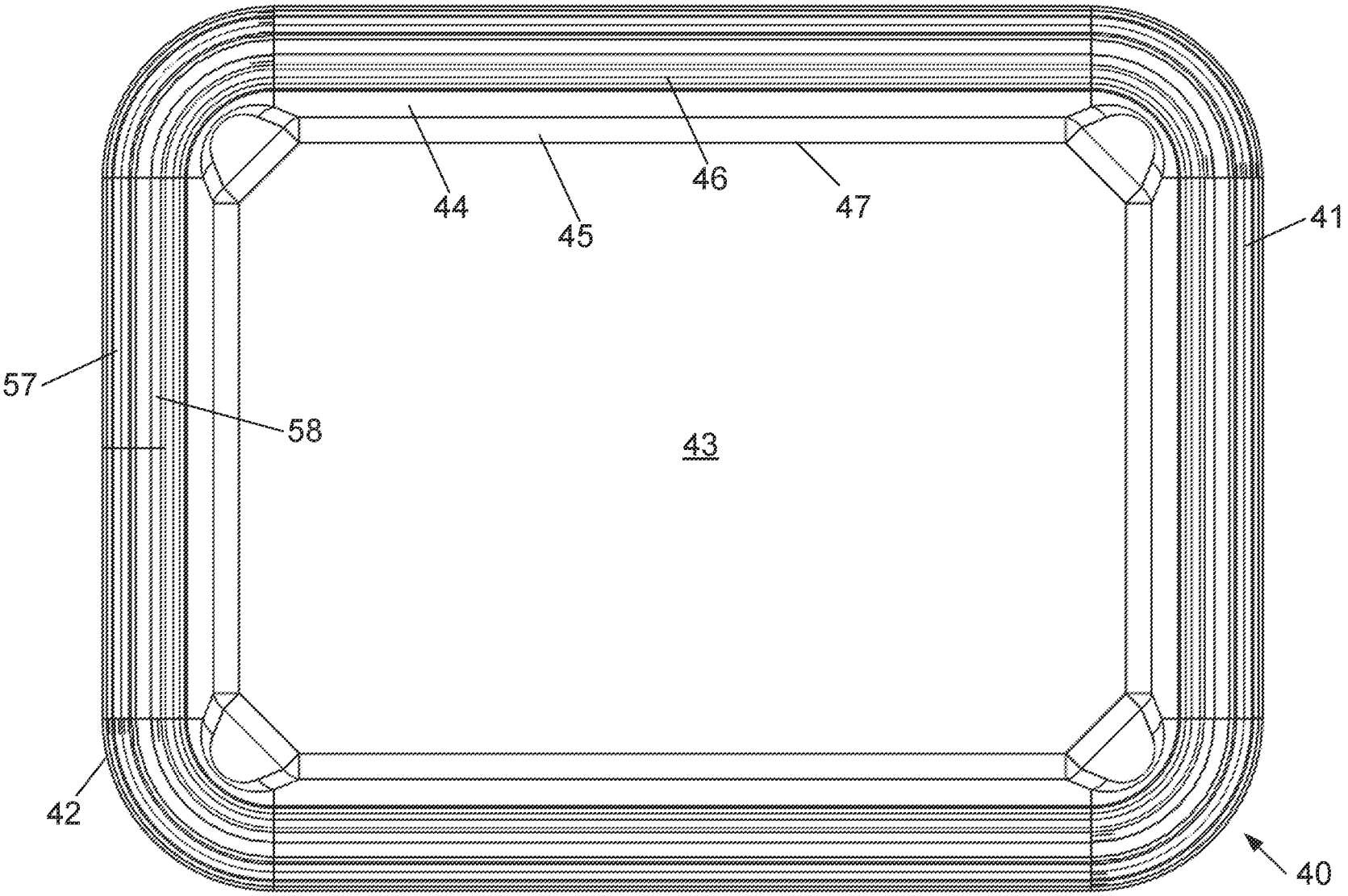
FIG. 10 shows a bottom view of the tray in accordance with the example embodiments.
Figure 11:
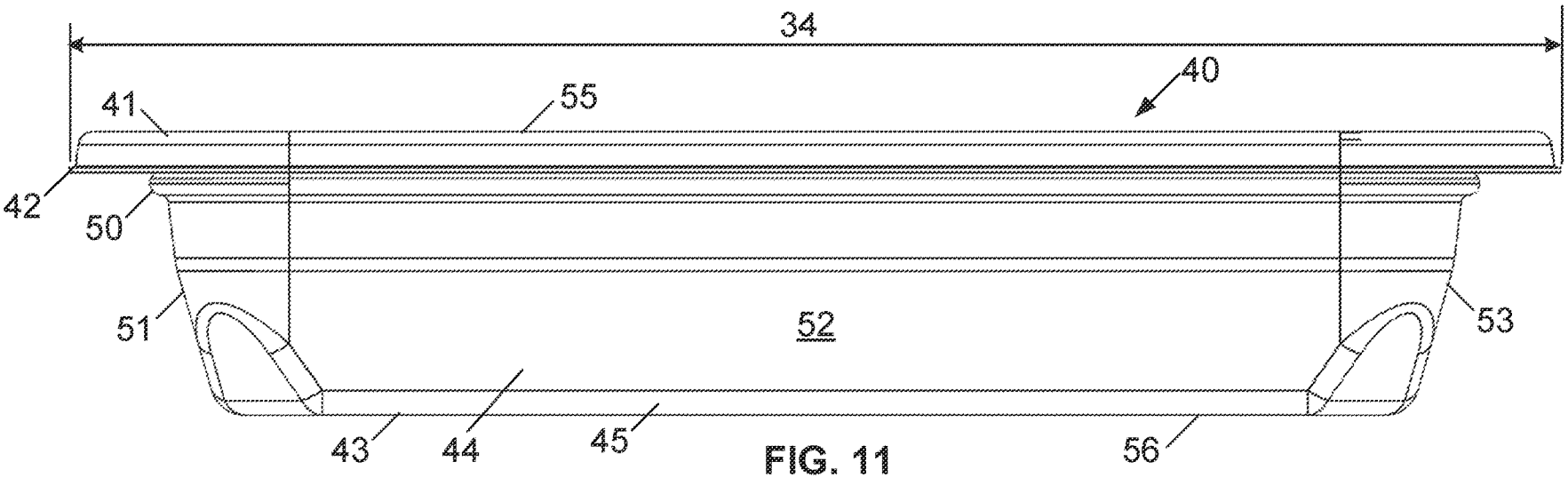
FIG. 11 and FIG. 12 show elevation views of the tray in accordance with the example embodiments.
Figure 12:
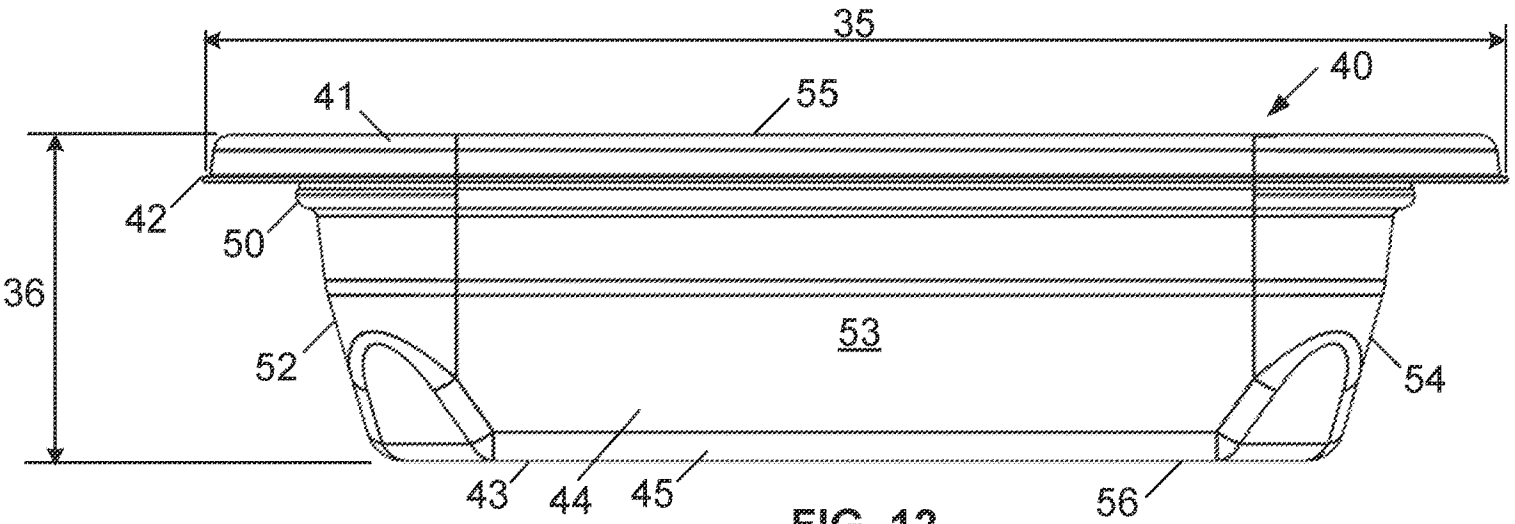
Figure 13:
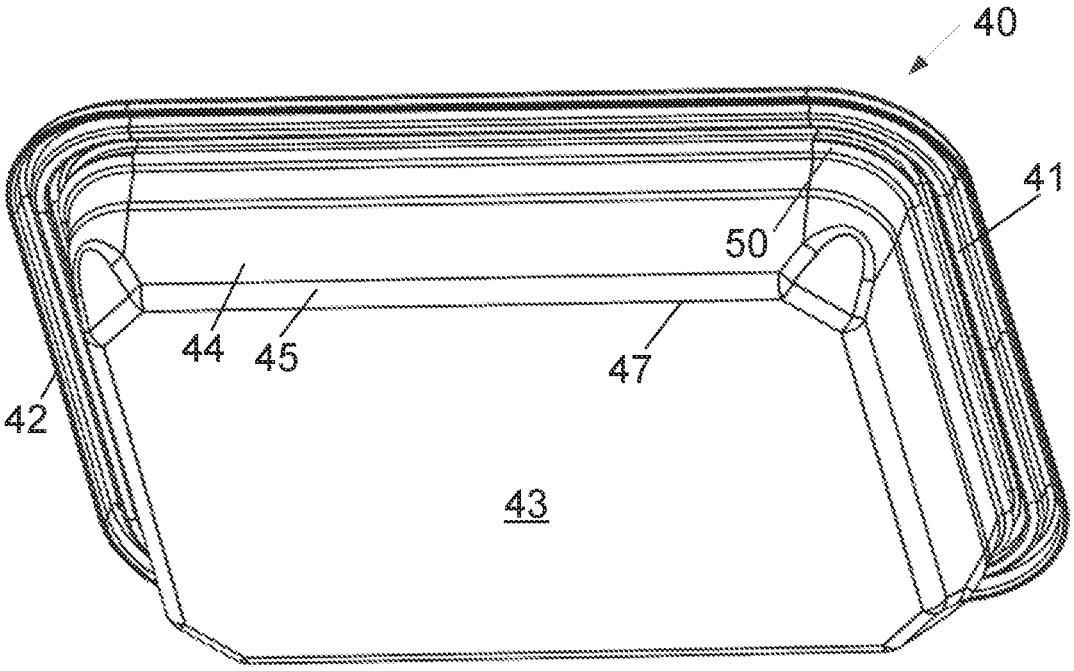
FIG. 13, FIG. 14, and FIG. 15 show perspective views of the tray in accordance with the example embodiments.
Figure 14:
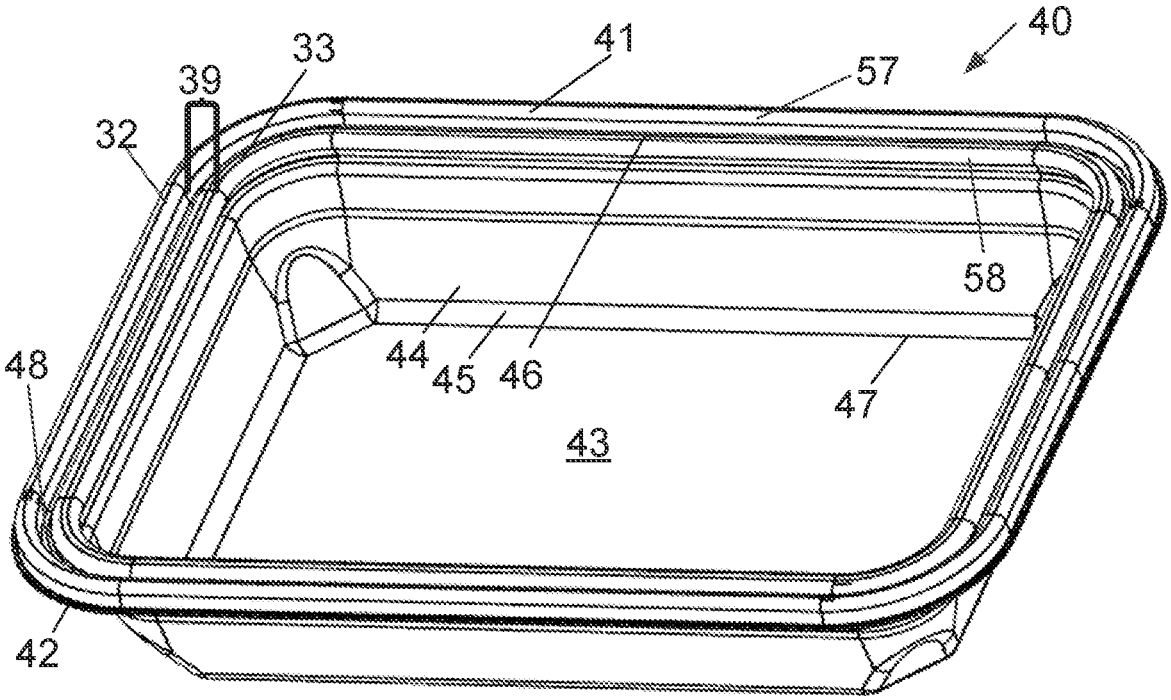
Figure 15:
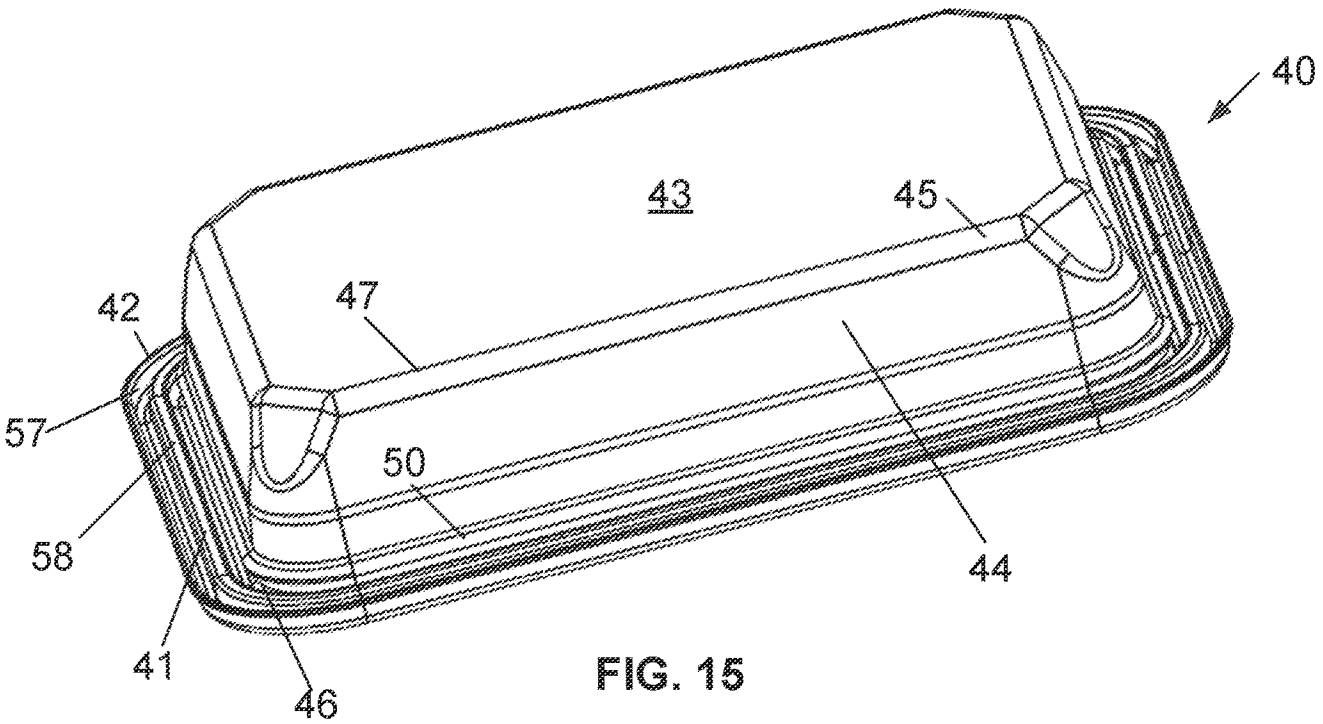
Figure 16:
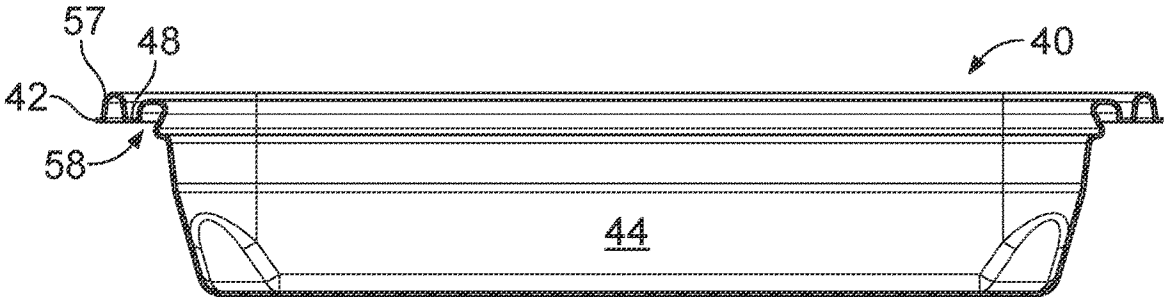
FIG. 16 is a section view of the tray in accordance with the example embodiments.

Next, FIG. 9 to FIG. 16 show different views of a tray 40. In particular, FIG. 9 shows a top view of the tray 40, FIG. 10 shows a bottom view of the tray 40, FIG. 11 and FIG. 12 show elevation views of the tray 40, and FIG. 13, FIG. 14, and FIG. 15 show perspective views of the tray 40. FIG. 9 includes a section line 16-16 and a line 59 to indicate where a section view based on the section line 16-16 ends. That section view is shown in FIG. 16.

Based on the top view of the tray 40 shown in FIG. 9, a top of the tray 40 has a substantially rectangular shape with rounded corners. The embodiments of this description are not limited to a tray having a substantially rectangular shape with rounded corners, but instead can have a different shape such as a circular shape, a hexagonal shape, a triangular shape or some other shape.

The tray 40 is a hinged tray (i.e., a tray with one or more hinges). As shown in one or more of FIG. 9 to FIG. 16, the tray 40 includes a flange 41, a trim edge 42, a base 43, a wall 44, and a hinge 48. The base 43 includes and/or is defined by a base perimeter 47. As shown in FIG. 9, FIG. 10, FIG. 13, and FIG. 15, the base perimeter 47 has an irregular octagon shape, but could be arranged with a different shape. In FIG. 9 to FIG. 16, the tray 40 is shown before the flange 41 is folded (e.g., bent) at and/or via the hinge 48.

The wall 44 includes a first end 45 (i.e., a first end of the wall 44) and a second end 46 (i.e., a second end of the wall 44). The first end 45 and the second end 46 are at opposite ends of the wall 44.

The wall 44 extends continuously around the base 43. For example, starting at any point on the base perimeter 47, the wall 44 continues around the base perimeter 47 until reaching the starting point without any breaks in the wall 44. With the base 43 positioned as shown in FIG. 11 and FIG. 12, the wall extends upward from the base 43. In accordance with embodiments in which the tray 40 has a substantially rectangular shape, the wall 44 can be described as having a first side 51, a second side 52, a third side 53, and a fourth side 54, as well as a top side 55 and a bottom side 56.

The flange 41 extends continuously around an entirety of the second end 46 of the wall 44. Stated another way, the flange 41 extends away from the second end 46 of the wall 44 (i.e., extends away from the entire second end 46 of the wall 44. The trim edge 42 extends continuously around the flange 41. The hinge 48 extends continuously around the flange 41. The hinge 48 can include a single cut or multiple interrupted cuts within the flange 41.

The flange 41 includes a portion 57 of the flange 41 between the hinge 48 and the trim edge 42. The flange 41 includes a portion 58 of the flange 41 between the hinge 48 and the second end 46 of the wall 44. In at least some embodiments, at least some of the portion 58 of the flange 41 is folded as a result of folding the flange 41 at and/or via the hinge 48. In at least some other embodiments, the portion 58 of the flange 41 is not folded as a result of folding the flange 41 at and/or via the hinge 48. In that regard, the portion 58 of the flange 41 remains unfolded (i.e., unbent).

As shown in FIG. 14, the flange 41 includes a pocket 39. The pocket 39 is disposed between an apex 32 (e.g., an high point) of the portion 57 of the flange 41 and an apex 33 (e.g., an high point) of the portion 58 of the flange 41. In accordance with at least some embodiments, a first portion of the flange (e.g., the portion 57) adjacent the pocket (e.g., the pocket 39) is flat, slanted, or rounded, and/or a second portion of the flange (e.g., the portion 58) adjacent the pocket (e.g., the pocket 39) is flat, slanted, or rounded. The hinge 48 is located within the pocket 39. In other embodiments, a hinge within the flange 41 can be located elsewhere on the portion 57 of the flange 41 or elsewhere on the portion 58 of the flange 41. In accordance with at least some embodiments, the portion 57 of the flange 41 and the portion 58 of the flange 41 have a radial shape. Accordingly, multiple portions of the flange 41 have a radial shape with the hinge 48 separating the portion 57 of the flange 41 and the portion 58 of the flange 41.

In accordance with at least some embodiments, the first portion of the flange and/or the second portion of the flange is arranged as a bumper (i.e., a flange bumper or a cushion). A flange bumper can be compressible. A flange bumper can have a rounded surface. An overwrap applied to a tray at the location of a flange bumper is less likely to tear when the overwrap at the flange bumper contacts the overwrap located at a flange bumper of another hinged tray during shipment or movement of the trays as compared to an overwrap applied to traditional trays.

The base 43 has an interior surface and an exterior surface. FIG. 9 shows the interior surface of the base 43 and FIG. 14 shows a portion of the interior surface of the base 43. FIG. 10, FIG. 13, and FIG. 15 shows the exterior surface of the base 43. The wall 44 has an inner wall surface and an outer wall surface. FIG. 9 shows at least a portion of the inner wall surface of the wall 44. FIG. 10, FIG. 11, FIG. 12 shows at least a portion of the outer wall surface of the wall 44. In at least some embodiments, the wall 44 includes a stacking ledge 50, as shown in at least FIG. 11.

The tray 40 can be manufactured using a mold and processes to generate a tray using an example material described in this description. In accordance with at least some embodiments, the hinge 48 is created within the flange 41 using any means described in this description as a way to generate a hinge 48. Other example means for creating the hinge 48 are also possible.

FIG. 11 and FIG. 12 indicate a length 34 of the tray 40, a length 35 of the tray 40, and a height 36 of the tray 40. The length 34 can be referred to as a longitudinal length of the tray 40. A longitudinal length of the flange 41 can equal the length 34. The length 35 can be referred to as a transverse length of the tray 40. A transverse length of the flange 41 can equal the length 35. A height of a tray wall can equal the height 36.

In embodiments arranged as a circular hinged tray, the tray can have a diameter, such as a first diameter of the top surface of tray and a second diameter of the bottom surface of the tray. In embodiments arranged as an elliptical hinged tray, the tray can have a first dimension for a semi-major axis of the top surface of the tray and a second dimension for a semi-minor axis of the top surface. The circular and elliptical hinged trays also have a height.

In accordance with at least some embodiments, a length of a flange of a tray (either or both the longitudinal or transverse length of the tray) is greater than a height of the wall of the tray. In other words, in those embodiments, a length of a tray is greater than a height of the tray.

In accordance with at least some other embodiments, a length of a flange of a tray (either or both the longitudinal or transverse length of the tray) is less than or equal to a height of the wall of the tray. In other words, in those other embodiments, a length of a tray is less than or equal to a height of the tray.

Next, FIG. 17 to FIG. 24 show views of the tray 40 in which the flange 41 has been folded (e.g., bent) at and/or via the hinge 48 disposed on the flange 41.

Figure 17:
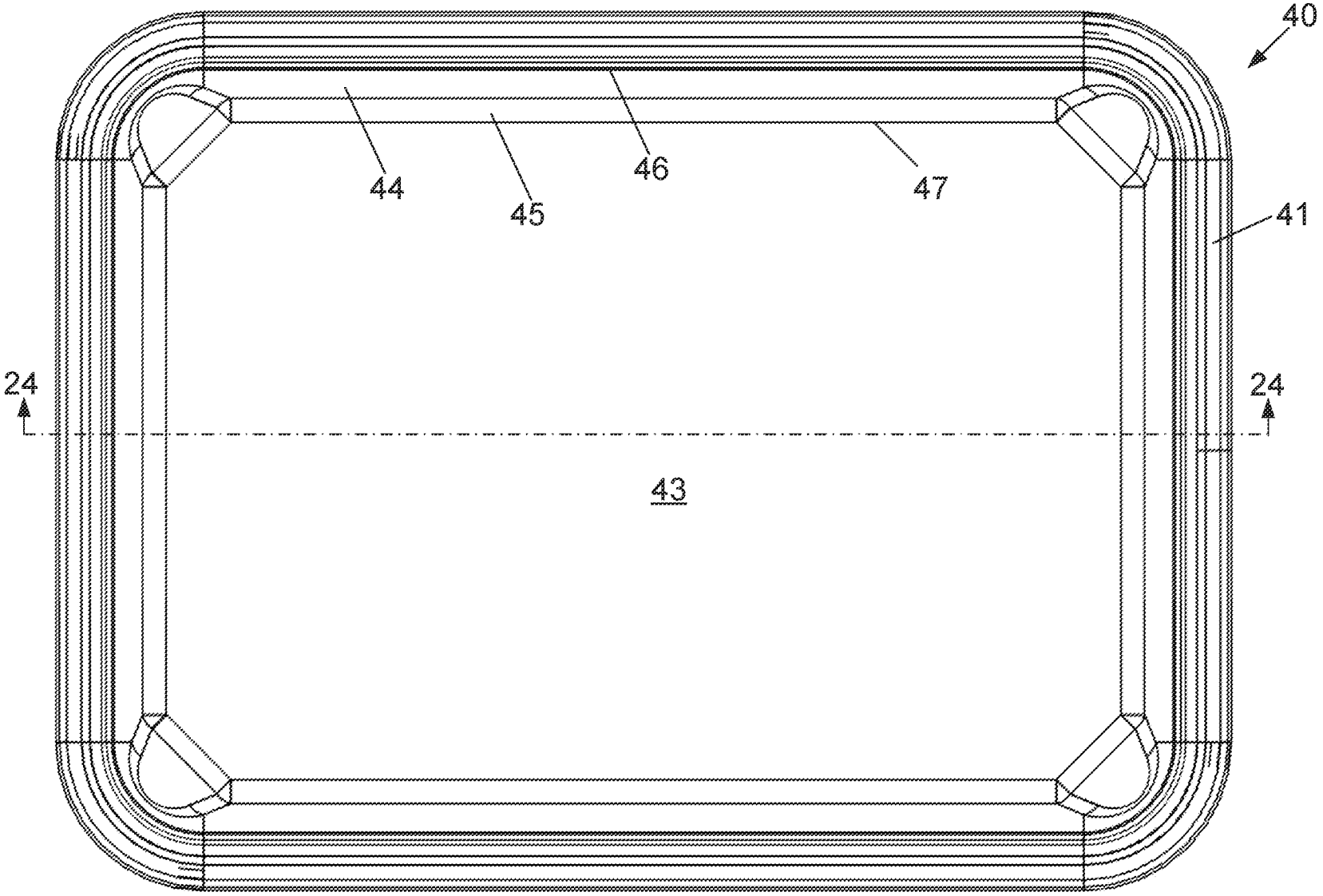
FIG. 17 shows a top view of a tray in accordance with the example embodiments.
Figure 18:
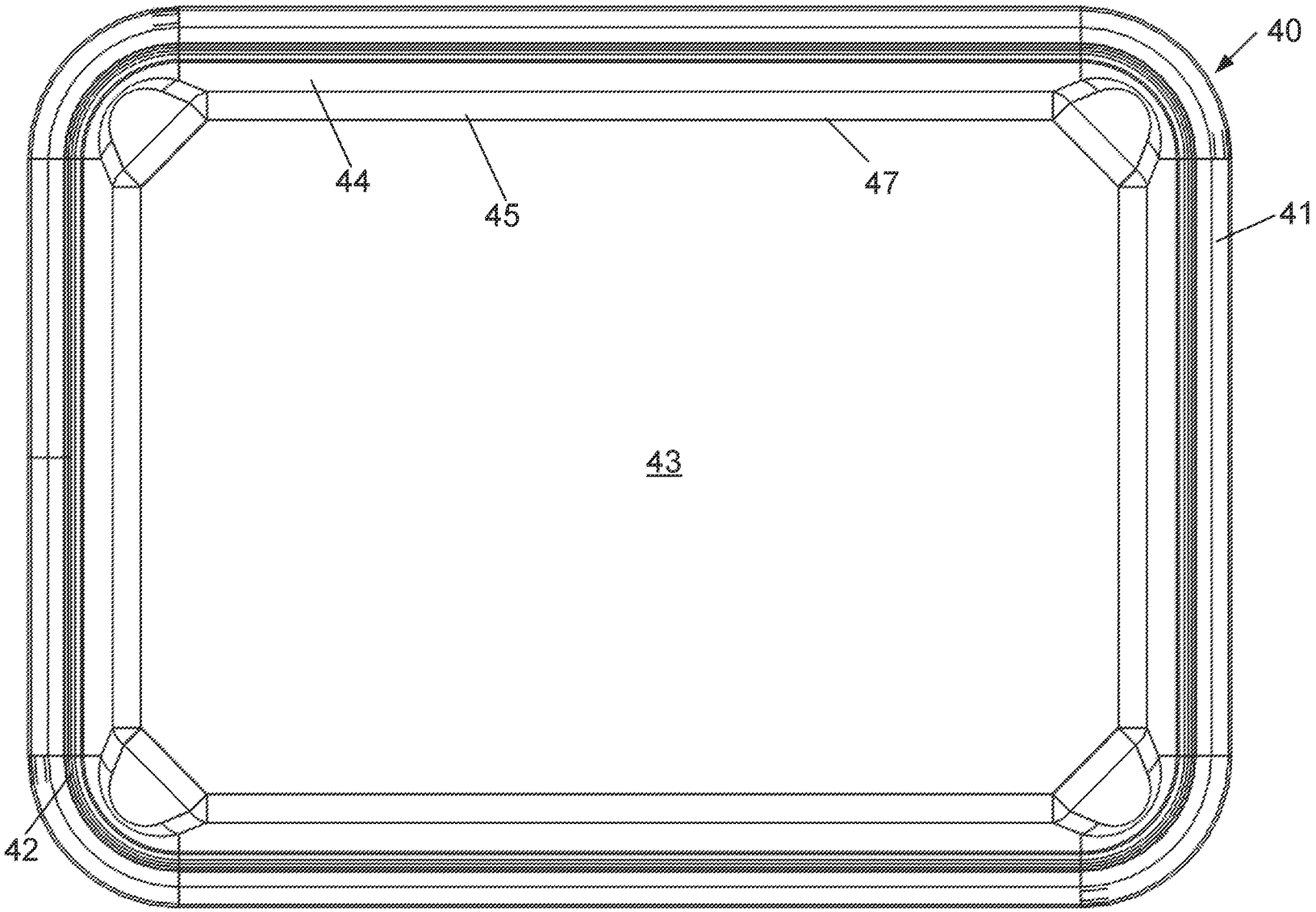
FIG. 18 shows a bottom view of the tray in accordance with the example embodiments.
Figure 19:
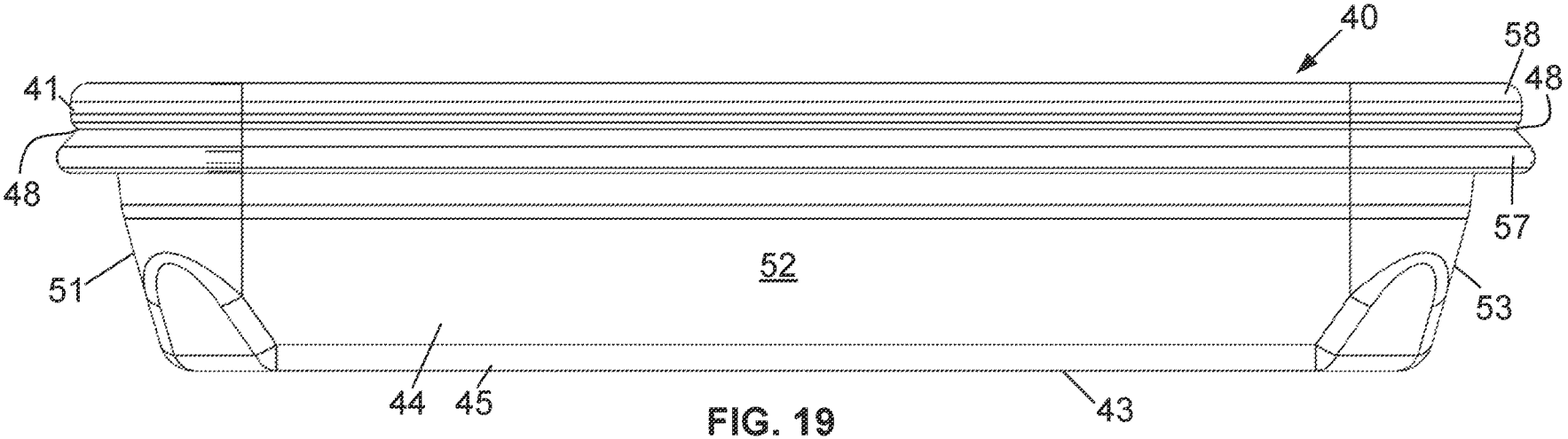
FIG. 19 and FIG. 20 show elevation views of the tray in accordance with the example embodiments.
Figure 20:
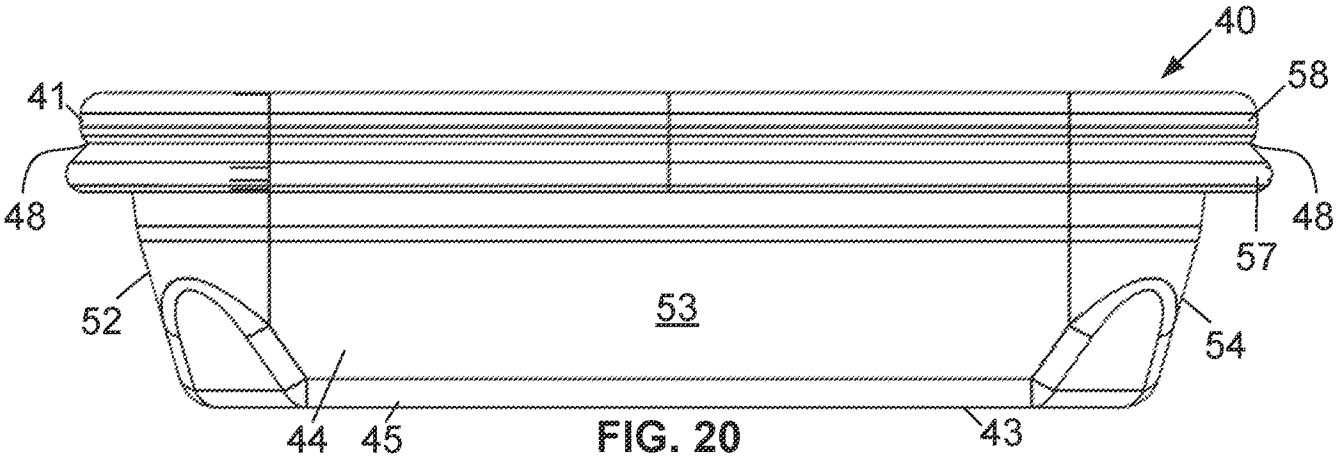
Figure 21:
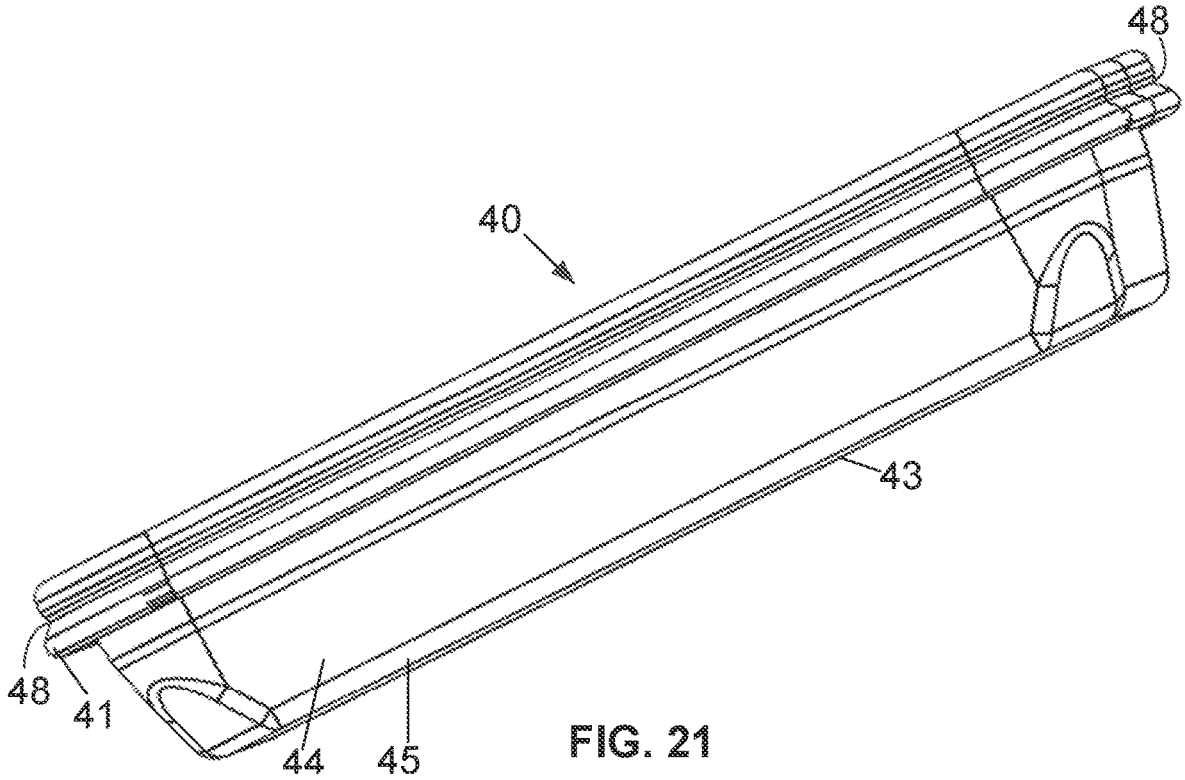
FIG. 21, FIG. 22, and FIG. 23 show perspective views of the tray in accordance with the example embodiments.
Figure 22:
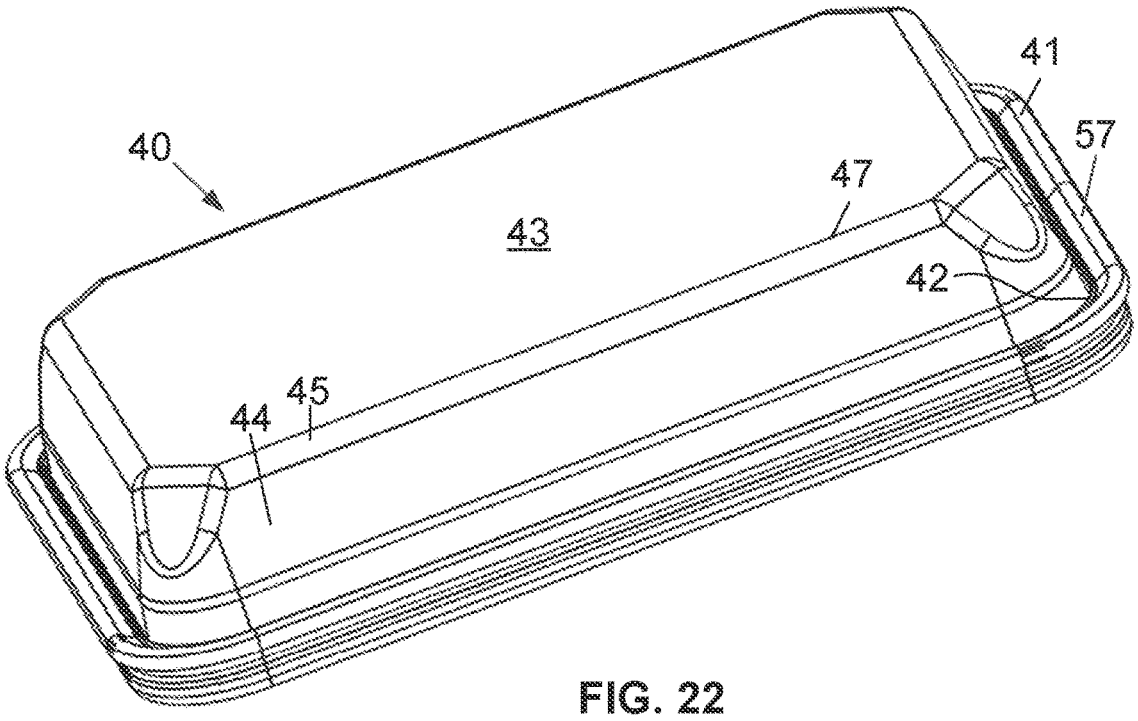
Figure 23:
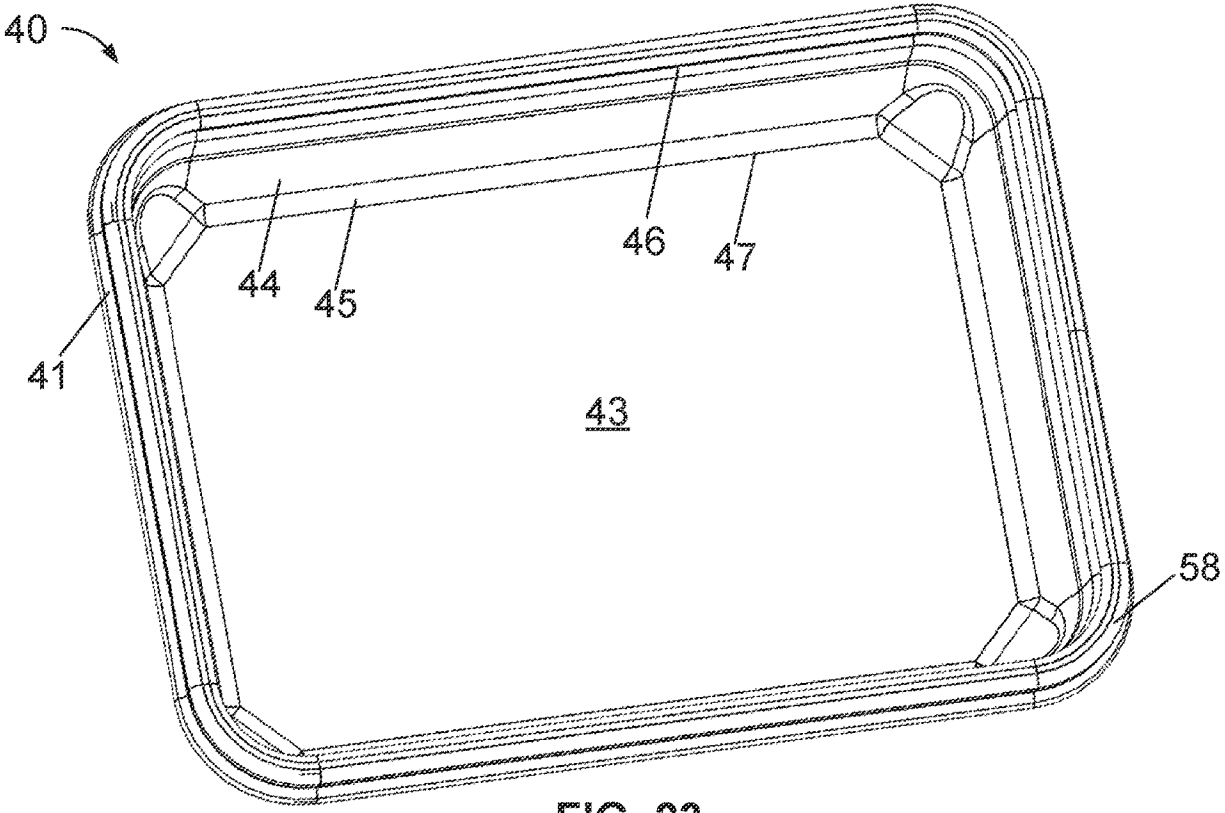

In particular, FIG. 17 shows a top view of the tray 40, FIG. 18 shows a bottom view of the tray 40, FIG. 19 and FIG. 20 show elevation views of the tray 40, and FIG. 21, FIG. 22, and FIG. 23 show perspective views of the tray 40. FIG. 17 includes a section line 24-24 corresponding to a section view shown in FIG. 24.

Based on the top view of the tray 40 shown in FIG. 17, a top of the tray 40 has a substantially rectangular shape with rounded corners after the flange 41 has been folded.

As shown in one or more of FIG. 17 to FIG. 24, the tray 40 includes the flange 41, the trim edge 42, the base 43, the wall 44, the base perimeter 47, and the hinge 48. FIG. 17, FIG. 18, FIG. 22, and FIG. 23 show the irregular octagon shape of the base perimeter 47. As noted above, the base perimeter 47 could be arranged with a different shape.

One or more of FIG. 17 to FIG. 24 show the first end 45 of the wall 44, the second end 46 of the wall 44, the first side 51, the second side 52, the third side 53, the fourth side 54, the top side 55, and the bottom side 56. One or more of FIG. 17 to FIG. 24 also show: (i) the portion 57 of the flange 41 between the hinge 48 and the trim edge 42, and (ii) the portion 58 of the flange 41 between the hinge 48 and the second end 46 of the wall 44. Various details regarding the aforementioned portions of the tray 40 and other aspects of the tray 40 are discussed above with respect to FIG. 9 to FIG. 16.

Figure 24:
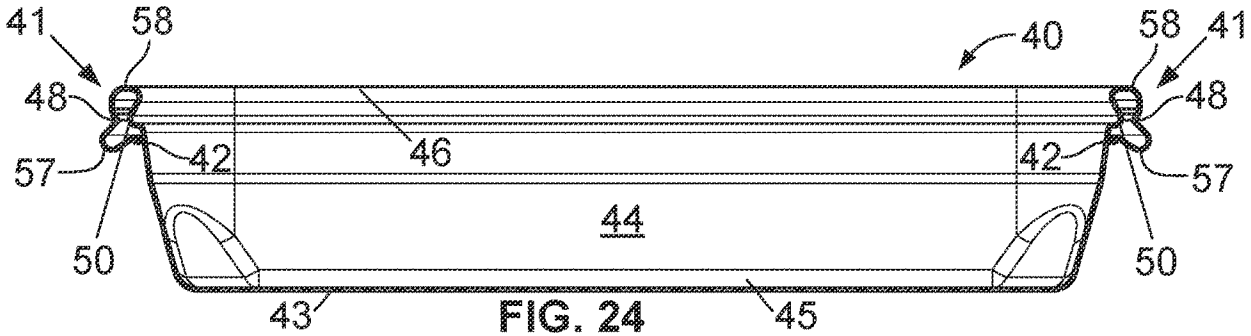
FIG. 24 shows a section view of the tray in accordance with the example embodiments.

As noted above, the base 43 has an interior surface and an exterior surface. FIG. 17 and FIG. 23 show the interior surface of the base 43. FIG. 18 and FIG. 22 show the exterior surface of the base 43. FIG. 17 and FIG. 23 show at least a portion of the inner wall surface of the wall 44. FIG. 18 to FIG. 22 show at least a portion of the outer wall surface of the wall 44. A portion of the stacking ledge 50 is shown in FIG. 24.

Figure 25:
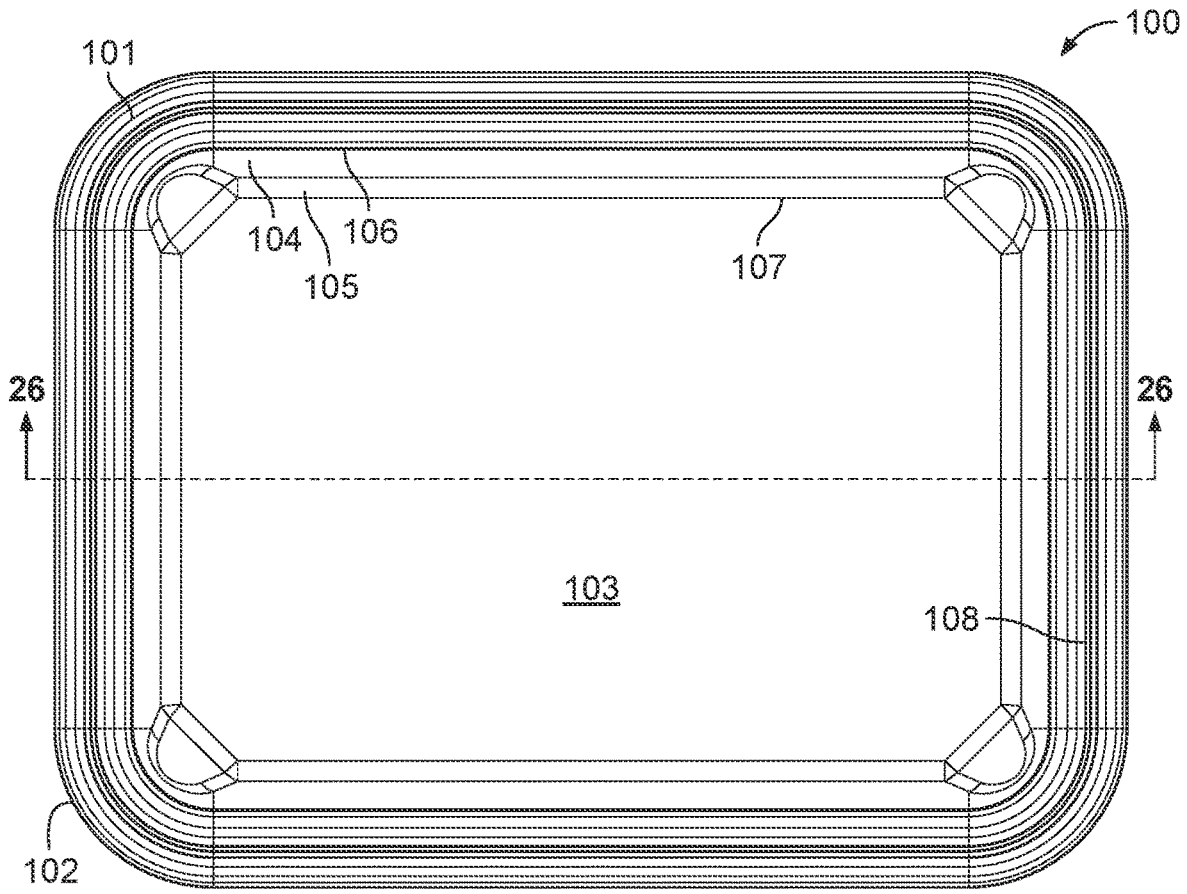
FIG. 25, FIG. 26, FIG. 27, and FIG. 28 show various views of a tray in accordance with the example embodiments.
Figure 26:
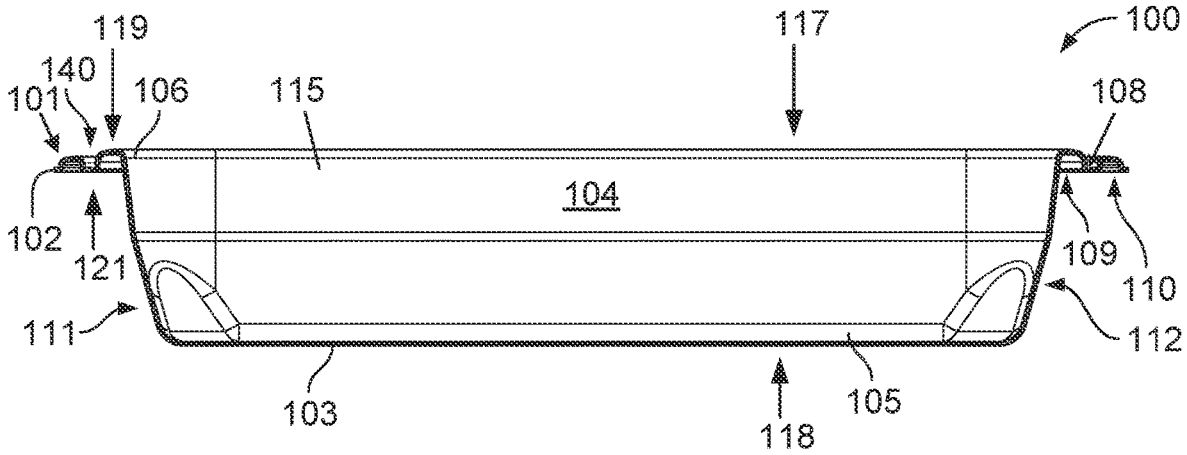
Figure 27:
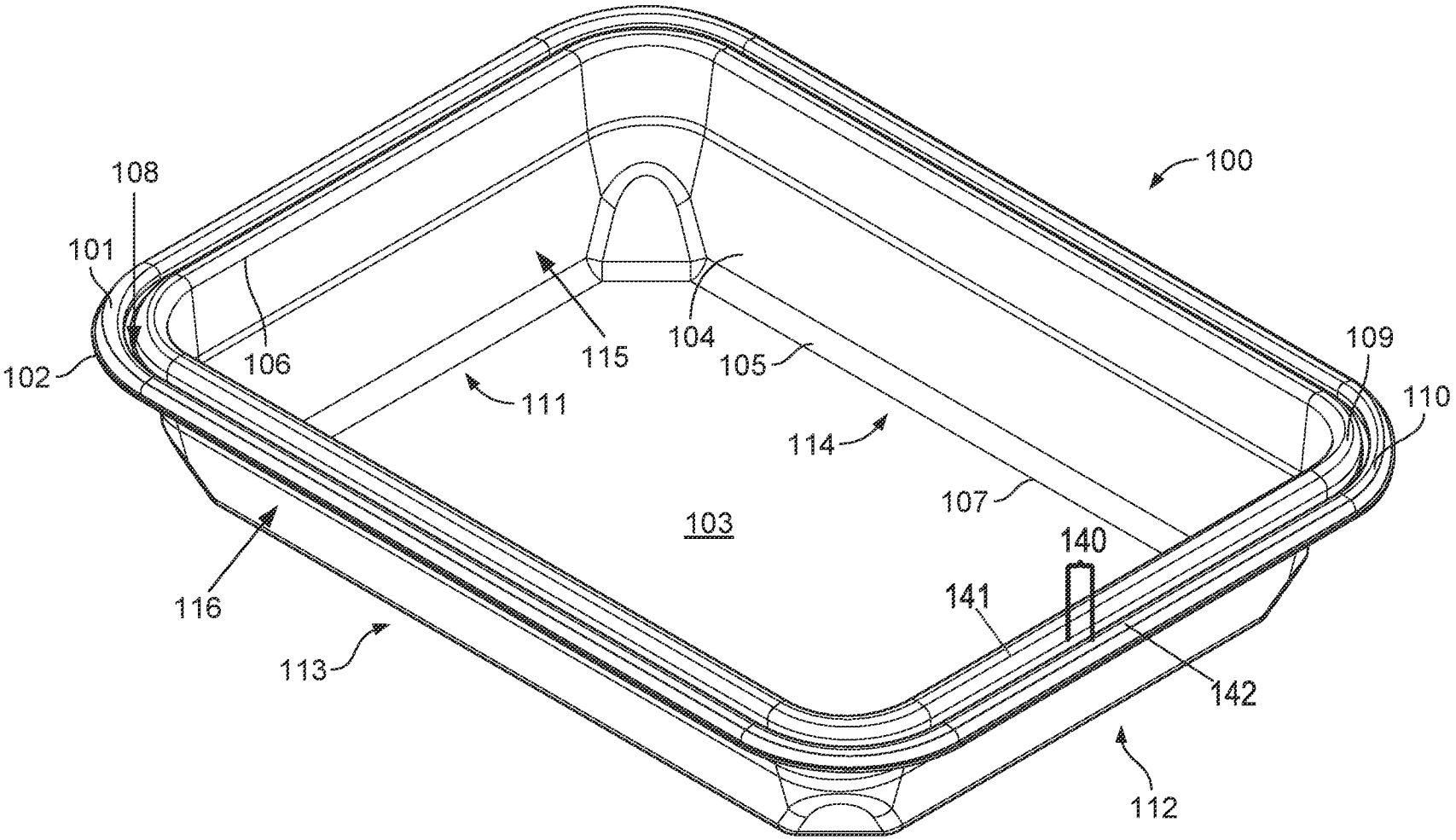
Figure 28:
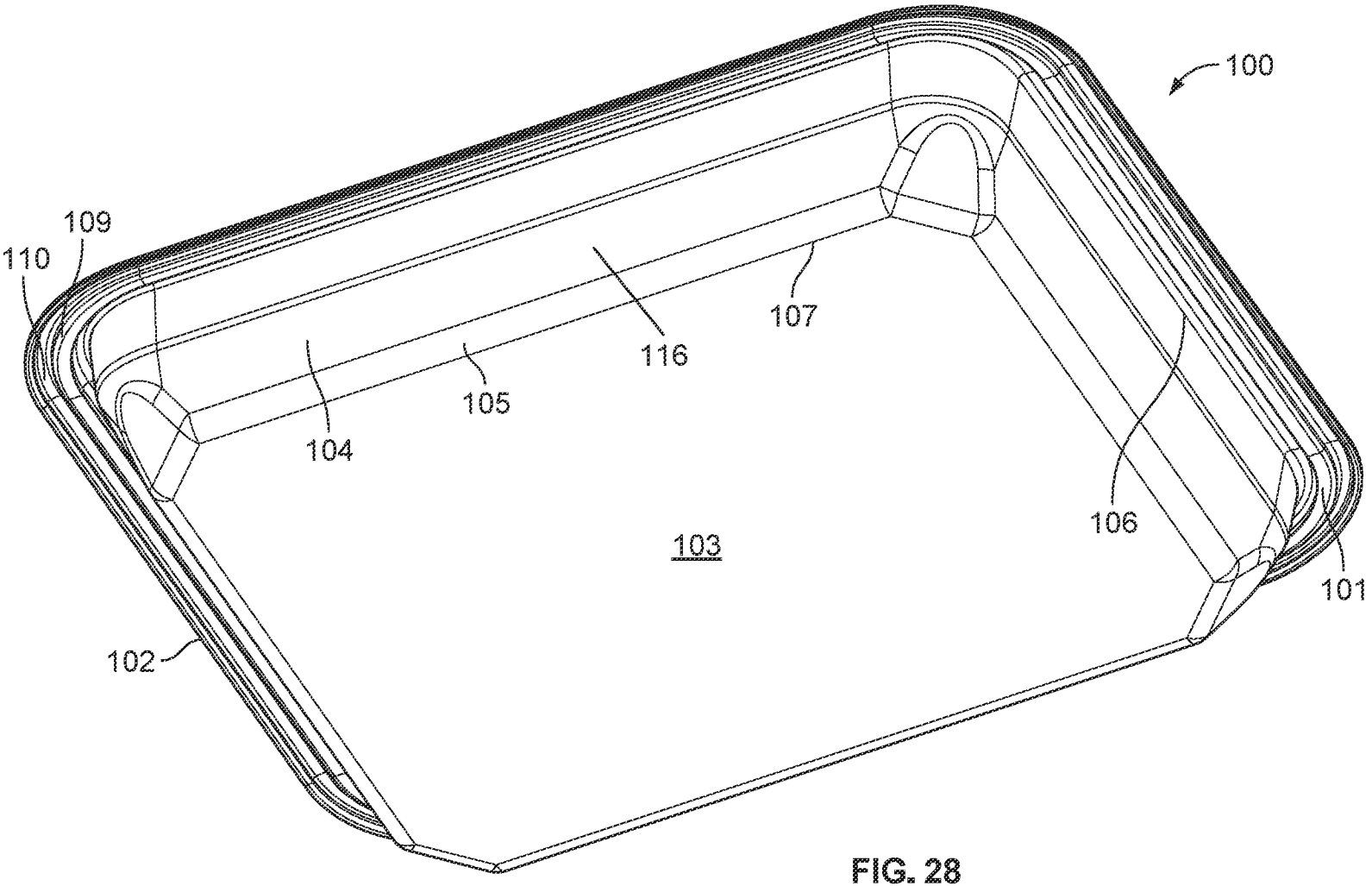

Next, FIG. 25 to FIG. 28 show different views of a tray 100. In particular, FIG. 25 shows a top view of the tray 100, FIG. 26 shows a section view of the tray 100, and FIG. 27 and FIG. 28 show perspective views of the tray 100.

Based on the top view of the tray 100 shown in FIG. 25, a top of the tray 100 has a substantially rectangular shape with rounded corners. The tray 100 is a hinged tray. As shown in one or more of FIG. 25 to FIG. 28, the tray 100 includes a flange 101, a trim edge 102, a base 103, a wall 104, and a hinge 108. The base 103 includes and/or is defined by a base perimeter 107. As shown in FIG. 25, the base perimeter 107 has an irregular octagon shape, but could be arranged with a different shape.

Figure 49:
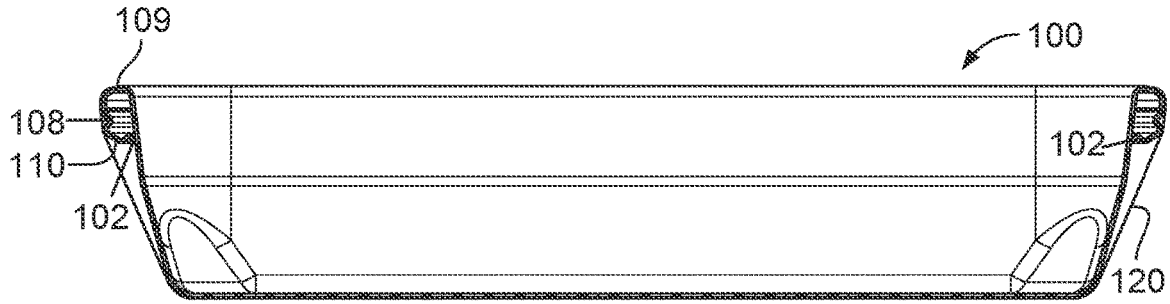
FIG. 49 shows aspects of the tray shown in FIG. 25, FIG. 26, FIG. 27, and FIG. 28.

In FIG. 25 to FIG. 28, the tray 100 is shown before the flange 101 is folded (e.g., bent) at and/or via the hinge 108. The flange 101 is configured to be folded downward, for example, by the application of an overwrap 120 (shown in FIG. 49) to the tray 100. After the flange 101 is folded downward, the trim edge 102 is positioned closer to the wall 104 relative to how the trim edge 102 and the wall 104 are shown in FIG. 26. FIG. 49 shows aspects of the tray 100 after the flange 108 has been folded downward. As shown in FIG. 49, the trim edge 102 is disposed away from the overwrap 120 so that a sharp edge of the trim edge 102 cannot tear the overwrap 120.

The wall 104 includes a first end 105 (i.e., a first end of the wall 104) and a second end 106 (i.e., a second end of the wall 104). The first end 105 and the second end 106 are at opposite ends of the wall 104.

The wall 104 extends continuously around the base 103. For example, starting at any point on the base perimeter 107, the wall 104 continues around the base perimeter 107 until reaching the starting point without any breaks in the wall 104. With the base 103 positioned as shown in FIG. 26, the wall 104 extends upward from the base 103. In accordance with embodiments in which the tray 100 has a substantially rectangular shape, the wall 104 can be described as having a first side 111, a second side 112, a third side 113 (shown in FIG. 27), and a fourth side 114 (shown in FIG. 27), as well as a top side 117 and a bottom side 118.

The flange 101 extends continuously around an entirety of the second end 106 of the wall 104. Stated another way, the flange 101 extends away from the second end 106 of the wall 104 (i.e., extends away from the entire second end 106 of the wall 104. The trim edge 102 extends continuously around the flange 101. The hinge 108 extends continuously around the flange 101. The hinge 108 can include a single cut or multiple interrupted cuts within the flange 101.

The flange 101 includes a portion 109 of the flange 101 between the hinge 108 and the second end 106 of the wall 104. The flange 101 includes a portion 110 of the flange 101 between the hinge 108 and the trim edge 102. In at least some embodiments, the portion 109 of the flange 101 is not folded as a result of folding the flange 101 at and/or via the hinge 108. In that regard, the portion 109 of the flange 101 remains unfolded (i.e., unbent). In at least some other embodiments, at least some of the portion 109 of the flange 101 is folded as a result of folding the flange 101 at and/or via the hinge 108. The flange 101 includes a top flange surface 119 extending from the trim edge 102 to the second end 106 of the wall 104. The flange 101 includes a bottom flange surface 121 extending from the trim edge 102 to the wall 104. The portion 109 of the flange 101 and/or the portion 110 of the flange 101 can be arranged as a flange bumper.

The base 103 has an interior surface and an exterior surface. FIG. 27 shows the interior surface of the base 103. FIG. 28 shows the exterior surface of the base 103. The wall 104 has an inner wall surface 115 and an outer wall surface 116. FIG. 26 and FIG. 27 show at least a portion of the inner wall surface 115 of the wall 104. FIG. 28 shows at least a portion of the outer wall surface 116 of the wall 104.

As shown in FIG. 27, the flange 101 includes a pocket 140. The pocket 140 is disposed between an apex 141 (e.g., an high point) of the portion 109 of the flange 101 and an apex 142 (e.g., an high point) of the portion 110 of the flange 101. The hinge 108 is located within the pocket 140. In other embodiments, a hinge within the flange 101 can be located elsewhere on the portion 109 of the flange 101 or elsewhere on the portion 110 of the flange 101. In accordance with at least some embodiments, the portion 109 of the flange 101 and the portion 110 of the flange 101 have a radial shape. Accordingly, multiple portions of the flange 101 have a radial shape with the hinge 108 separating the portion 109 of the flange 101 and the portion 110 of the flange 101.

Figure 29:
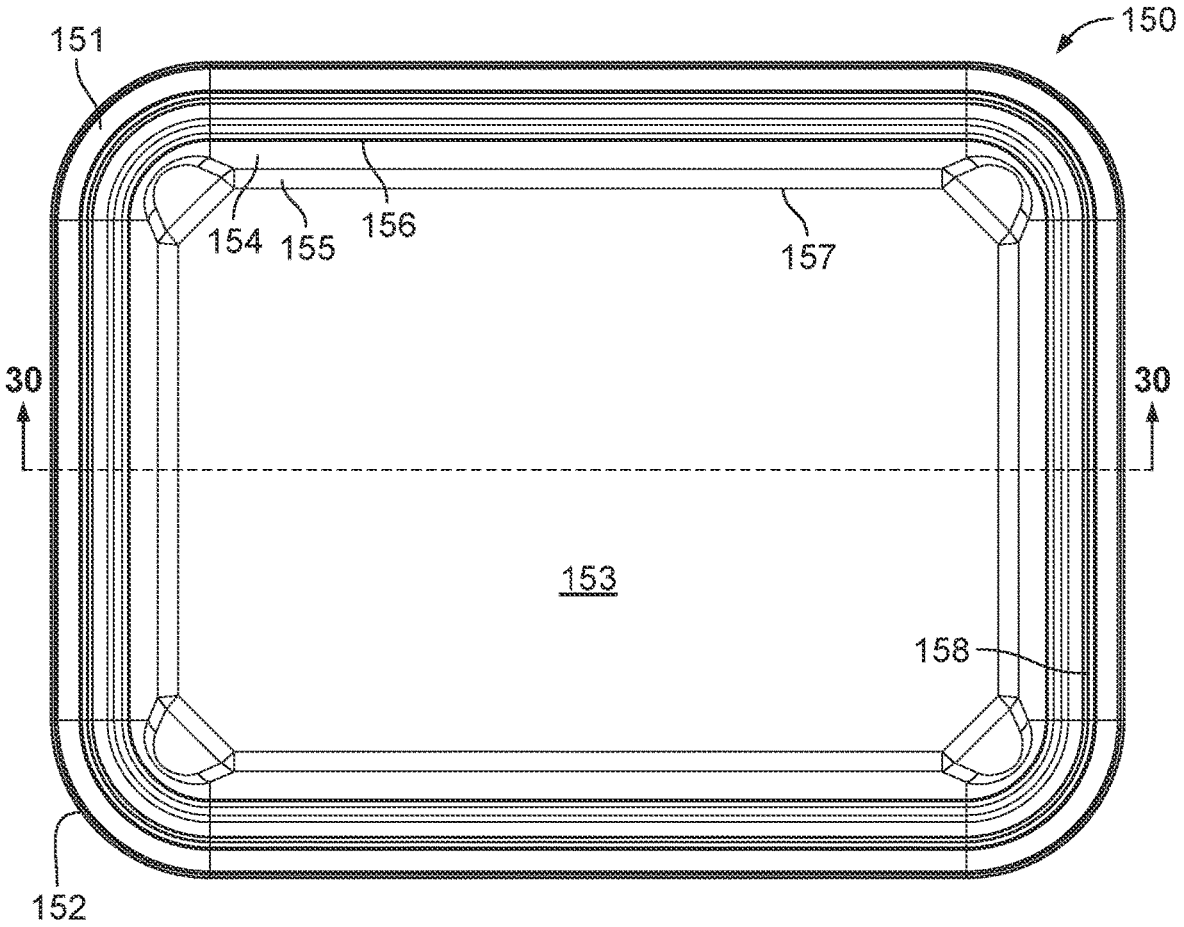
FIG. 29, FIG. 30, FIG. 31, and FIG. 32 show various views of a tray in accordance with the example embodiments.
Figure 30:
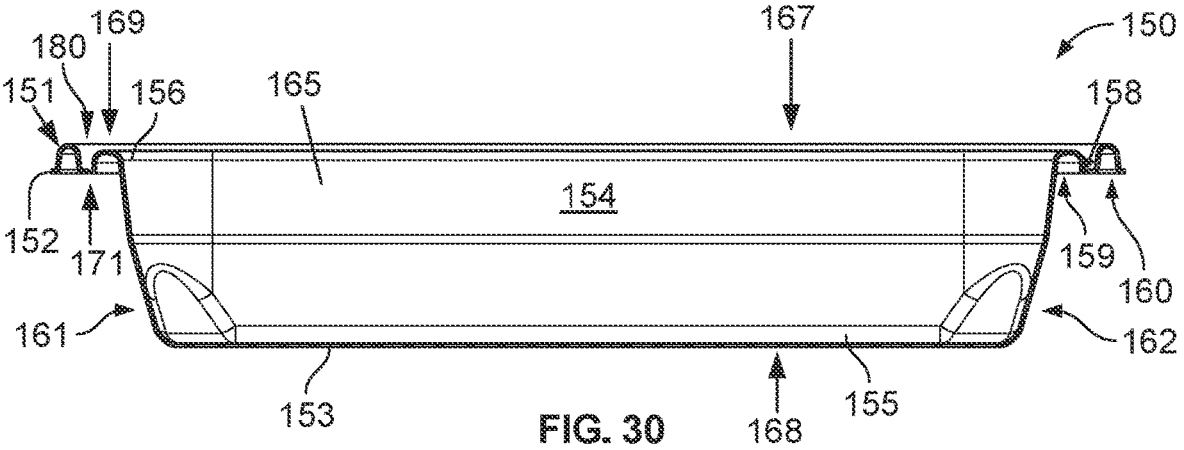
Figure 31:
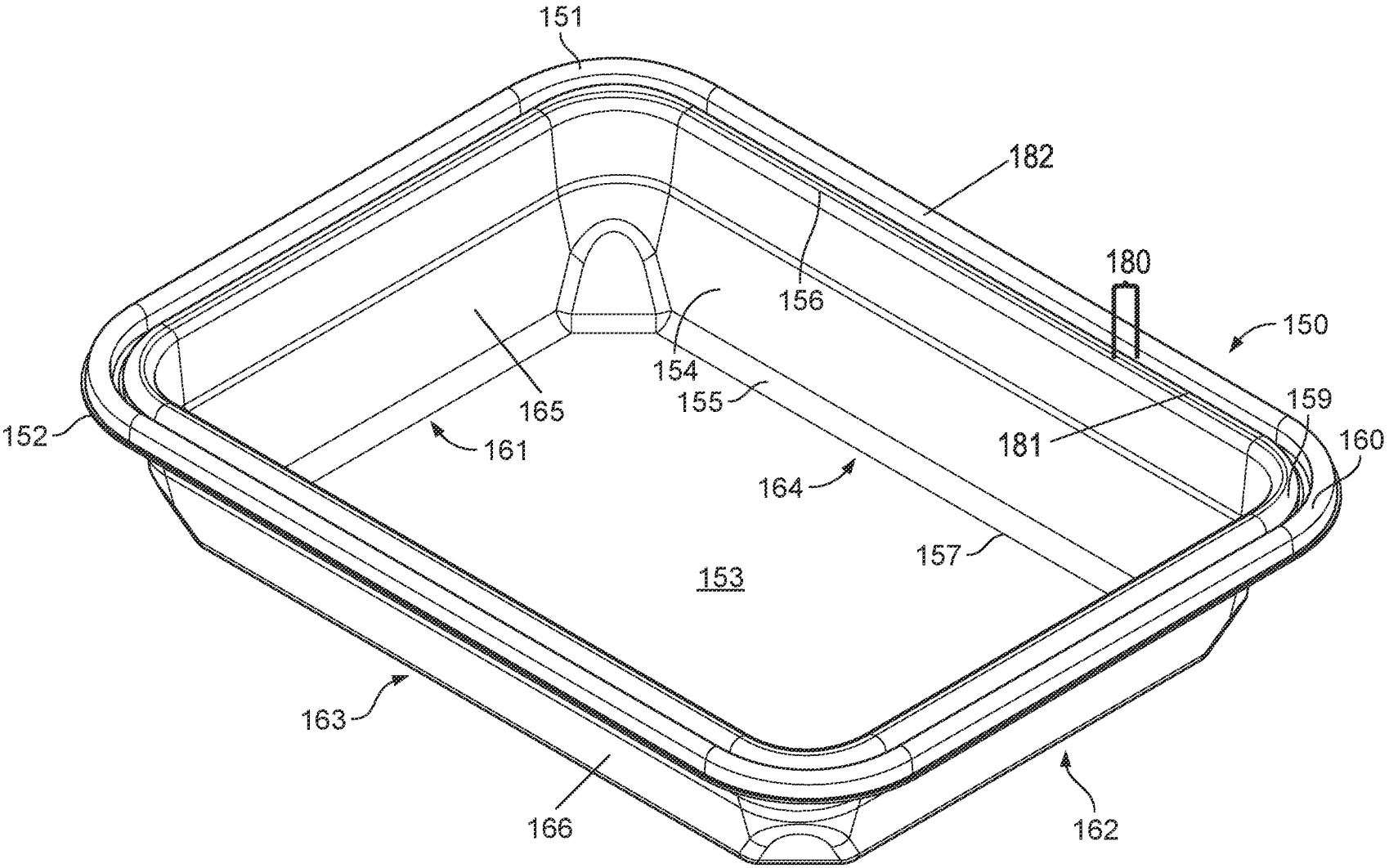
Figure 32:
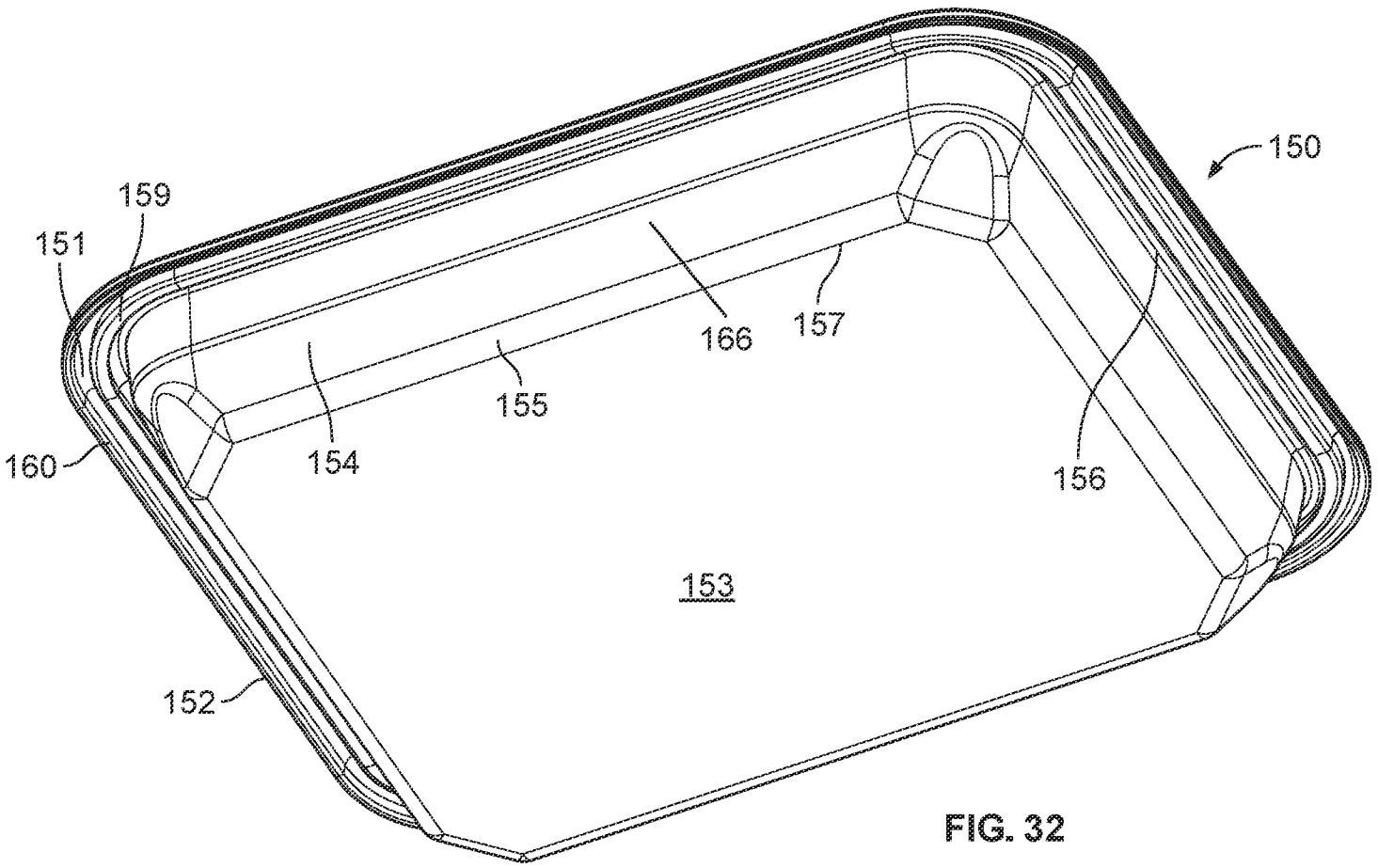

Next, FIG. 29 to FIG. 32 show different views of a tray 150. In particular, FIG. 29 shows a top view of the tray 150, FIG. 30 shows a section view of the tray 150, and FIG. 31 and FIG. 32 show perspective views of the tray 150.

Based on the top view of the tray 150 shown in FIG. 29, a top of the tray 150 has a substantially rectangular shape with rounded corners. The tray 150 is a hinged tray. As shown in one or more of FIG. 29 to FIG. 32, the tray 150 includes a flange 151, a trim edge 152, a base 153, a wall 154, and a hinge 158. The base 153 includes and/or is defined by a base perimeter 157. As shown in FIG. 29, the base perimeter 157 has an irregular octagon shape, but could be arranged with a different shape.

Figure 50:
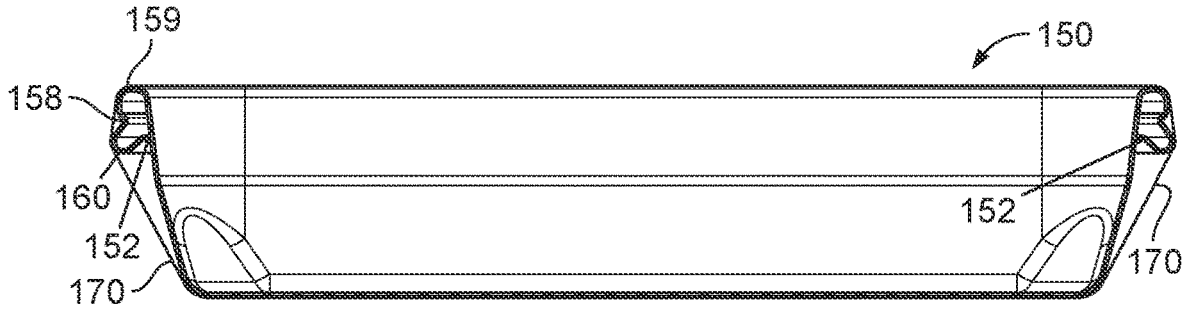
FIG. 50 shows aspects of the tray shown in FIG. 29, FIG. 30, FIG. 31, and FIG. 32.

In FIG. 29 to FIG. 32, the tray 150 is shown before the flange 151 is folded (e.g., bent) at and/or via the hinge 158. The flange 151 is configured to be folded downward, for example, by the application of an overwrap (shown in FIG. 50) to the tray 150. After the flange 151 is folded downward, the trim edge 152 is positioned closer to the wall 154 relative to how the trim edge 152 and the wall 154 are shown in FIG. 30. FIG. 50 shows aspects of the tray 150 after the flange 158 has been folded downward. As shown in FIG. 50, the trim edge 152 is disposed away from the overwrap 170 so that a sharp edge of the trim edge 172 cannot tear the overwrap 170.

The wall 154 includes a first end 155 (i.e., a first end of the wall 154) and a second end 156 (i.e., a second end of the wall 154). The first end 155 and the second end 106 are at opposite ends of the wall 154.

The wall 154 extends continuously around the base 153. For example, starting at any point on the base perimeter 157, the wall 154 continues around the base perimeter 157 until reaching the starting point without any breaks in the wall 154. With the base 153 positioned as shown in FIG. 30, the wall 154 extends upward from the base 153. In accordance with embodiments in which the tray 150 has a substantially rectangular shape, the wall 154 can be described as having a first side 161, a second side 162, a third side 163 (shown in FIG. 31), and a fourth side 164 (shown in FIG. 31), as well as a top side 167 and a bottom side 168.

The flange 151 extends continuously around an entirety of the second end 156 of the wall 154. Stated another way, the flange 151 extends away from the second end 156 of the wall 154 (i.e., extends away from the entire second end 156 of the wall 154. The trim edge 152 extends continuously around the flange 151. The hinge 158 extends continuously around the flange 151. The hinge 158 can include a single cut or multiple interrupted cuts within the flange 151.

The flange 151 includes a portion 159 of the flange 151 between the hinge 158 and the second end 156 of the wall 154. The flange 151 includes a portion 160 of the flange 151 between the hinge 158 and the trim edge 152. In at least some embodiments, the portion 159 of the flange 151 is not folded as a result of folding the flange 151 at and/or via the hinge 158. In that regard, the portion 159 of the flange 151 remains unfolded (i.e., unbent). In at least some other embodiments, at least some of the portion 159 of the flange 151 is folded as a result of folding the flange 151 at and/or via the hinge 158. The flange 151 includes a top flange surface 169 extending from the trim edge 152 to the second end 156 of the wall 154. The flange 151 includes a bottom flange surface 171 extending from the trim edge 152 to the wall 154. The portion 159 of the flange 151 and/or the portion 160 of the flange 151 can be arranged as a flange bumper.

The base 153 has an interior surface and an exterior surface. FIG. 29 and FIG. 31 shows the interior surface of the base 153. FIG. 32 shows the exterior surface of the base 153. The wall 154 has an inner wall surface 165 and an outer wall surface 166. FIG. 30 and FIG. 31 show at least a portion of the inner wall surface 165 of the wall 154. FIG. 32 shows at least a portion of the outer wall surface 166 of the wall 154.

As shown in FIG. 31, the flange 151 includes a pocket 180. The pocket 180 is disposed between an apex 181 (e.g., an high point) of the portion 159 of the flange 151 and an apex 182 (e.g., an high point) of the portion 160 of the flange 151. The hinge 158 is located within the pocket 180. In other embodiments, a hinge within the flange 151 can be located elsewhere on the portion 159 of the flange 151 or elsewhere on the portion 160 of the flange 151. In accordance with at least some embodiments, the portion 159 of the flange 151 and the portion 160 of the flange 151 have a radial shape. Accordingly, multiple portions of the flange 151 have a radial shape with the hinge 158 separating the portion 159 of the flange 151 and the portion 160 of the flange 151.

Figure 33:
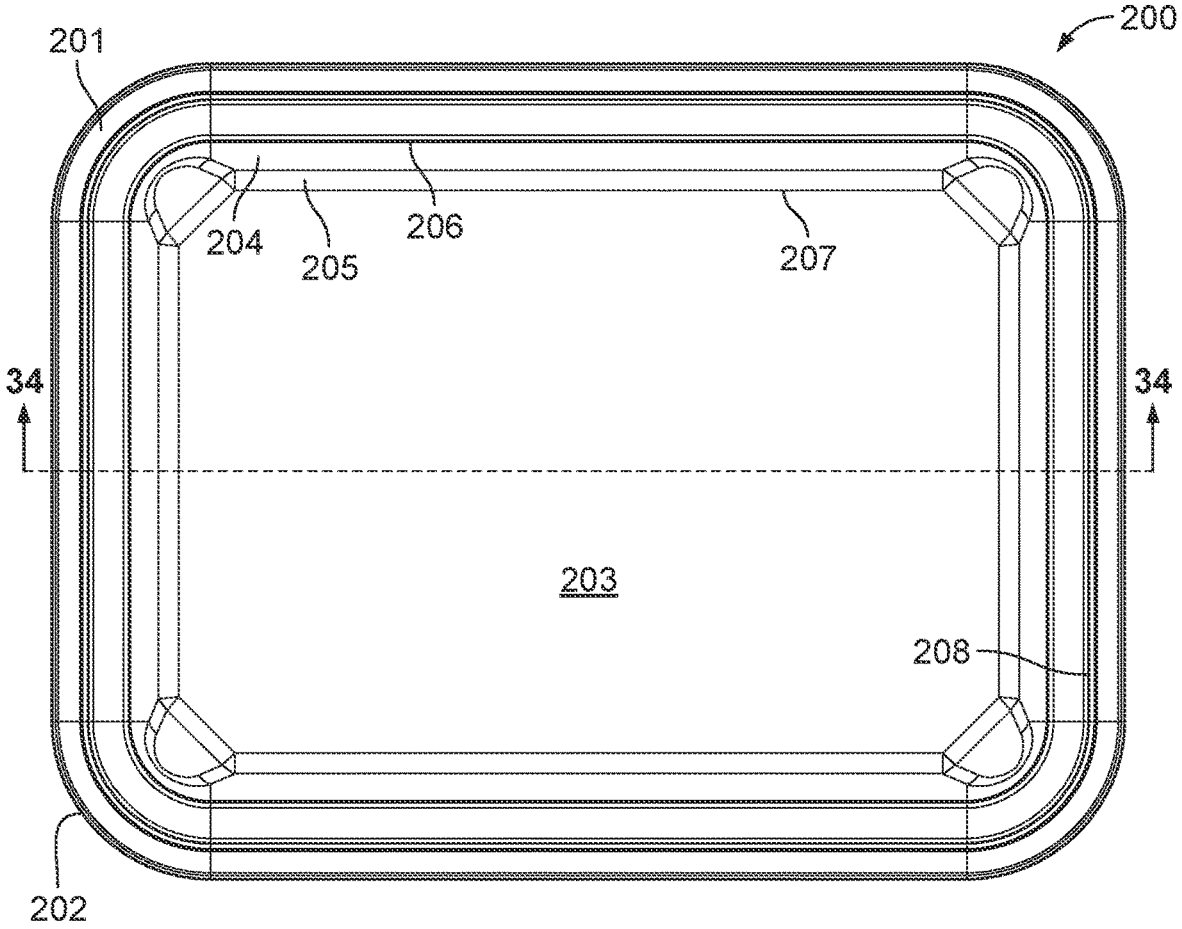
FIG. 33, FIG. 34, FIG. 35, and FIG. 36 show various views of a tray in accordance with the example embodiments.
Figure 34:
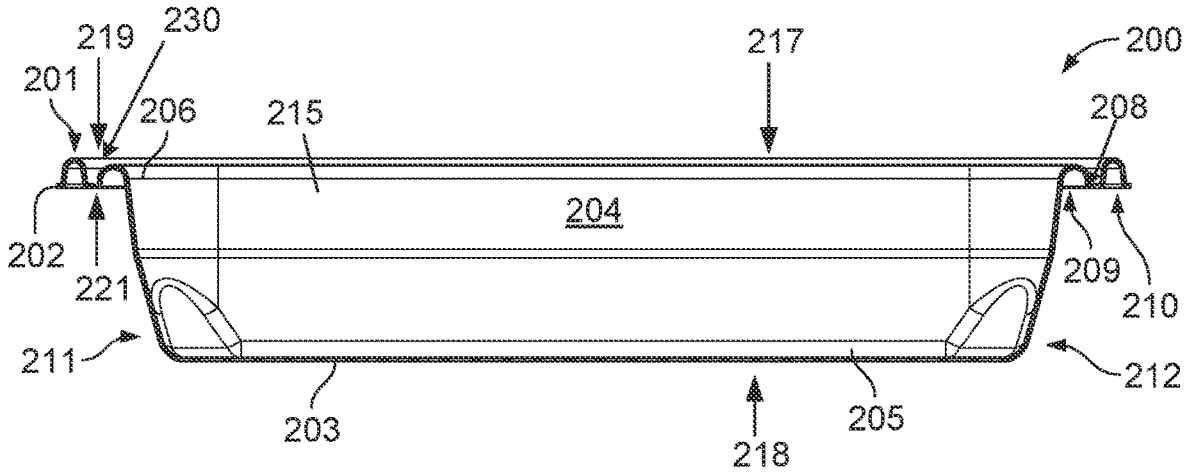
Figure 35:
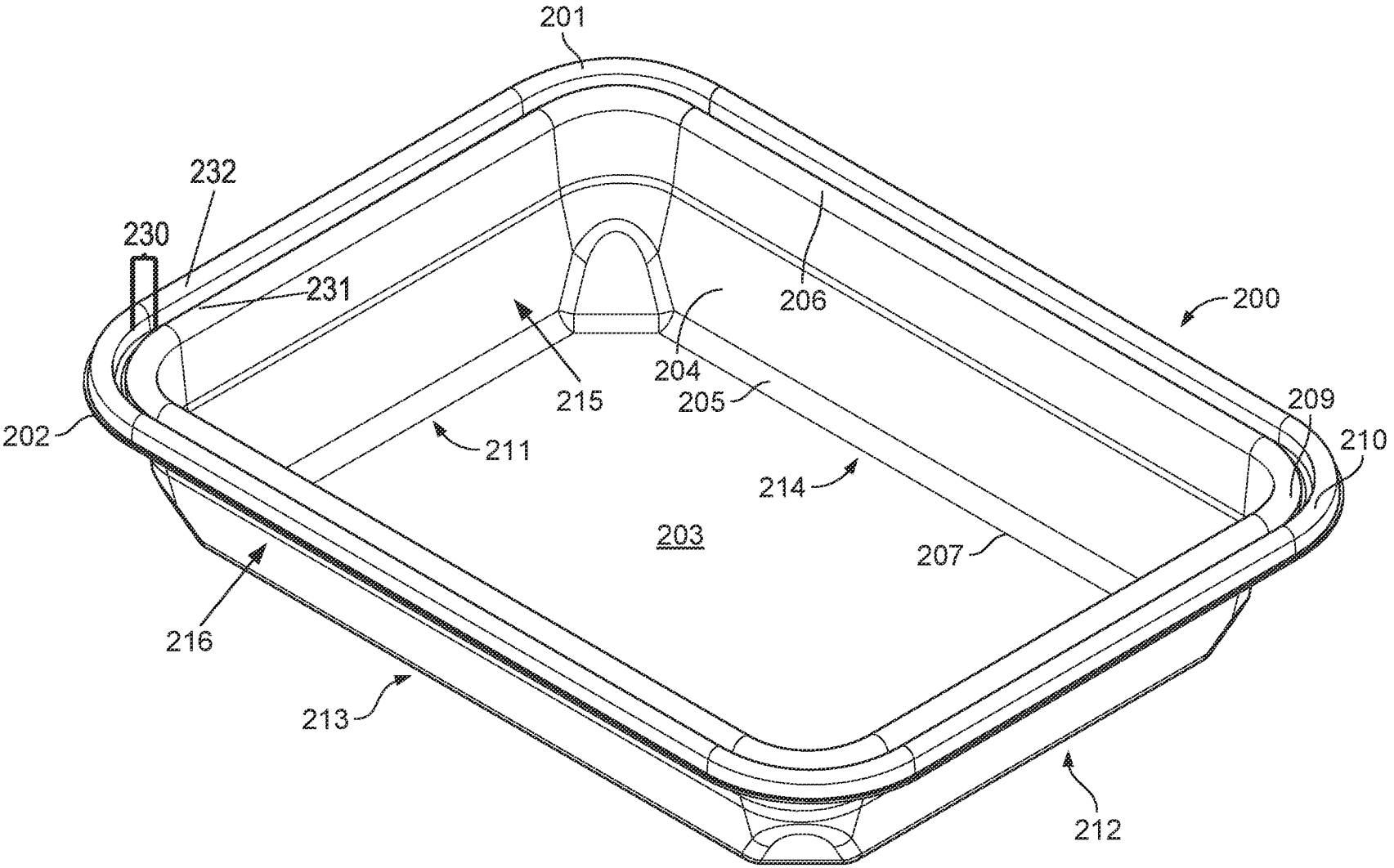
Figure 36:
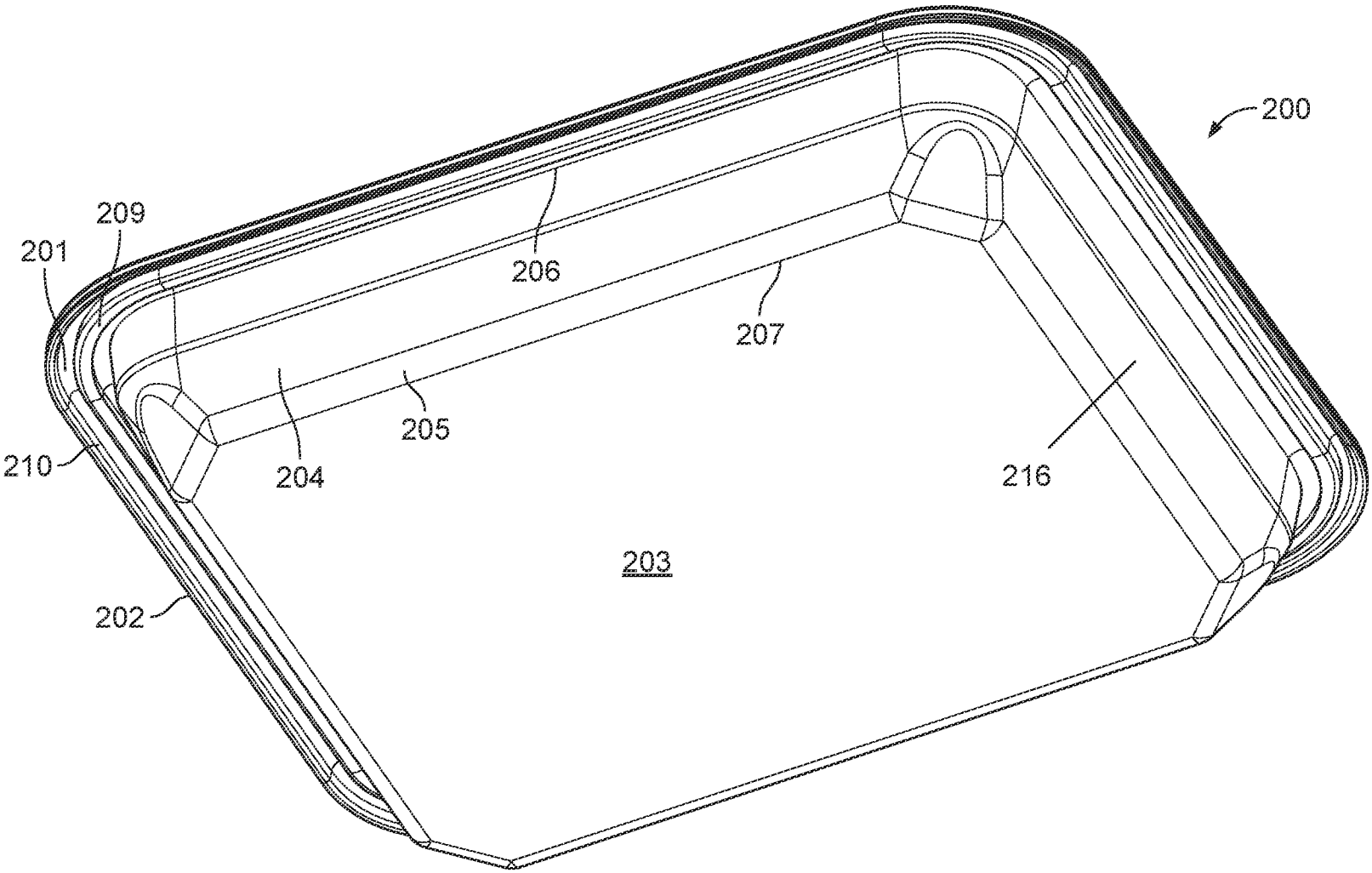

Next, FIG. 33 to FIG. 36 show different views of a tray 200. In particular, FIG. 33 shows a top view of the tray 200, FIG. 34 shows a section view of the tray 200, and FIG. 35 and FIG. 36 show perspective views of the tray 200.

Based on the top view of the tray 200 shown in FIG. 33, a top of the tray 200 has a substantially rectangular shape with rounded corners. The tray 200 is a hinged tray. As shown in one or more of FIG. 33 to FIG. 36, the tray 200 includes a flange 201, a trim edge 202, a base 203, a wall 204, and a hinge 208. The base 203 includes and/or is defined by a base perimeter 207. As shown in FIG. 33, the base perimeter 207 has an irregular octagon shape, but could be arranged with a different shape.

Figure 51:
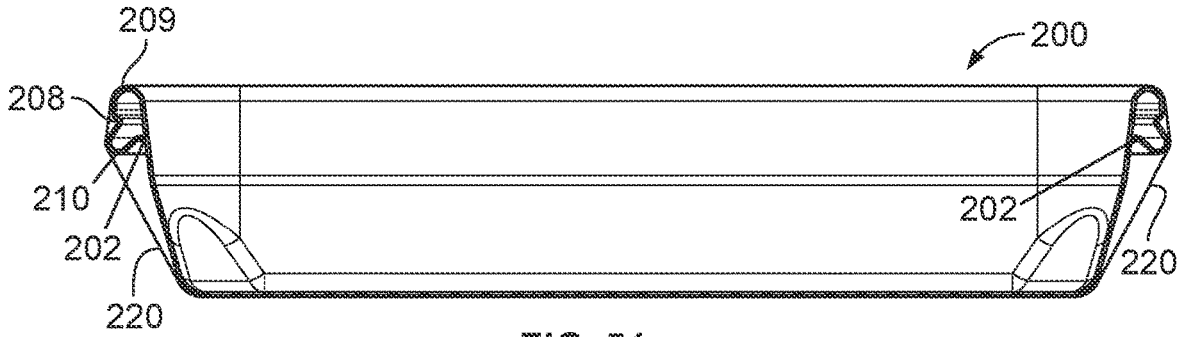
FIG. 51 shows aspects of the tray shown in FIG. 33, FIG. 34, FIG. 35, and FIG. 36.

In FIG. 33 to FIG. 36, the tray 200 is shown before the flange 201 is folded (e.g., bent) at and/or via the hinge 208. The flange 201 is configured to be folded downward, for example, by the application of an overwrap (shown in FIG. 51) to the tray 200. After the flange 201 is folded downward, the trim edge 202 is positioned closer to the wall 204 relative to how the trim edge 202 and the wall 204 are shown in FIG. 34. FIG. 51 shows aspects of the tray 200 after the flange 208 has been folded downward. As shown in FIG. 51, the trim edge 202 is disposed away from the overwrap 220 so that a sharp edge of the trim edge 202 cannot tear the overwrap 220.

The wall 204 includes a first end 205 (i.e., a first end of the wall 204) and a second end 206 (i.e., a second end of the wall 204). The first end 205 and the second end 206 are at opposite ends of the wall 204.

The wall 204 extends continuously around the base 203. For example, starting at any point on the base perimeter 207, the wall 204 continues around the base perimeter 207 until reaching the starting point without any breaks in the wall 204. With the base 203 positioned as shown in FIG. 34, the wall 204 extends upward from the base 203. In accordance with embodiments in which the tray 200 has a substantially rectangular shape, the wall 204 can be described as having a first side 211, a second side 212, a third side 213 (shown in FIG. 35), and a fourth side 214 (shown in FIG. 35), as well as a top side 217 and a bottom side 218.

The flange 201 extends continuously around an entirety of the second end 206 of the wall 204. Stated another way, the flange 201 extends away from the second end 206 of the wall 204 (i.e., extends away from the entire second end 206 of the wall 204. The trim edge 202 extends continuously around the flange 201. The hinge 208 extends continuously around the flange 201. The hinge 208 can include a single cut or multiple interrupted cuts within the flange 201.

The flange 201 includes a portion 209 of the flange 201 between the hinge 208 and the second end 206 of the wall 204. The flange 201 includes a portion 210 of the flange 201 between the hinge 208 and the trim edge 202. In at least some embodiments, the portion 209 of the flange 201 is not folded as a result of folding the flange 201 at and/or via the hinge 208. In that regard, the portion 209 of the flange 201 remains unfolded (i.e., unbent). In at least some other embodiments, at least some of the portion 209 of the flange 201 is folded as a result of folding the flange 201 at and/or via the hinge 208. The flange 201 includes a top flange surface 219 extending from the trim edge 202 to the second end 206 of the wall 204. The flange 201 includes a bottom flange surface 221 extending from the trim edge 202 to the wall 204. The portion 209 of the flange 201 and/or the portion 210 of the flange 201 can be arranged as a flange bumper.

The base 203 has an interior surface and an exterior surface. FIG. 33 and FIG. 35 show the interior surface of the base 203. FIG. 36 shows the exterior surface of the base 203. The wall 204 has an inner wall surface 215 and an outer wall surface 216. FIG. 34 and FIG. 35 show at least a portion of the inner wall surface 215 of the wall 204. FIG. 36 shows at least a portion of the outer wall surface 216 of the wall 204.

As shown in FIG. 35, the flange 201 includes a pocket 230. The pocket 230 is disposed between an apex 231 (e.g., an high point) of the portion 209 of the flange 201 and an apex 232 (e.g., an high point) of the portion 210 of the flange 201. The hinge 208 is located within the pocket 230. In other embodiments, a hinge within the flange 201 can be located elsewhere on the portion 209 of the flange 201 or elsewhere on the portion 210 of the flange 201. In accordance with at least some embodiments, the portion 209 of the flange 201 and the portion 210 of the flange 201 have a radial shape. Accordingly, multiple portions of the flange 201 have a radial shape with the hinge 208 separating the portion 209 of the flange 201 and the portion 210 of the flange 201.

Figure 37:
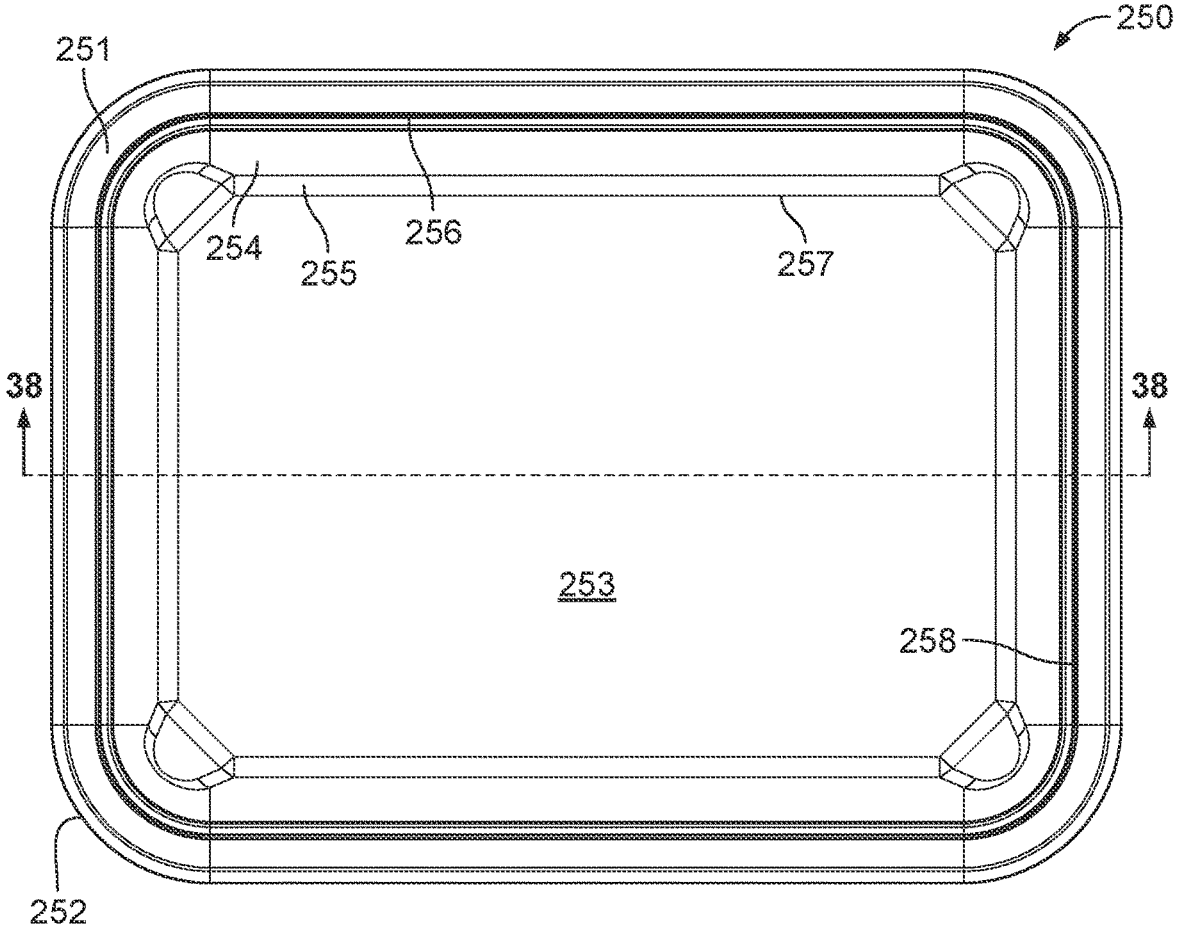
FIG. 37, FIG. 38, FIG. 39, and FIG. 40 show various views of a tray in accordance with the example embodiments.
Figure 38:
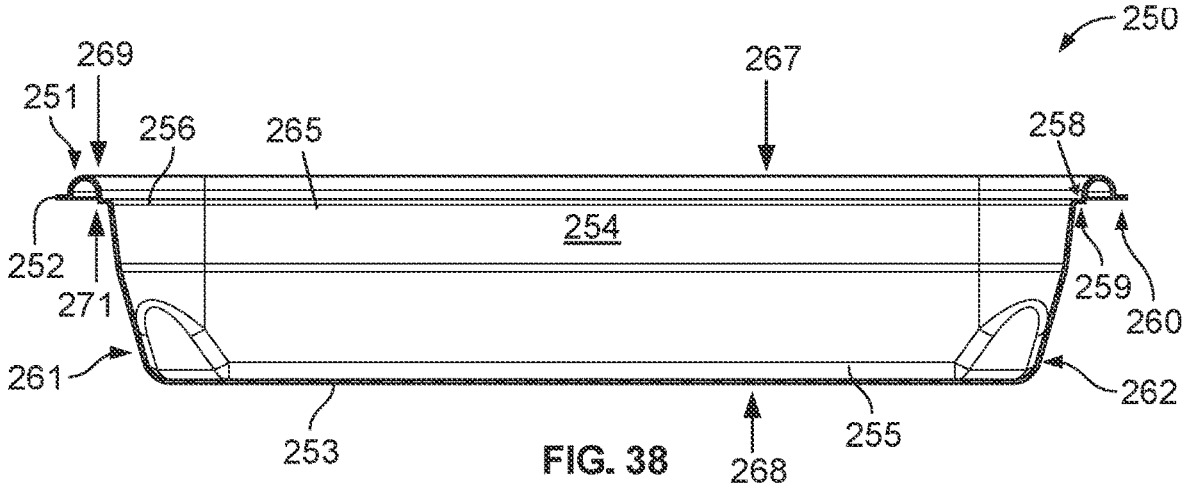
Figure 39:
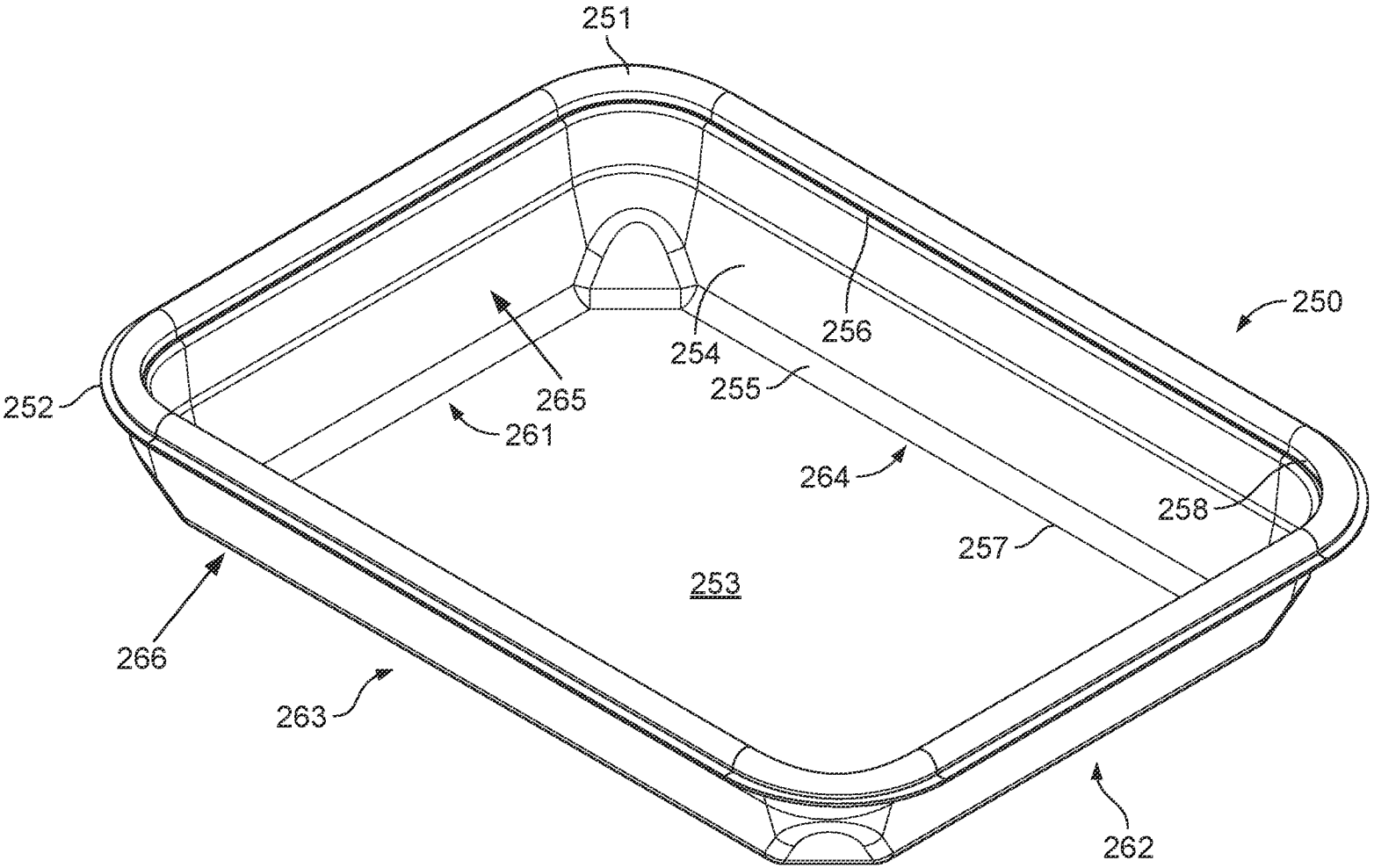
Figure 40:
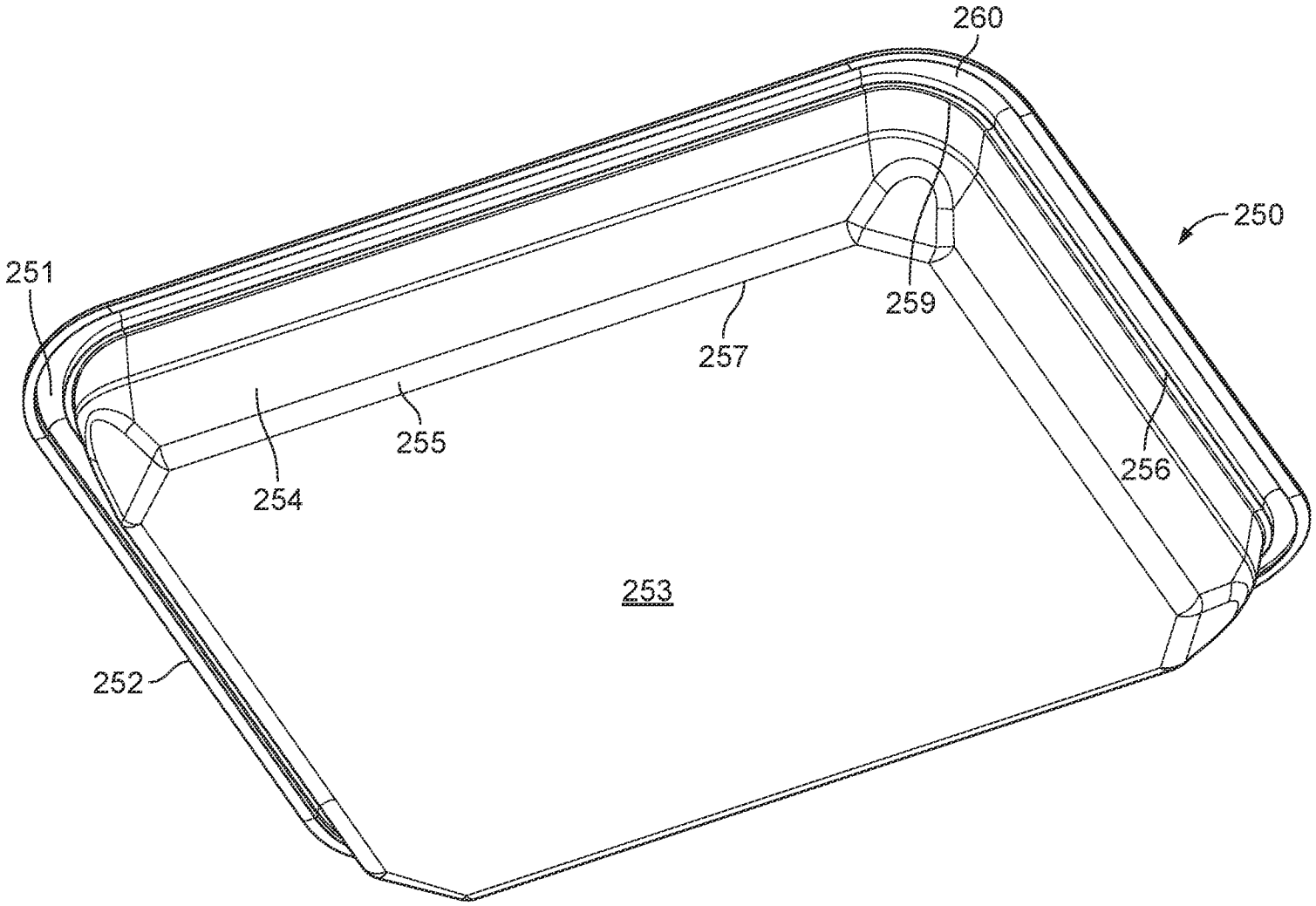

Next, FIG. 37 to FIG. 40 show different views of a tray 250. In particular, FIG. 37 shows a top view of the tray 250, FIG. 38 shows a section view of the tray 250, and FIG. 39 and FIG. 40 show perspective views of the tray 250.

Based on the top view of the tray 250 shown in FIG. 25, a top of the tray 250 has a substantially rectangular shape with rounded corners. The tray 250 is a hinged tray. As shown in one or more of FIG. 37 to FIG. 40, the tray 250 includes a flange 251, a trim edge 252, a base 253, a wall 254, and a hinge 258. The base 253 includes and/or is defined by a base perimeter 257. As shown in FIG. 37, the base perimeter 257 has an irregular octagon shape, but could be arranged with a different shape.

Figure 52:
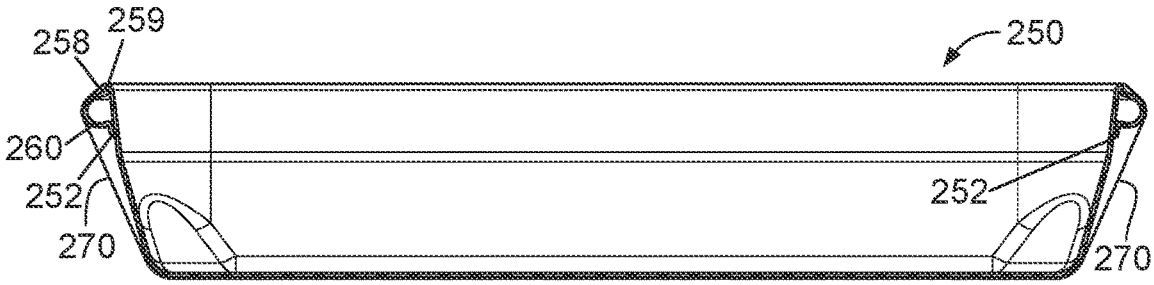
FIG. 52 shows aspects of the tray shown in FIG. 37, FIG. 38, FIG. 39, and FIG. 40.

In FIG. 37 to FIG. 40, the tray 250 is shown before the flange 251 is folded (e.g., bent) at and/or via the hinge 258. The flange 251 is configured to be folded downward, for example, by the application of an overwrap (shown in FIG. 52) to the tray 250. After the flange 251 is folded downward, the trim edge 252 is positioned closer to the wall 254 relative to how the trim edge 252 and the wall 254 are shown in FIG. 38. FIG. 52 shows aspects of the tray 250 after the flange 258 has been folded downward. As shown in FIG. 52, the trim edge 252 is disposed away from the overwrap 270 so that a sharp edge of the trim edge 252 cannot tear the overwrap 270.

The wall 254 includes a first end 255 (i.e., a first end of the wall 254) and a second end 256 (i.e., a second end of the wall 254). The first end 255 and the second end 256 are at opposite ends of the wall 254.

The wall 254 extends continuously around the base 253. For example, starting at any point on the base perimeter 257, the wall 254 continues around the base perimeter 257 until reaching the starting point without any breaks in the wall 254. With the base 253 positioned as shown in FIG. 38, the wall 254 extends upward from the base 253. In accordance with embodiments in which the tray 250 has a substantially rectangular shape, the wall 254 can be described as having a first side 261, a second side 262, a third side 263 (shown in FIG. 39), and a fourth side 264 (shown in FIG. 39), as well as a top side 267 and a bottom side 268.

The flange 251 extends continuously around an entirety of the second end 256 of the wall 254. Stated another way, the flange 251 extends away from the second end 256 of the wall 254 (i.e., extends away from the entire second end 256 of the wall 254. The trim edge 252 extends continuously around the flange 251. The hinge 258 extends continuously around the flange 251. The hinge 258 can include a single cut or multiple interrupted cuts within the flange 251.

The flange 251 includes a portion 259 of the flange 251 between the hinge 258 and the second end 256 of the wall 254. The flange 251 includes a portion 260 of the flange 251 between the hinge 258 and the trim edge 252. In at least some embodiments, the portion 259 of the flange 251 is not folded as a result of folding the flange 251 at and/or via the hinge 258. In that regard, the portion 259 of the flange 251 remains unfolded (i.e., unbent). In at least some other embodiments, at least some of the portion 259 of the flange 251 is folded as a result of folding the flange 251 at and/or via the hinge 258. The flange 251 includes a top flange surface 269 extending from the trim edge 252 to the second end 256 of the wall 254. The flange 251 includes a bottom flange surface 271 extending from the trim edge 252 to the wall 254. The portion 259 of the flange 251 and/or the portion 260 of the flange 251 can be arranged as a flange bumper.

The base 253 has an interior surface and an exterior surface. FIG. 39 shows the interior surface of the base 253. FIG. 40 shows the exterior surface of the base 253. The wall 254 has an has an inner wall surface 265 and an outer wall surface 266. FIG. 38 and FIG. 39 shows at least a portion of the inner wall surface 265 of the wall 254. FIG. 40 shows at least a portion of the outer wall surface 266 of the wall 254.

In accordance with at least some embodiments, the flange 251 includes a single hinge (i.e., the hinge 258), and the hinge 258 abuts the second end 256 of the wall 254. In accordance with at least some other embodiments, the flange 251 includes a single hinge (i.e., the hinge 258), and the hinge 258 is disposed between the trim edge 252 and a portion of the flange 251 that abuts the second end 256 of the wall 254.

Figure 41:
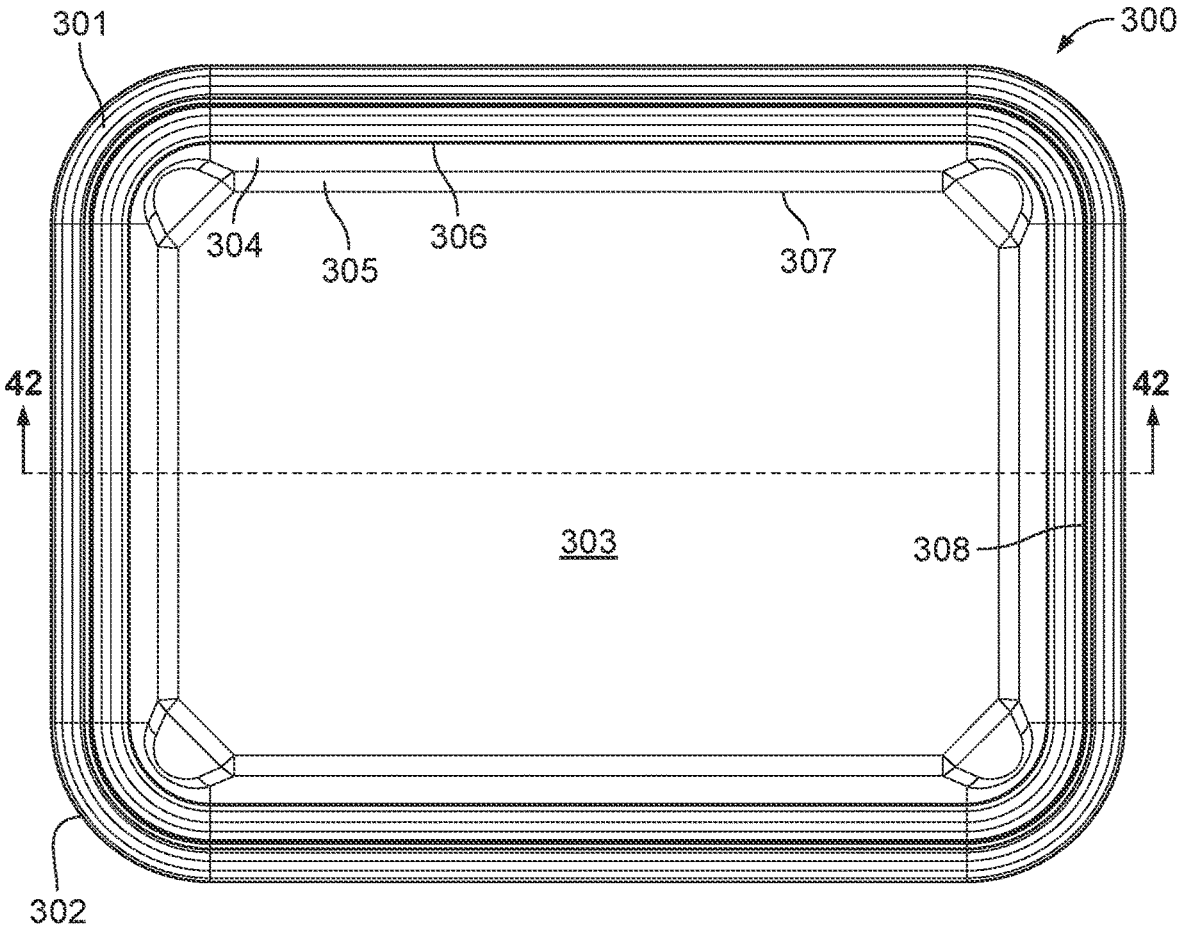
FIG. 41, FIG. 42, FIG. 43, and FIG. 44 show various views of a tray in accordance with the example embodiments.
Figure 42:
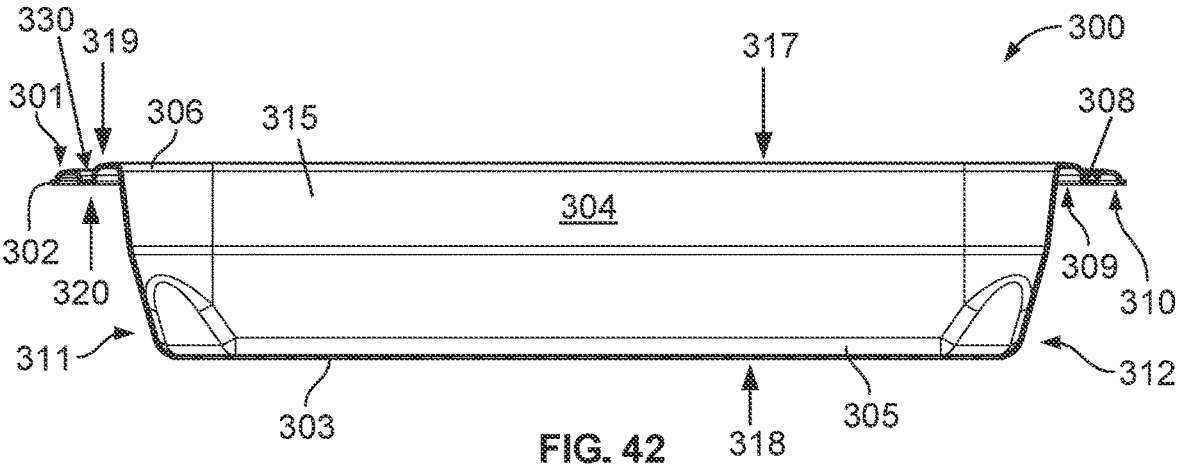
Figure 43:
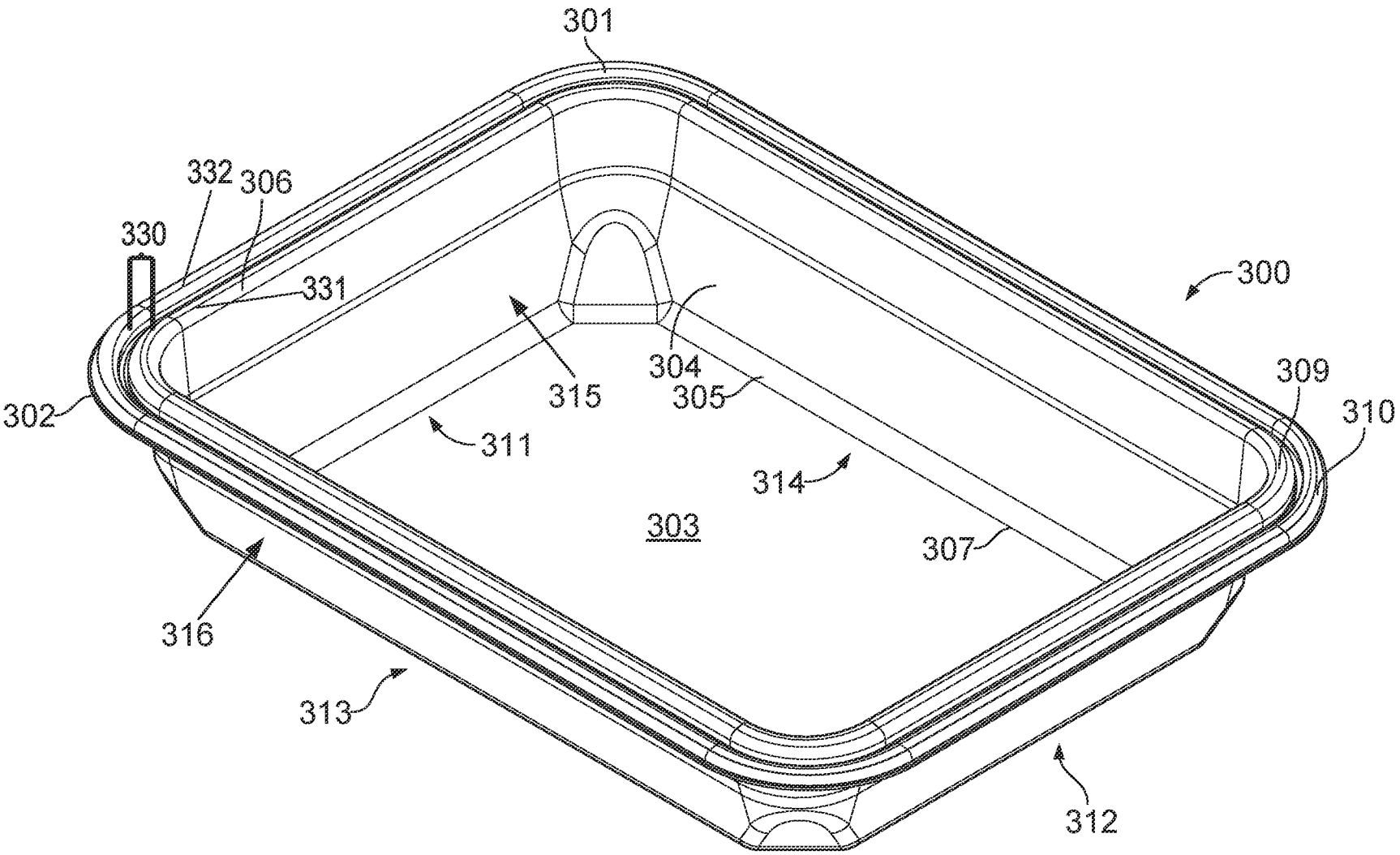
Figure 44:
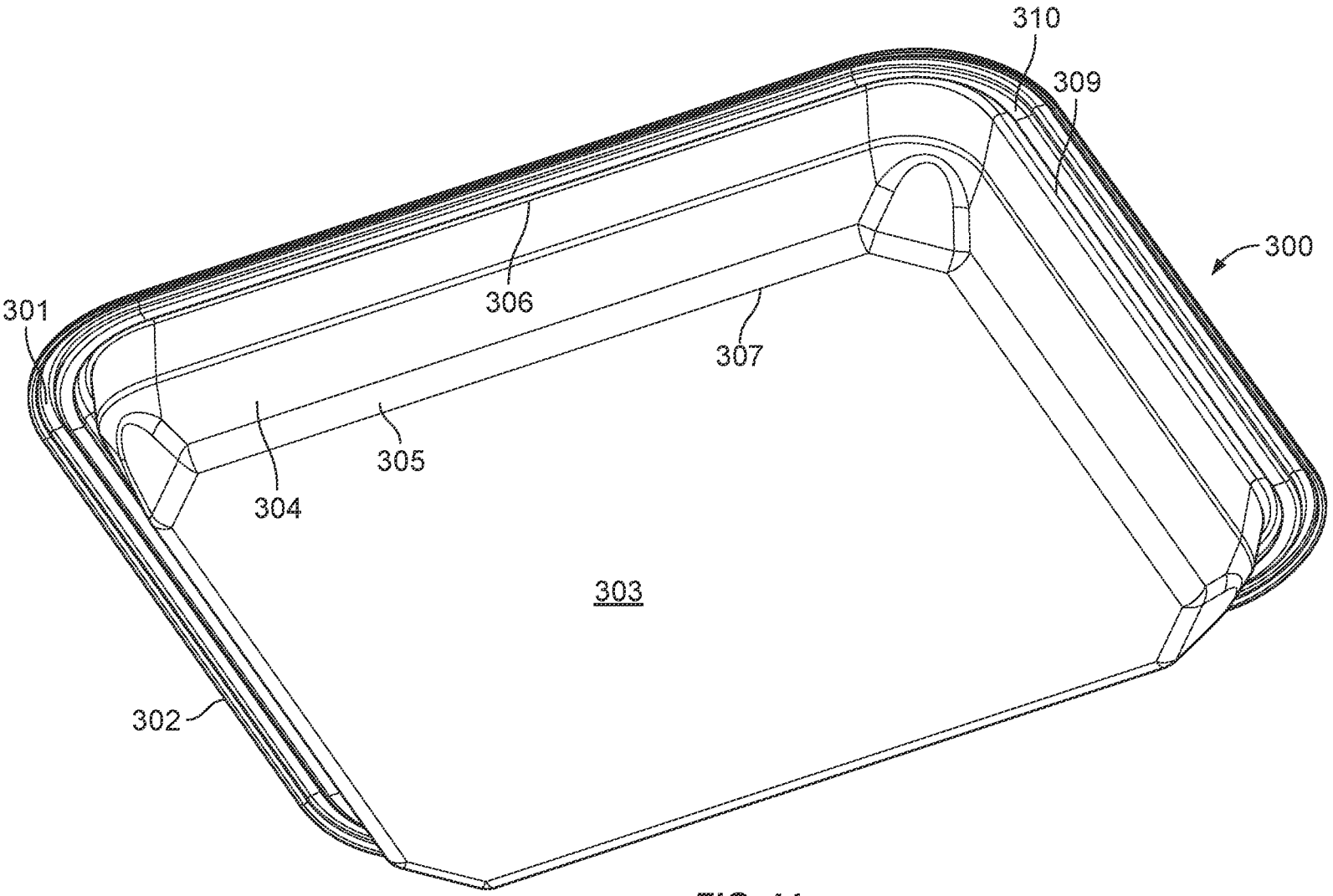

Next, FIG. 41 to FIG. 44 show different views of a tray 300. In particular, FIG. 41 shows a top view of the tray 300, FIG. 42 shows a section view of the tray 300, and FIG. 43 and FIG. 44 show perspective views of the tray 300.

Based on the top view of the tray 300 shown in FIG. 41, a top of the tray 300 has a substantially rectangular shape with rounded corners. The tray 300 is a hinged tray. As shown in one or more of FIG. 41 to FIG. 44, the tray 300 includes a flange 301, a trim edge 302, a base 303, a wall 304, and a hinge 308. The base 303 includes and/or is defined by a base perimeter 307. As shown in FIG. 41, the base perimeter 307 has an irregular octagon shape, but could be arranged with a different shape.

Figure 53:
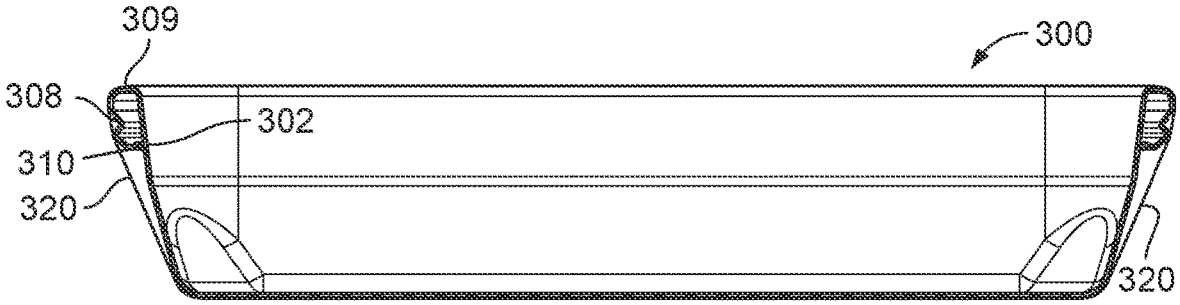
FIG. 53 shows aspects of the tray shown in FIG. 41, FIG. 42, FIG. 43, and FIG. 44.

In FIG. 41 to FIG. 44, the tray 300 is shown before the flange 301 is folded (e.g., bent) at and/or via the hinge 308. The flange 301 is configured to be folded downward, for example, by the application of an overwrap (shown in FIG. 53) to the tray 300. After the flange 301 is folded downward, the trim edge 302 is positioned closer to the wall 304 relative to how the trim edge 302 and the wall 304 are shown in FIG. 42. FIG. 53 shows aspects of the tray 300 after the flange 308 has been folded downward. As shown in FIG. 53, the trim edge 302 is disposed away from the overwrap 320 so that a sharp edge of the trim edge 302 cannot tear the overwrap 320.

The wall 304 includes a first end 305 (i.e., a first end of the wall 304) and a second end 306 (i.e., a second end of the wall 304). The first end 305 and the second end 306 are at opposite ends of the wall 304.

The wall 304 extends continuously around the base 303. For example, starting at any point on the base perimeter 307, the wall 304 continues around the base perimeter 307 until reaching the starting point without any breaks in the wall 304. With the base 303 positioned as shown in FIG. 42, the wall 304 extends upward from the base 303. In accordance with embodiments in which the tray 300 has a substantially rectangular shape, the wall 304 can be described as having a first side 311, a second side 312, a third side 313 (shown in FIG. 43), and a fourth side 314 (shown in FIG. 43), as well as a top side 317 and a bottom side 318.

The flange 301 extends continuously around an entirety of the second end 306 of the wall 304. Stated another way, the flange 301 extends away from the second end 306 of the wall 304 (i.e., extends away from the entire second end 306 of the wall 304. The trim edge 302 extends continuously around the flange 301. The hinge 308 extends continuously around the flange 301. The hinge 308 can include a single cut or multiple interrupted cuts within the flange 301.

The flange 301 includes a portion 309 of the flange 301 between the hinge 308 and the second end 306 of the wall 304. The flange 301 includes a portion 310 of the flange 301 between the hinge 308 and the trim edge 302. In at least some embodiments, the portion 309 of the flange 301 is not folded as a result of folding the flange 301 at and/or via the hinge 308. In that regard, the portion 309 of the flange 301 remains unfolded (i.e., unbent). In at least some other embodiments, at least some of the portion 309 of the flange 301 is folded as a result of folding the flange 301 at and/or via the hinge 308. The flange 301 includes a top flange surface 319 extending from the trim edge 302 to the second end 306 of the wall 304. The flange 301 includes a bottom flange surface 321 extending from the trim edge 302 to the wall 304. The portion 309 of the flange 301 and/or the portion 310 of the flange 301 can be arranged as a flange bumper.

The base 303 has an interior surface and an exterior surface. FIG. 41 and FIG. 43 show at least portions of the interior surface of the base 303. FIG. 44 shows the exterior surface of the base 303. The wall 304 has an inner wall surface 315 and an outer wall surface 316. FIG. 42 and FIG. 43 show at least a portion of the inner wall surface 315 the wall 304. FIG. 44 shows at least a portion of the outer wall surface 316 of the wall 304.

As shown in FIG. 43, the flange 301 includes a pocket 330. The pocket 330 is disposed between an apex 331 (e.g., an high point) of the portion 309 of the flange 301 and an apex 332 (e.g., an high point) of the portion 310 of the flange 301. The hinge 308 is located within the pocket 330. In other embodiments, a hinge within the flange 301 can be located elsewhere on the portion 309 of the flange 301 or elsewhere on the portion 310 of the flange 301. In accordance with at least some embodiments, the portion 309 of the flange 301 and the portion 310 of the flange 301 have a radial shape. Accordingly, multiple portions of the flange 301 have a radial shape with the hinge 308 separating the portion 309 of the flange 301 and the portion 310 of the flange 301.

Figure 45:
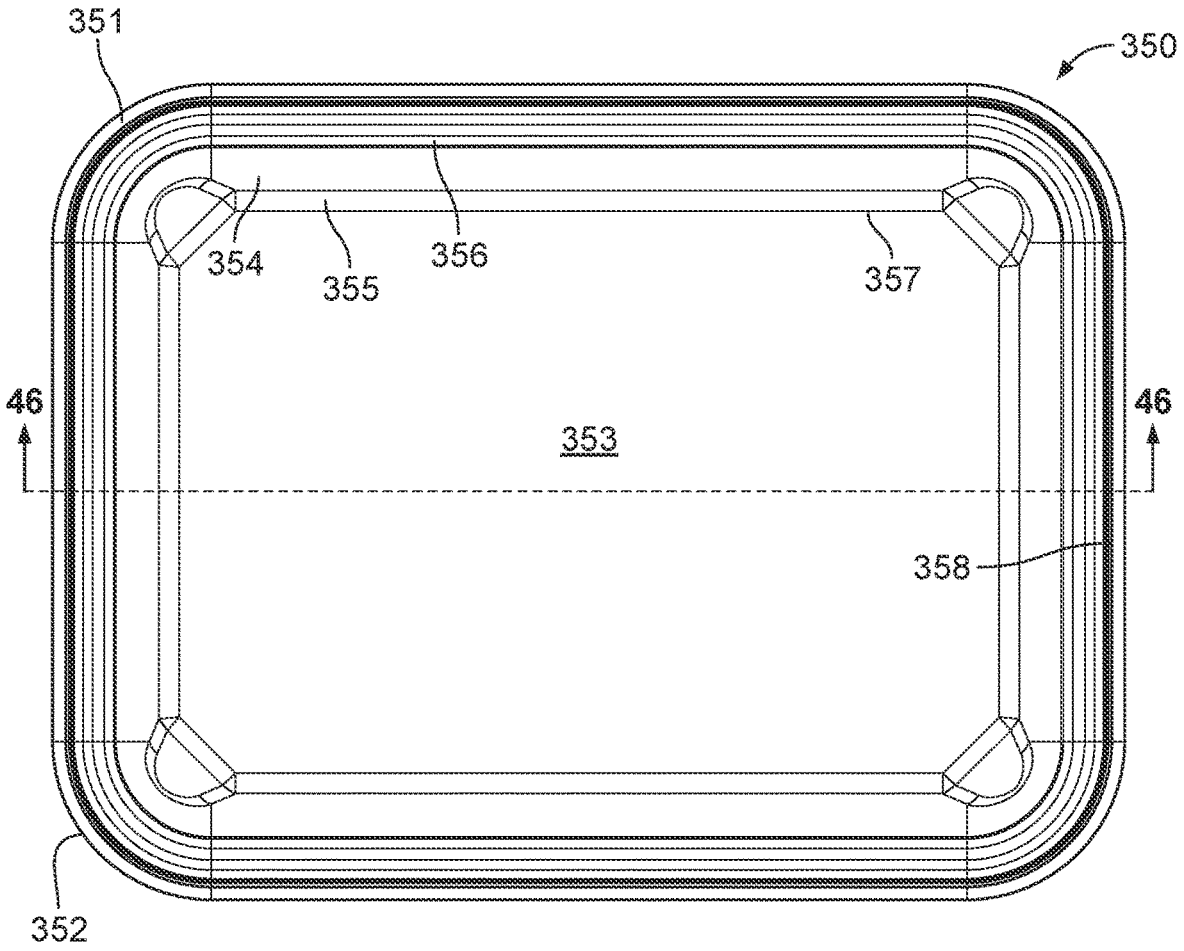
FIG. 45, FIG. 46, FIG. 47, and FIG. 48 show various views of a tray in accordance with the example embodiments.
Figure 46:
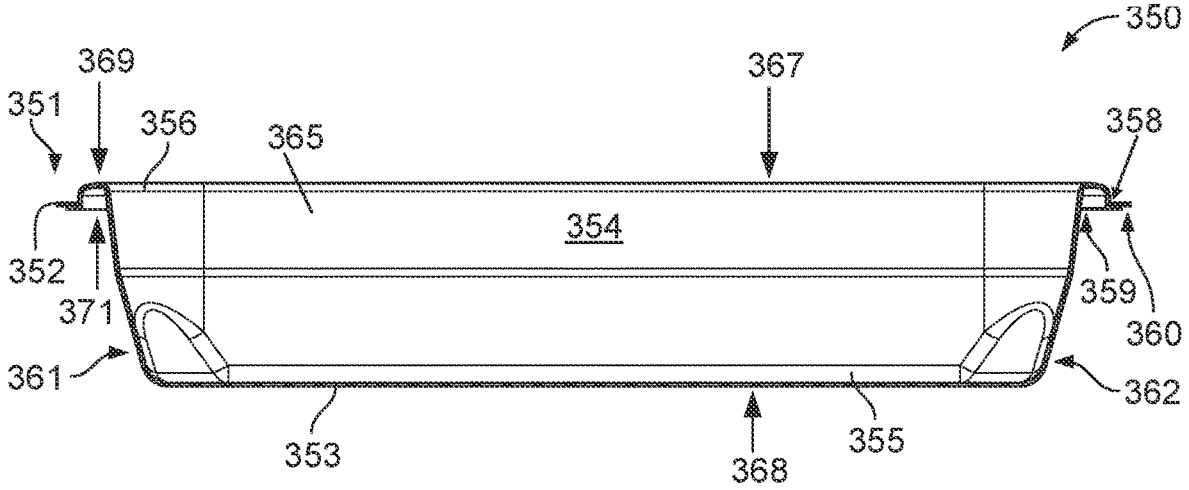
Figure 47:
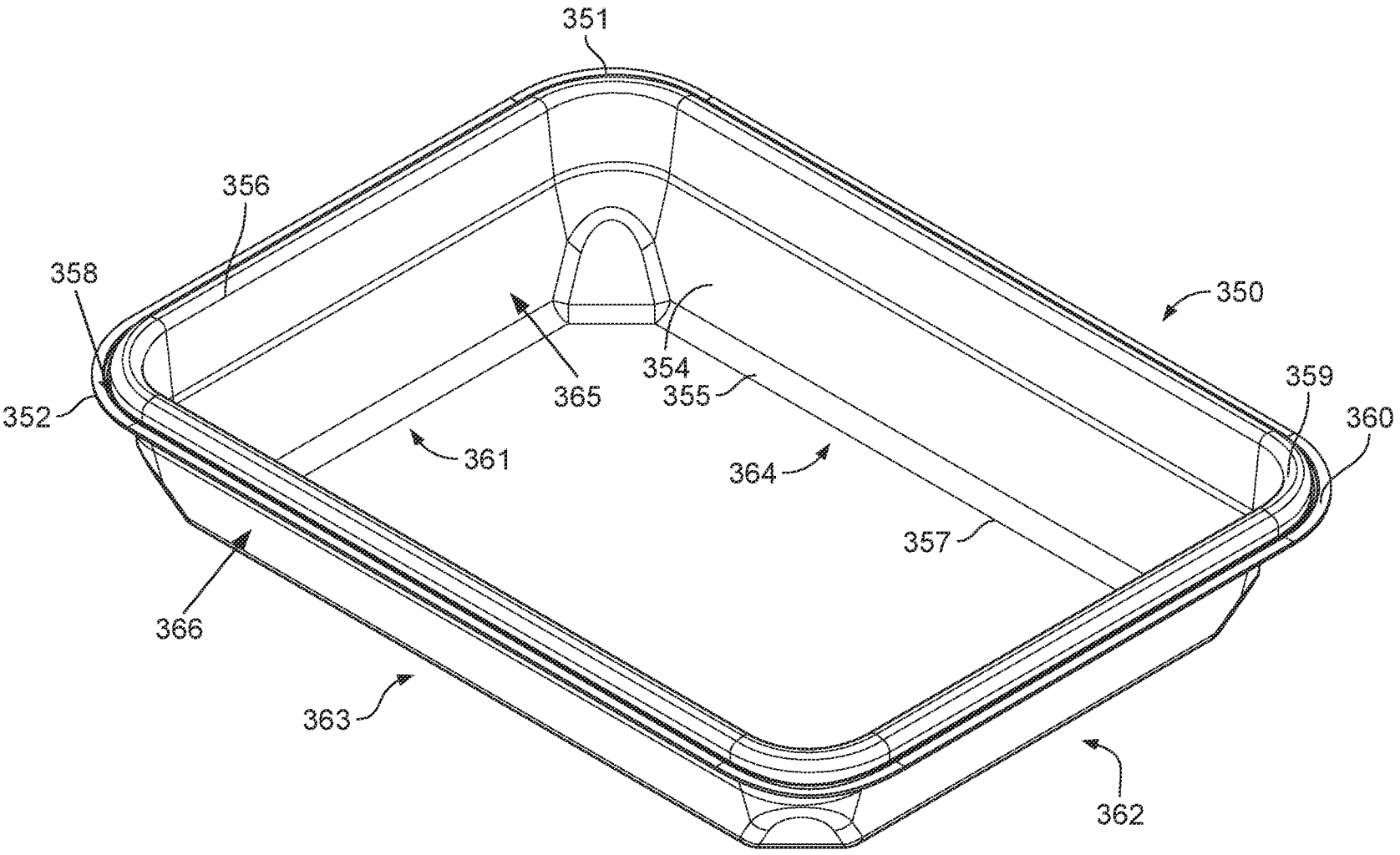
Figure 48:
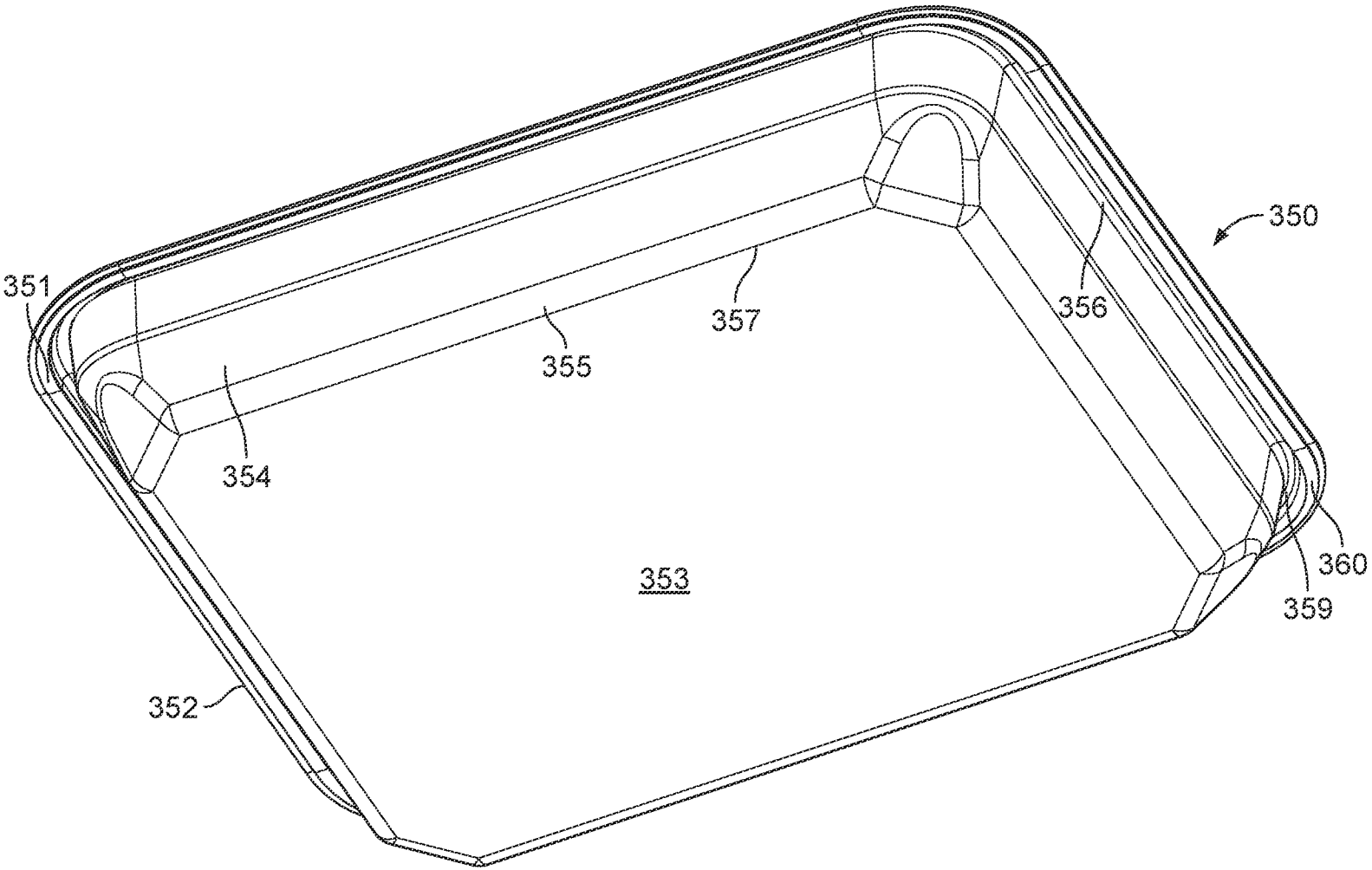

Next, FIG. 45 to FIG. 48 show different views of a tray 350. In particular, FIG. 45 shows a top view of the tray 350, FIG. 46 shows a section view of the tray 350, and FIG. 47 and FIG. 48 show perspective views of the tray 350.

Based on the top view of the tray 350 shown in FIG. 45, a top of the tray 350 has a substantially rectangular shape with rounded corners. The tray 350 is a hinged tray. As shown in one or more of FIG. 45 to FIG. 48, the tray 350 includes a flange 351, a trim edge 352, a base 353, a wall 354, and a hinge 358. The base 353 includes and/or is defined by a base perimeter 357. As shown in FIG. 45, the base perimeter 357 has an irregular octagon shape, but could be arranged with a different shape.

Figure 54:
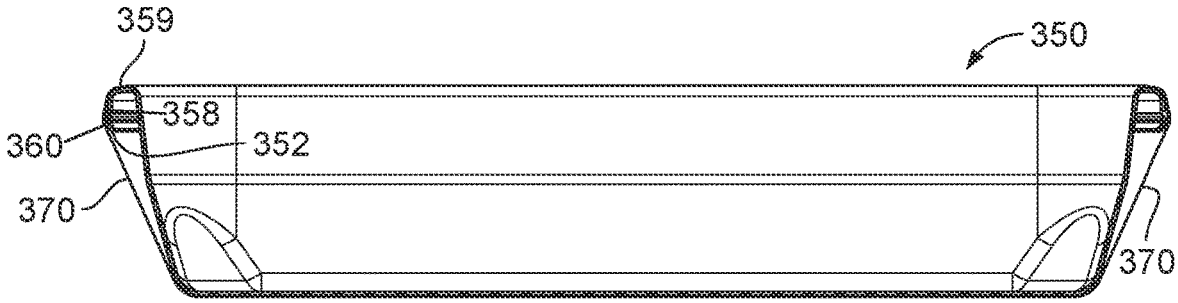
FIG. 54 shows aspects of the tray shown in FIG. 45, FIG. 46, FIG. 47, and FIG. 48.

In FIG. 45 to FIG. 48, the tray 350 is shown before the flange 351 is folded (e.g., bent) at and/or via the hinge 358. The flange 351 is configured to be folded downward, for example, by the application of an overwrap (shown in FIG. 54) to the tray 350. After the flange 351 is folded downward, the trim edge 352 is positioned closer to the wall 354 relative to how the trim edge 352 and the wall are shown in FIG. 46. FIG. 54 shows aspects of the tray 350 after the flange 358 has been folded downward. As shown in FIG. 54, the trim edge 352 is disposed away from the overwrap 370 so that a sharp edge of the trim edge 352 cannot tear the overwrap 370.

The wall 354 includes a first end 355 (i.e., a first end of the wall 354) and a second end 356 (i.e., a second end of the wall 354). The first end 355 and the second end 356 are at opposite ends of the wall 354.

The wall 354 extends continuously around the base 353. For example, starting at any point on the base perimeter 357, the wall 354 continues around the base perimeter 357 until reaching the starting point without any breaks in the wall 354. With the base 353 positioned as shown in FIG. 46, the wall 354 extends upward from the base 353. In accordance with embodiments in which the tray 350 has a substantially rectangular shape, the wall 354 can be described as having a first side 361, a second side 362, a third side 363 (shown in FIG. 47), and a fourth side 364 (shown in FIG. 47), as well as a top side 367 and a bottom side 368.

The flange 351 extends continuously around an entirety of the second end 356 of the wall 354. Stated another way, the flange 351 extends away from the second end 356 of the wall 354 (i.e., extends away from the entire second end 356 of the wall 354. The trim edge 352 extends continuously around the flange 351. The hinge 358 extends continuously around the flange 351. The hinge 358 can include a single cut or multiple interrupted cuts within the flange 351.

The flange 351 includes a portion 359 of the flange 351 between the hinge 358 and the second end 356 of the wall 354. The flange 351 includes a portion 360 of the flange 351 between the hinge 358 and the trim edge 352. In at least some embodiments, the portion 359 of the flange 351 is not folded as a result of folding the flange 351 at and/or via the hinge 358. In that regard, the portion 359 of the flange 351 remains unfolded (i.e., unbent). In at least some other embodiments, at least some of the portion 359 of the flange 351 is folded as a result of folding the flange 351 at and/or via the hinge 358. The flange 351 includes a top flange surface 369 extending from the trim edge 352 to the second end 356 of the wall 354. The flange 351 includes a bottom flange surface 371 extending from the trim edge 352 to the wall 354. The portion 359 of the flange 351 and/or the portion 360 of the flange 351 can be arranged as a flange bumper.

The base 353 has an interior surface and an exterior surface. FIG. 47 shows the interior surface of the base 353. FIG. 48 shows the exterior surface of the base 353. The wall 354 has an inner wall surface 365 and an outer wall surface 366. FIG. 46 and FIG. 47 shows at least a portion of the inner wall surface 365 of the wall 354. FIG. 48 shows at least a portion of the outer wall surface 366 of the wall 354.

Next, in accordance with at least some embodiment, a hinged tray includes one or more channels within the flange. A channel within a flange can be referred to as a "channel," a "flange channel," a 'flange moat," a "moat," a "flange pocket," or a "pocket," or some other term.

Figure 55:
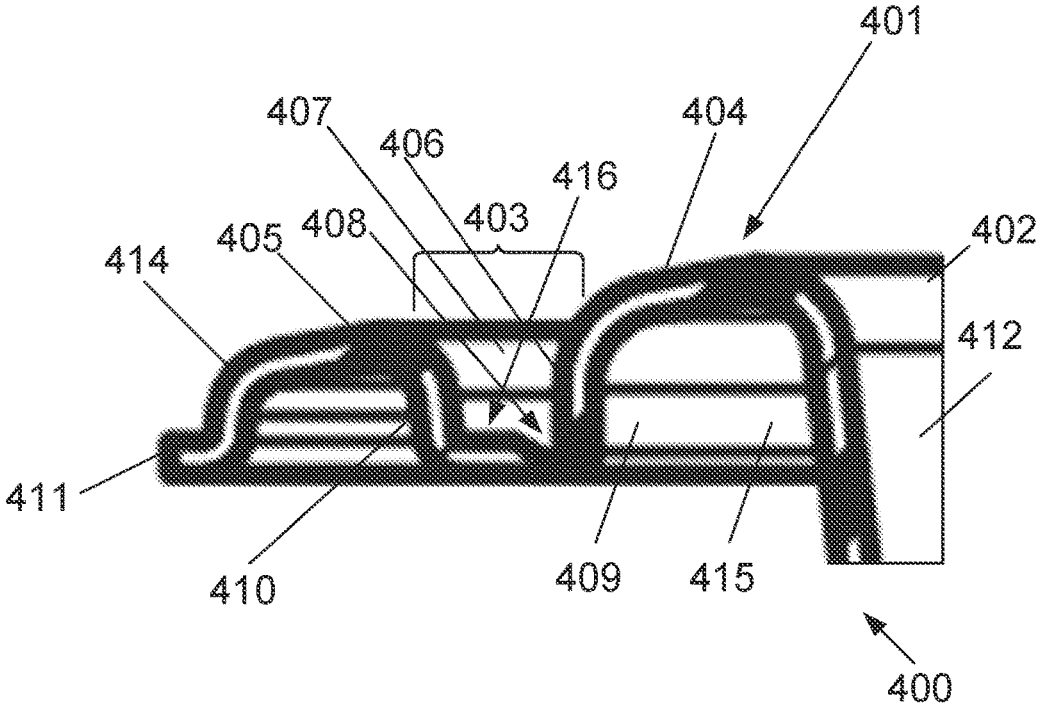
FIG. 55 shows features of a hinged tray in accordance with the example embodiments.
Figure 55:
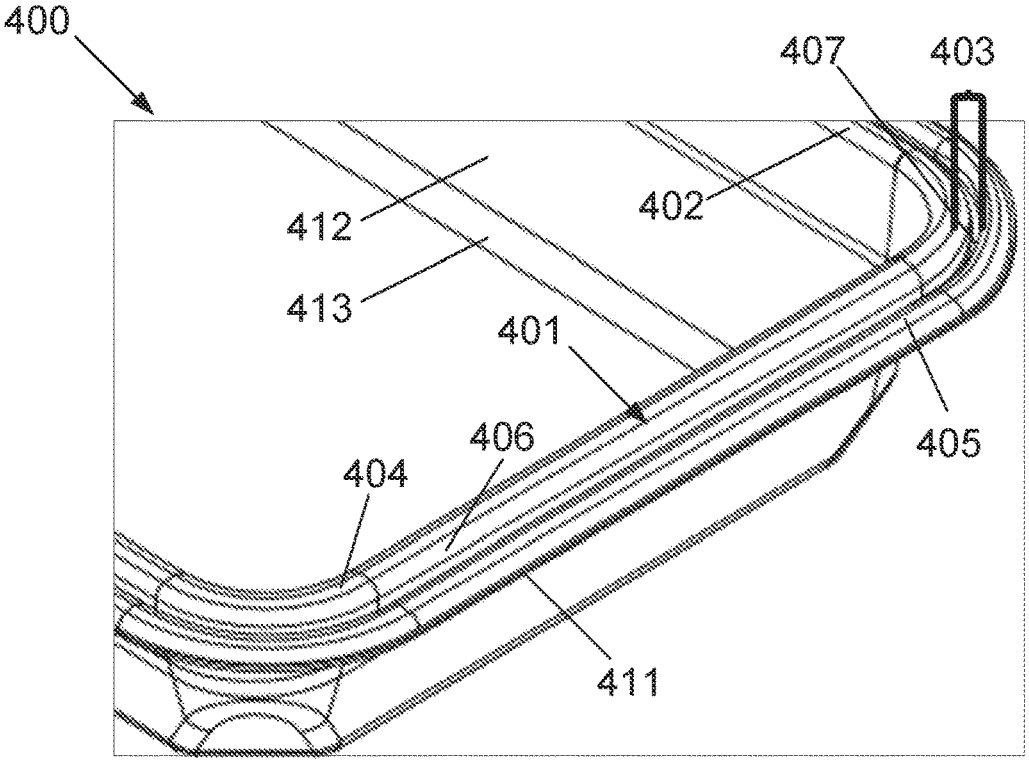

FIG. 55 shows features of a hinged tray 400. Those features appear in other hinge trays shown in the drawings, such as the tray 100 shown in FIG. 25-28. At least some of the features discussed with respect to FIG. 55 can be embodied other hinged trays including a channel.

As shown in FIG. 55, the tray 400 includes a flange 401, a wall 412, a first end 413 of the wall 412, and a second end 402 of the wall 412. The flange 401 includes a channel 403 (i.e., a pocket), a channel bank 404, 405, and a trim edge 411. The flange 401 includes a top flange surface 414 extending from the trim edge 411 to the second end 402 of the wall 412. The flange 401 includes a bottom flange surface 415 extending from the trim edge 411 to the wall 412. The channel 403 is defined by a channel wall 406 and a channel wall 407. In FIG. 55 the lines for the channel wall 406 and the channel wall 407 are shown in contact with the top flange surface 414. FIG. 55 also shows a bottom flange surface portion 409 of the channel wall 406 and a bottom flange surface portion 410 of the channel wall 407. The channel 403 can include one or more steps arising from the hinge 408. As an example, the channel 403 includes a step 416 arising from the hinge 408. The channel 403 and include another step arising from an opposite side of the hinge 408.

As noted, the tray 400 is a hinged tray such that the tray 400 includes one or more hinges within the flange 401. As an example, the tray 400 includes a hinge 408. As shown in FIG. 55, the hinge 408 is located within the channel 403. In at least some example embodiments, the hinge 408 separates the channel wall 406 from the channel wall 407.

In other example embodiments, a hinge can be disposed within a channel wall, such as the channel wall 406 or the channel wall 407. In still other example, embodiments, a hinge can be disposed within a channel bank, such as the channel bank 404 or the channel bank 405. The channel bank 404 can extend from an apex of the top flange surface 414 between the trim edge 411 and the channel 403. The channel bank 405 can extend from an apex of the top flange surface 414 between the second end 402 of the wall 412 and the channel 403. The channel bank 404 and/or the channel bank 405 can be arranged as a flange bumper.

Figure 56:
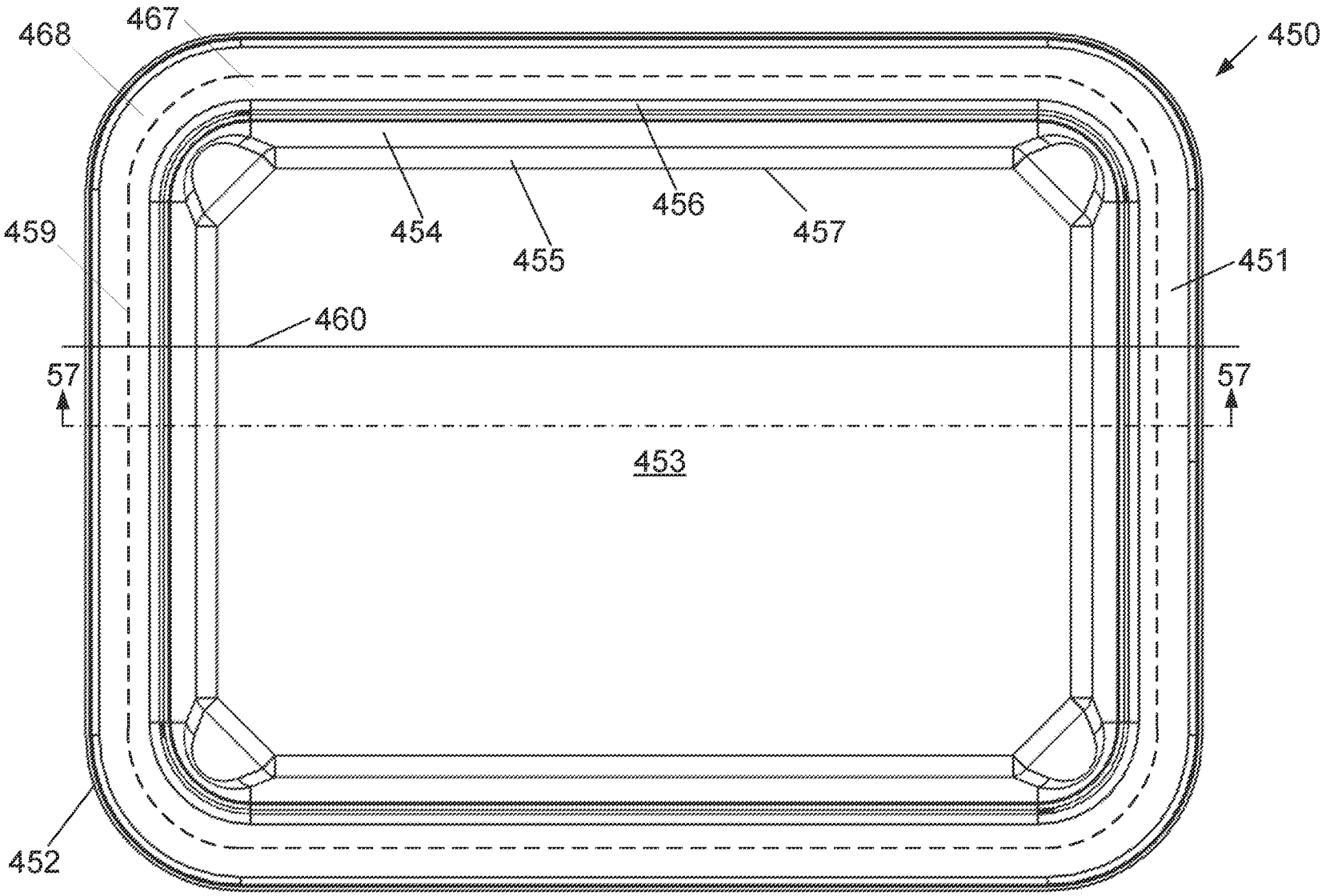
FIG. 56 and FIG. 57 show various views of a tray in accordance with the example embodiments.

Next, FIG. 56 shows a top view of a tray 450. In accordance with at least some embodiments, elevation views of the tray 450 can look exactly like the elevation views shown in FIG. 3 and FIG. 4.

The tray 450 is a hinged tray. The tray 450 includes a flange 451, a trim edge 452, a base 453, a wall 454, and a hinge 459. The wall 454 includes a first end 455 and a second end 456. The first end 455 and the second end 456 are at opposite ends of the wall 454. The wall 454 extends continuously around the base 453. The flange 451 extends continuously around an entirety of the second end 456 of the wall 454. The trim edge 452 extends continuously around the flange 451. The base 453 includes and/or is defined by a base perimeter 457. As shown in FIG. 56, the base perimeter 457 has an irregular octagon shape, but could be arranged with a different shape. The tray 450 is shown before the flange 451 is folded (e.g., bent) at and/or via the hinge 459.

The flange 451 extends continuously around an entirety of the second end 456 of the wall 454. Stated another way, the flange 451 extends away from the second end 456 of the wall 454 (i.e., extends away from the entire second end 456 of the wall 454. The trim edge 452 extends continuously around the flange 451. The hinge 459 extends continuously around the flange 451. The hinge 459 can include a single cut or multiple interrupted cuts within the flange 451.

The flange 451 includes a portion 467 of the flange 451 between the hinge 459 and the second end 456 of the wall 454. The flange 451 includes a portion 468 of the flange 451 between the hinge 459 and the trim edge 452.

FIG. 56 includes a section line 57-57 and a line 460 to indicate where a section view based on the section line 57-57 ends.

Figure 57:
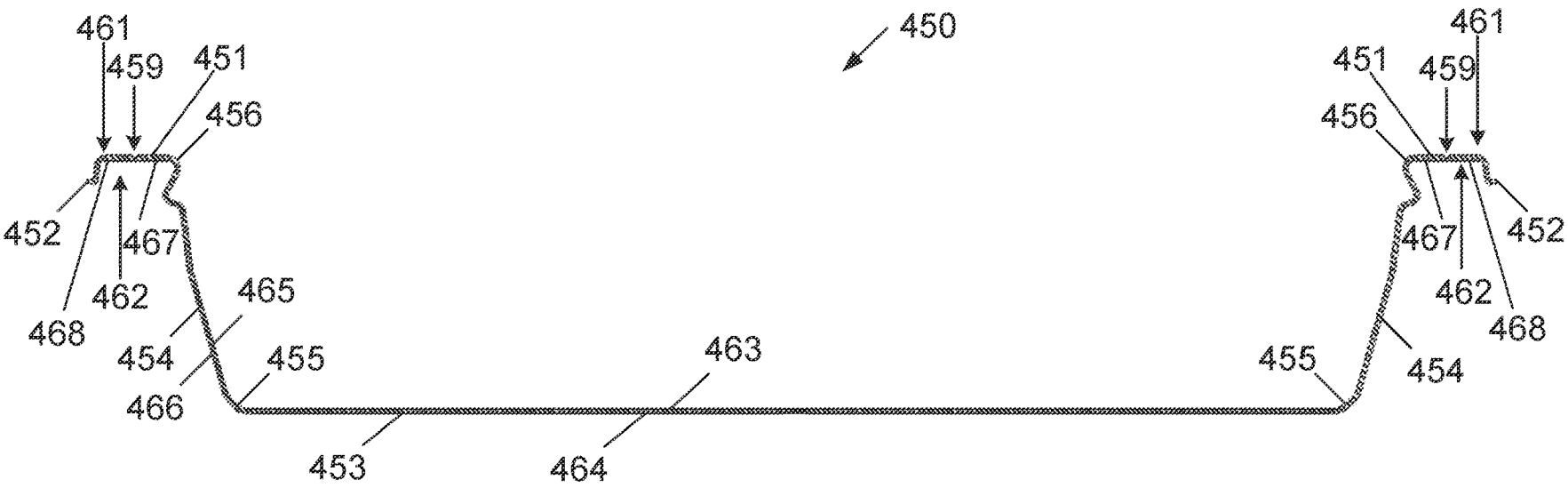

Next, FIG. 57 shows a section view of the tray 450. FIG. 57 shows the flange 451, the trim edge 452, the base 453, the wall 454, the first end 455 of the wall 454, the second end 456 of the wall 454, and the hinge 459. The base 453 has an interior surface 463 and an exterior surface 464. The wall 454 has an inner wall surface 465 and an outer wall surface 466.

As noted, the flange 451 includes the portion 467 of the flange 451 between the hinge 459 and the second end 456 of the wall 454, and the portion 468 of the flange 451 between the hinge 459 and the trim edge 452. In at least some embodiments, the portion 467 of the flange 451 is not folded as a result of folding the flange 451 at and/or via the hinge 459. In that regard, the portion 467 of the flange 451 remains unfolded (i.e., unbent). In at least some other embodiments, at least some of the portion 467 of the flange 451 is folded as a result of folding the flange 451 at and/or via the hinge 459.

The flange 451 includes a top flange surface 461 extending from the trim edge 452 to the second end 456 of the wall 454. The flange 451 includes a bottom flange surface 462 extending from the trim edge 452 to the wall 454.

Figure 58:
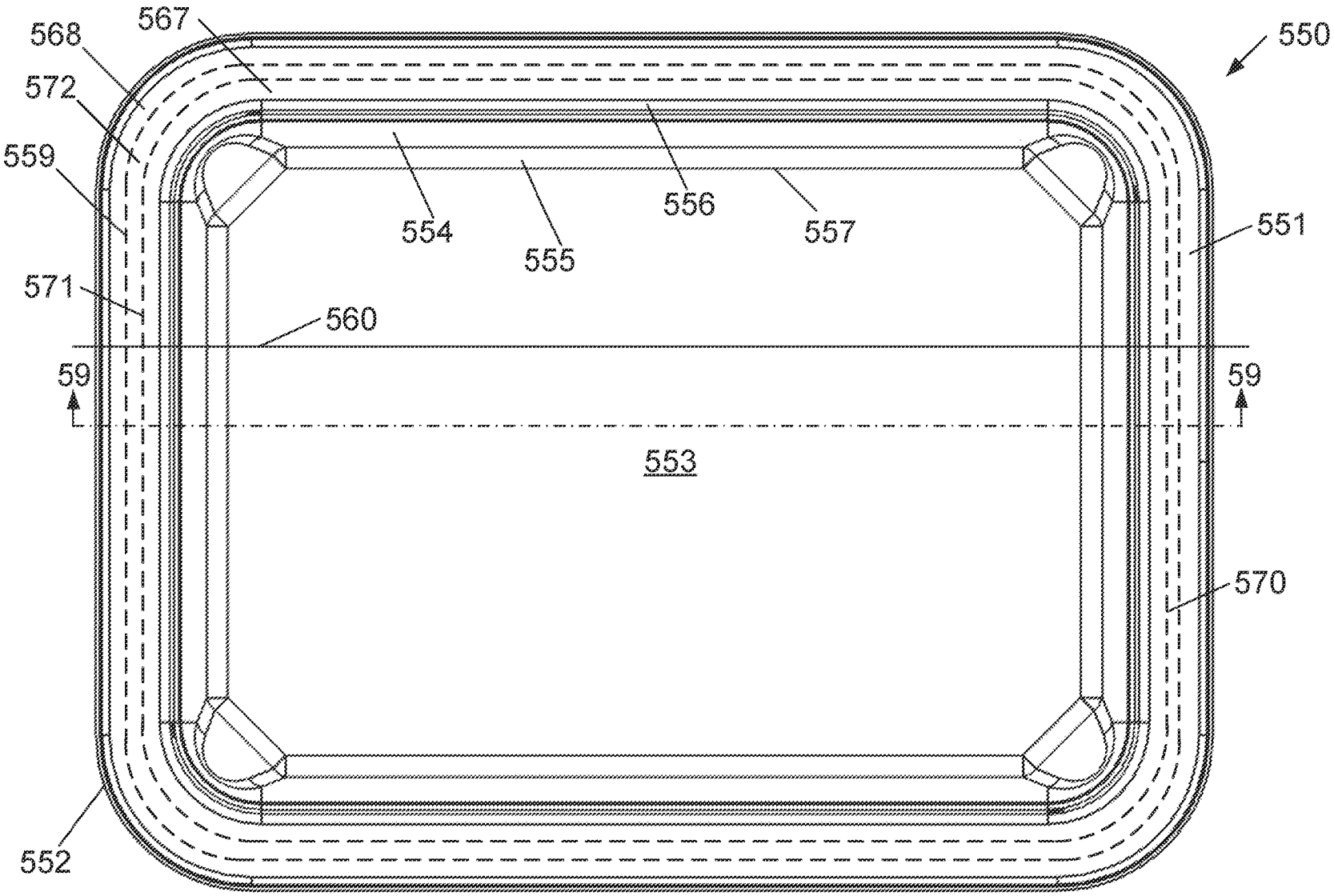
FIG. 58 and FIG. 59 show various views of a tray in accordance with the example embodiments.

Next, FIG. 58 shows a top view of a tray 550. In accordance with at least some embodiments, elevation views of the tray 550 can look exactly like the elevation views shown in FIG. 3 and FIG. 4.

The tray 550 is a hinged tray. The tray 550 includes a flange 551, a trim edge 552, a base 553, a wall 554, a hinge 559, and a hinge 571. The wall 554 includes a first end 555 and a second end 556. The first end 555 and the second end 556 are at opposite ends of the wall 554. The wall 554 extends continuously around the base 553. The flange 551 extends continuously around an entirety of the second end 556 of the wall 554. The trim edge 552 extends continuously around the flange 551. The base 553 includes and/or is defined by a base perimeter 557. As shown in FIG. 58, the base perimeter 557 has an irregular octagon shape, but could be arranged with a different shape. The tray 550 is shown before the flange 551 is folded (e.g., bent) at and/or via the hinge 559 or at and/or the hinge 571.

The flange 551 extends continuously around an entirety of the second end 556 of the wall 554. Stated another way, the flange 551 extends away from the second end 556 of the wall 554 (i.e., extends away from the entire second end 556 of the wall 554. The trim edge 552 extends continuously around the flange 551. The hinge 559 extends continuously around the flange 551. Similarly, the hinge 579 extends continuously around the flange 551. The hinge 559 can include a single cut or multiple interrupted cuts within the flange 551. The hinge 579 can include a single cut or multiple interrupted cuts within the flange 451.

The flange 551 includes a portion 567 of the flange 551 between the hinge 571 and the second end 556 of the wall 554. The flange 551 includes a portion 568 of the flange 551 between the hinge 559 and the trim edge 552. The flange 551 includes a portion 572 of the flange 551 between the hinge 559 and/or the hinge 571. In at least some embodiments, the portion 567 of the flange 551 is not folded as a result of folding the flange 551 at and/or via the hinge 559 and/or the hinge 571. In that regard, the portion 567 of the flange 551 remains unfolded (i.e., unbent).

The portion 568 of the flange 551 and the portion 572 of the flange 551 can be referred to as a pair of multiple portions of the flange 551 (e.g., a first pair). The portion 567 of the flange 551 and the portion 572 of the flange 551 can be referred to as a pair of multiple portions of the flange 551 (e.g., a second pair). The portion 567 of the flange 551 and the portion 568 of the flange 551 can be referred to as a pair of multiple portions of the flange 551 (e.g., a third pair).

FIG. 58 includes a section line 59-59 and a line 560 to indicate where a section view based on the section line 59-59 ends.

Figure 59:
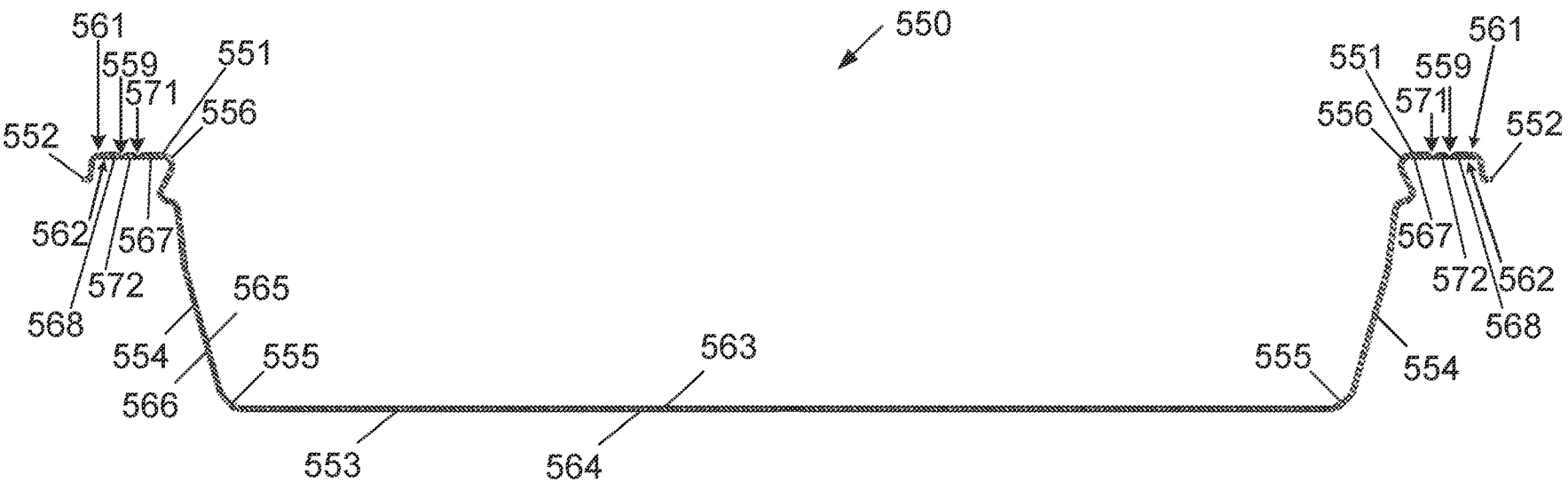

Next, FIG. 59 shows a section view of the tray 550. FIG. 59 shows the flange 551, the trim edge 552, the base 553, the wall 554, the first end 555 of the wall 554, the second end 556 of the wall 554, the hinge 559, and the hinge 571. The base 553 has an interior surface 563 and an exterior surface 564. The wall 554 has an inner wall surface 565 and an outer wall surface 566.

As noted, the flange 551 includes the portion 567 of the flange 551 between the hinge 571 and the second end 556 of the wall 554, the portion 568 of the flange 551 between the hinge 559 and the trim edge 552, and the portion 572 of the flange 551 between the hinge 559 and the hinge 579. In at least some embodiments, the portion 567 of the flange 551 is not folded as a result of folding the flange 551 at and/or via the hinge 571 and/or the hinge 559. In that regard, the portion 567 of the flange 551 remains unfolded (i.e., unbent). In at least some other embodiments, at least some of the portion 567 of the flange 551 is folded as a result of folding the flange 551 at and/or via the hinge 559 and/or the hinge 571.

The flange 551 includes a top flange surface 561 extending from the trim edge 552 to the second end 556 of the wall 554. The flange 551 includes a bottom flange surface 562 extending from the trim edge 552 to the wall 554.

In accordance with at least some embodiments, the hinge 559 and the hinge 571 are continuous hinges. In accordance with at least some other embodiments, one of the hinge 559 or the hinge 571 is a continuous hinge and the other is a non-continuous hinge.

In accordance with at least some embodiments, the hinge 571 abuts the second end 556 of the wall 554. In accordance with at least some other embodiments, the portion 567 of the flange 551 extends between the hinge 571 and the second end 556 of the wall 554.

Figure 60:
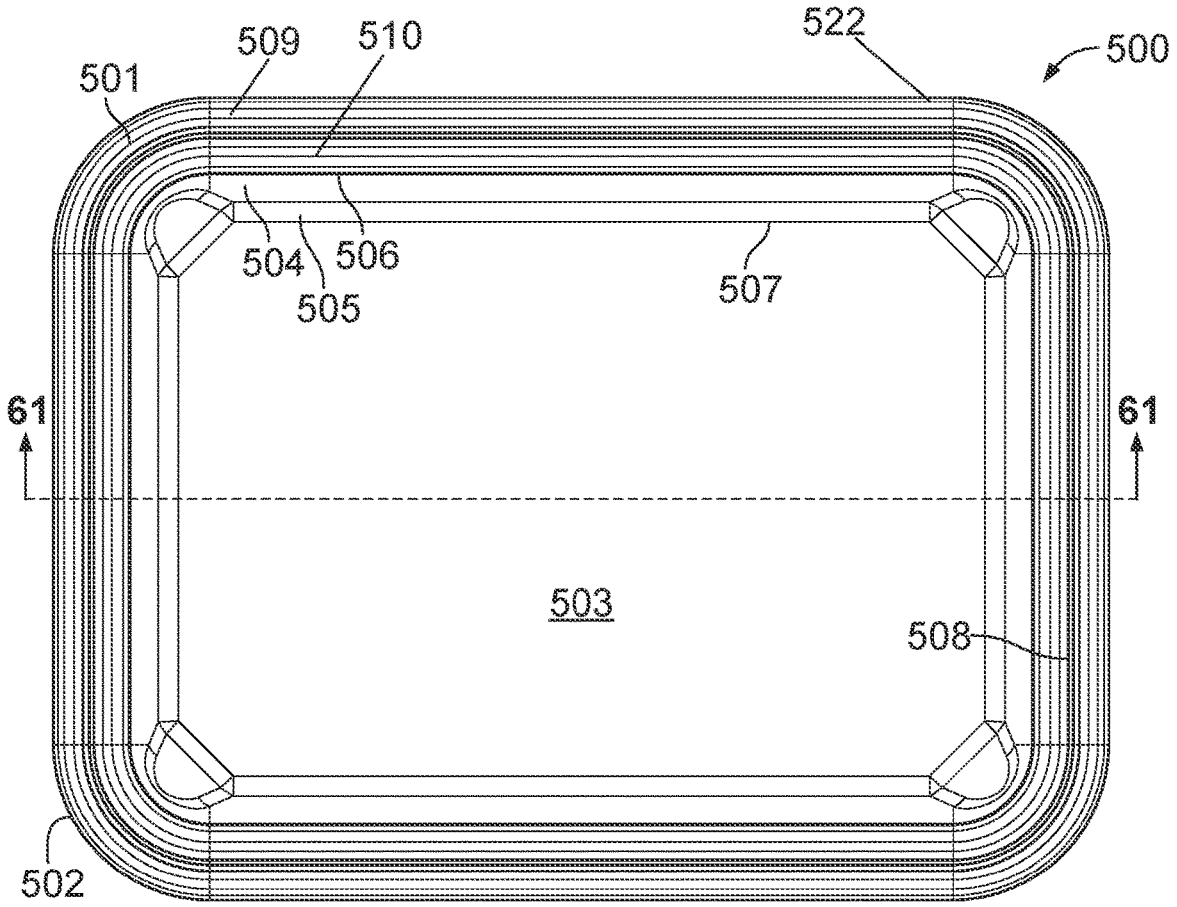
FIG. 60, FIG. 61, and FIG. 62 show various views of a tray in accordance with the example embodiments.
Figure 61:
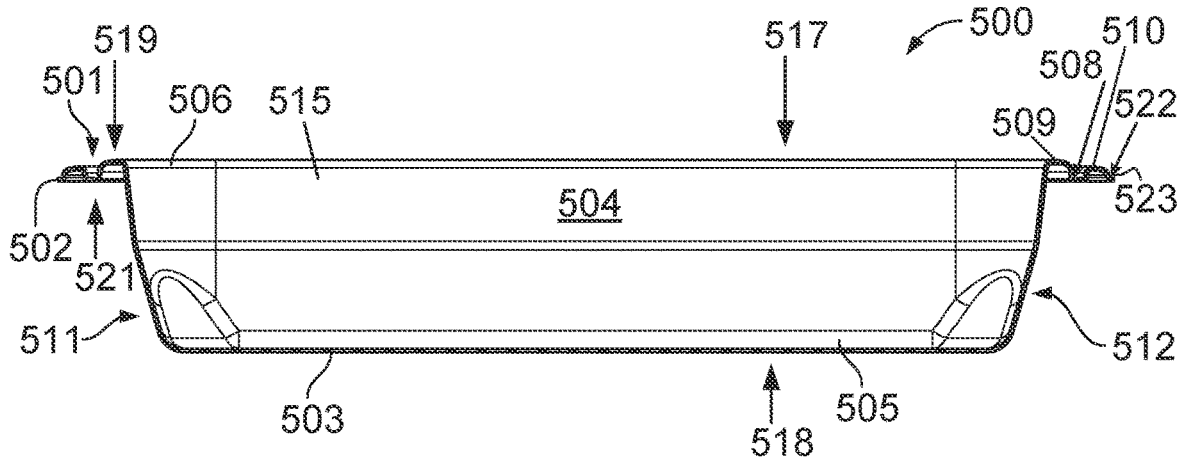
Figure 62:
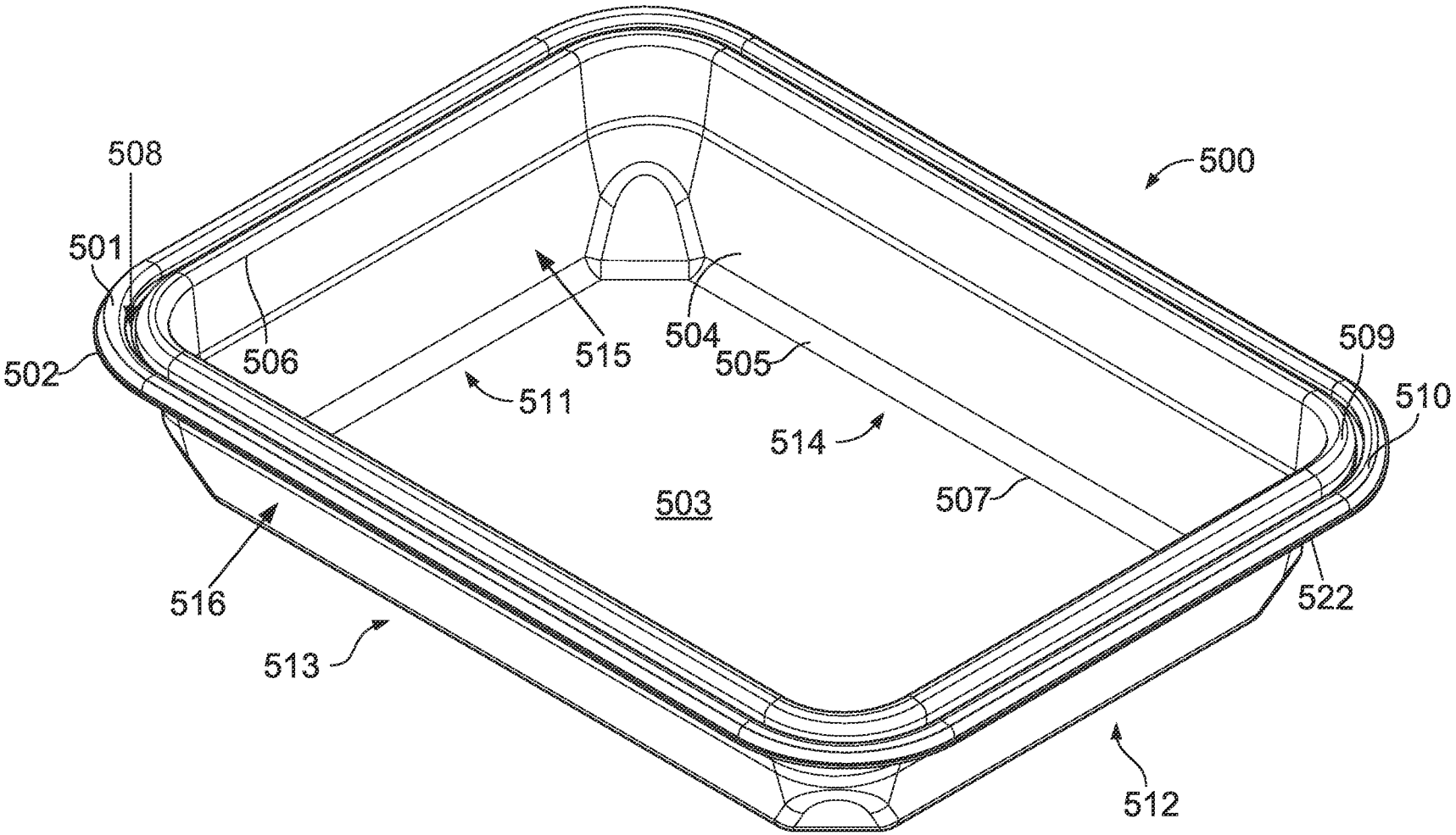

Next, FIG. 60 to FIG. 62 show different views of a tray 500. In particular, FIG. 60 shows a top view of the tray 500, FIG. 61 shows a section view of the tray 500, and FIG. 62 shows a perspective view of the tray 500.

Based on the top view of the tray 500 shown in FIG. 60, a top of the tray 500 has a substantially rectangular shape with rounded corners. The tray 500 is a hinged tray having multiple hinges. As shown in one or more of FIG. 60 to FIG. 62, the tray 500 includes a flange 501, a trim edge 502, a base 503, a wall 504, a hinge 508, and a hinge 522. The base 503 includes and/or is defined by a base perimeter 507. As shown in FIG. 60, the base perimeter 507 has an irregular octagon shape, but could be arranged with a different shape.

In FIG. 60 to FIG. 62, the tray 500 is shown before the flange 501 is folded (e.g., bent) at and/or via the hinge 508 or the hinge 522. The flange 501 is configured to be folded downward, for example, by the application of an overwrap 520 to the tray 500. After the flange 501 is folded downward, the trim edge 502 is positioned closer to the wall 504 relative to how the trim edge 502 and the wall 504 are shown in FIG. 61. The flange 501 can be folded at and/or via the hinge 508 and/or the hinge 522.

The wall 504 includes a first end 505 (i.e., a first end of the wall 504) and a second end 506 (i.e., a second end of the wall 504). The first end 505 and the second end 506 are at opposite ends of the wall 504.

The wall 504 extends continuously around the base 503. For example, starting at any point on the base perimeter 507, the wall 504 continues around the base perimeter 507 until reaching the starting point without any breaks in the wall 504. With the base 503 positioned as shown in FIG. 60, the wall 504 extends upward from the base 503. In accordance with embodiments in which the tray 500 has a substantially rectangular shape, the wall 504 can be described as having a first side 511, a second side 512, a third side 513 (shown in FIG. 62), and a fourth side 514 (shown in FIG. 62), as well as a top side 517 and a bottom side 518.

The flange 501 extends continuously around an entirety of the second end 506 of the wall 504. Stated another way, the flange 501 extends away from the second end 506 of the wall 504 (i.e., extends away from the entire second end 506 of the wall 504. The trim edge 502 extends continuously around the flange 501. The hinge 508 extends continuously around the flange 501. The hinge 522 extends continuously around the flange 501. The hinge 508 can include a single cut or multiple interrupted cuts within the flange 501. The hinge 522 can include a single cut or multiple interrupted cuts within the flange 501.

The flange 501 includes a portion 509 of the flange 501 between the hinge 508 and the second end 506 of the wall 504. The flange 501 includes a portion 510 of the flange 501 between the hinge 508 and the hinge 522. The flange 501 includes a portion 523 of the flange 501 between the hinge 522 and the trim edge 502.

In at least some embodiments, the portion 509 of the flange 501 is not folded as a result of folding the flange 501 at and/or via the hinge 508 and/or the hinge 522. In that regard, the portion 509 of the flange 501 remains unfolded (i.e., unbent). In that regard, the portion 509 of the flange 501 remains unfolded (i.e., unbent). In at least some other embodiments, at least some of the portion 509 of the flange 501 is folded as a result of folding the flange 501 at and/or via the hinge 508 and/or the hinge 522.

In at least some embodiments, the portion 509 of the flange 501 and the portion 510 of the flange 501 are not folded as a result of folding the flange 501 at and/or via the hinge 522. In that regard, the portion 509 of the flange 501 and the portion 510 of the flange 501 remain unfolded (i.e., unbent). In at least some other embodiments, at least some of the portion 509 of the flange 501 and/or at least some of the portion 510 of the flange 501 is folded as a result of folding the flange 501 at and/or via the hinge 508 and/or the hinge 522. The portion 509 of the flange 501 and/or the portion 510 of the flange 501 can be arranged as a flange bumper.

The portion 509 of the flange 501 and the portion 510 of the flange 501 can be referred to as a pair of multiple portions of the flange 501 (e.g., a first pair). The portion 510 of the flange 501 and the portion 523 of the flange 501 can be referred to as a pair of multiple portions of the flange 501 (e.g., a second pair). The portion 509 of the flange 501 and the portion 523 of the flange 501 can be referred to as a pair of multiple portions of the flange 501 (e.g., a third pair).

The flange 501 includes a top flange surface 519 extending from the trim edge 502 to the second end 506 of the wall 504. The flange 501 includes a bottom flange surface 521 extending from the trim edge 502 to the wall 504.

The base 503 has an interior surface and an exterior surface. FIG. 62 shows the interior surface of the base 503. The wall 504 has an inner wall surface 515 and an outer wall surface 516. FIG. 61 and FIG. 62 show at least a portion of the inner wall surface 515 of the wall 504. FIG. 62 shows at least a portion of the outer wall surface 516 of the wall 504.

In accordance with at least some embodiments, the hinge 508 and the hinge 522 are continuous hinges. In accordance with at least some other embodiments, one of the hinge 508 or the hinge 522 is a continuous hinge and the other is a non-continuous hinge.

III. Example Method

Figure 63:
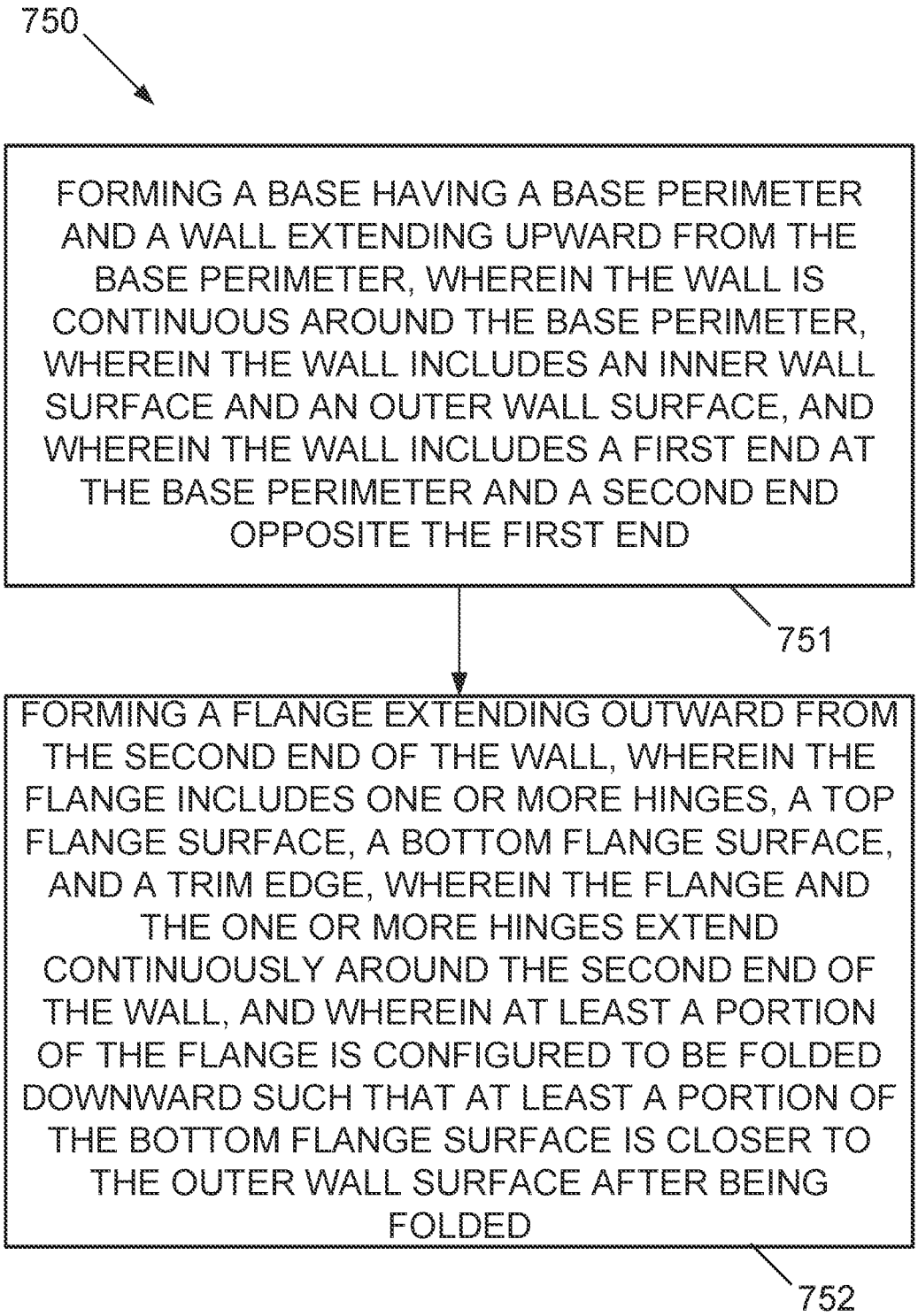
FIG. 63 is a flow chart listing steps of a method in accordance with the example embodiments.

Next, FIG. 63 shows a flow chart 750 listing steps of an example method of manufacturing a tray. The flow chart includes a block 751 and a block 752.

Block 751 includes forming a base having a base perimeter and a wall extending upward from the base perimeter. The wall is continuous around the base perimeter. The wall includes an inner wall surface and an outer wall surface. The wall includes a first end at the base perimeter and a second end opposite the first end.

Block 752 includes forming a flange extending outward from the second end of the wall. The flange includes one or more hinges, a top flange surface, a bottom flange surface, and a trim edge. The flange and the one or more hinges extend continuously around the second end of the wall. At least a portion of the flange is configured to be folded downward such that at least a portion of the bottom flange surface is closer to the outer wall surface after being folded.

Table A includes drawing reference numbers corresponding to different examples and aspects discussed in the description of block 751 and block 752.

TABLE A

| | Example | | | | | | | | |
|---|---|---|---|---|---|---|---|---|---|
| | 1 | 2 | 3 | 4 | 5 | 6 | 7 | 8 | 9 |
| Tray | 100 | 150 | 200 | 250 | 300 | 350 | 450 | 500 | 550 |
| Base | 103 | 153 | 203 | 253 | 303 | 353 | 453 | 503 | 553 |
| Base perimeter | 107 | 157 | 207 | 257 | 307 | 357 | 457 | 507 | 557 |
| Wall | 104 | 154 | 204 | 254 | 304 | 354 | 454 | 504 | 554 |
| Inner wall surface | 115 | 165 | 215 | 265 | 315 | 365 | 465 | 515 | 565 |
| Outer wall surface | 116 | 166 | 216 | 266 | 316 | 366 | 466 | 516 | 566 |
| First end of wall | 105 | 155 | 205 | 255 | 305 | 355 | 455 | 505 | 555 |
| Second end of wall | 106 | 156 | 206 | 256 | 306 | 356 | 456 | 506 | 556 |
| Hinge | 108 | 158 | 208 | 258 | 308 | 358 | 459 | 508 522 | 559 571 |
| Flange | 101 | 151 | 201 | 251 | 301 | 351 | 451 | 501 | 551 |
| Top flange surface | 119 | 169 | 219 | 269 | 319 | 369 | 461 | 519 | 561 |
| Bottom flange surface | 121 | 171 | 221 | 271 | 320 | 371 | 462 | 521 | 562 |
| Trim edge | 102 | 152 | 202 | 252 | 302 | 352 | 452 | 502 | 552 |

In accordance with at least some embodiments, the tray is made of a material, and the one or more hinges are formed by coining the material, creasing the material, contacting the material with a serrated blade, contacting the material with a heated serrated blade, thinning the material, contacting the material with a creasing knife, contacting the material with a heated creasing knife, or contacting the material with a punch and die. In at least some of those embodiments, forming the base and the flange occur at a first station and form the one or more hinges occurs at a second station using the creasing knife, the heated creasing knife, the serrated blade, the heated serrated blade, or the punch and die. In accordance with at least some other embodiments, the tray can be formed at a single station (e.g., a trim-in-place station, a form and post-trim machine) or via a rotary drum and trim press. In accordance with at least still some other embodiments, a hinge of a hinged tray can be formed at forming tool where the tray is formed, or the hinge can be formed with a knife or blade or another tool after the tray is formed, or the hinge can be formed after the tray is trimmed. Other examples of forming the one or more hinges are also possible.

Trimming the tray can include removing material from a sheet of the material. The removed material can include material of the sheet adjacent to an outside profile of the tray. Trimming the tray can include trimming multiple trays from a sheet of the material used to form the trays.

In accordance with at least some embodiments, such as the embodiments discussed in the preceding paragraph, the material used to form the tray comprises: polyethylene terephthalate (PET), amorphous polyethylene terephthalate (APET), crystalline polyethylene terephthalate (CPET), recycled polyethylene terephthalate (RPET), polyethylene terephthalate glycol-modified (PETG), polylactic acid (PLA), polypropylene, high impact polystyrene sheet (HIPS), or pulp fiber.

In accordance with at least some embodiments, the tray moves to the second station after the base and the flange have been formed at the first station. The tray can be trimmed to size and/or separated from adjacent formed trays at the second station or at a third station after the one or more hinges are formed at the second station.

In accordance with at least some embodiments, the flange is turned (e.g., bent) at a station after the tray is formed. As an example, the station can include a punch and die. The turning can occur by pushing the flange through a smaller opening after the tray and/or flange is trimmed. An ejector plate at the station can be configured to push the flange through an opening smaller than the flange to rotate the flange. In this way, less turning (e.g., bending) of the flange is required during applying of an overwrap onto the tray.

In accordance with at least some embodiments, the one or more hinges include interrupted cuts within the material. Since the hinge extends continuously around the flange, the interrupted cuts extend continuously around the flange. As an example, the interrupted cuts can be formed using a serrated knife, such as a heated serrated knife, or a punch and die. A thickness of the material at each cut of the interrupted cut is thinner than a thickness of the material at the positions where the interruption in the cut exists. Forming a hinge with interrupted cuts can result in a hinge that is easier to fold as compared to a hinge formed by a continuous thinning of the 5 material around the flange. A depth of the interrupted cuts can be selected so that a portion of the flange does not break or tear when folding the flange

IV. Conclusion

While various aspects and embodiments are described herein, other aspects and embodiments will be apparent to those skilled in the art. The various aspects and embodiments disclosed herein are for purposes of illustration and are not intended to be limiting, with the true scope being indicated by the claims, along with the full scope of equivalents to which such claims are entitled. It is also to be understood that the terminology used herein is for the purpose of describing example embodiments, and is not intended to be limiting.

What is claimed is:

1. A tray comprising:

a base having a base perimeter;

a wall extending upward from the base perimeter, wherein the wall is continuous around the base perimeter, wherein the wall includes an inner wall surface and an outer wall surface, and wherein the wall includes a first end at the base perimeter and a second end opposite the first end; and a flange extending outward from the second end of the wall, wherein the flange includes one or more hinges, a top flange surface, a bottom flange surface, and a trim edge, wherein the flange and the one or more hinges extend continuously around the second end of the wall, and wherein at least a portion of the flange is configured to be folded downward such that at least a portion of the bottom flange surface is closer to the outer wall surface after being folded.

2. The tray of claim 1, wherein at least a first portion of the base is flat and a second portion of the base is rounded.

3. The tray of claim 1, wherein a length of the flange is greater than or less than a height of the wall.

4. The tray of claim 1, wherein:

the flange includes a pocket, and the one or more hinges include a first hinge disposed within the pocket.

5. The tray of claim 4, wherein the pocket includes a step arising from the first hinge.

6. The tray of claim 4, wherein:

a first portion of the flange adjacent the pocket is one of flat, slanted, and rounded, and a second portion of the flange adjacent the pocket is one of flat, slanted, and rounded.

7. The tray of claim 6, wherein at least one of the first portion of the flange and the second portion of the flange is arranged as a flange bumper.

8. The tray of claim 1, wherein:

the one or more hinges includes at least a first hinge and a second hinge, and the first hinge is between the trim edge and the second hinge.

9. The tray of claim 8, wherein the second hinge abuts the second end of the wall, or a first portion of the flange extends between the second hinge and the second end of the wall.

10. The tray of claim 1, wherein:

the one or more hinges includes a single hinge, and the single hinge abuts the second end of the wall, or the single hinge is disposed between the trim edge and a first portion of the flange that abuts the second end of the wall.

11. The tray of claim 1, wherein:

the one or more hinges include a first continuous hinge, and the first continuous hinge has a uniform width.

12. The tray of claim 1, wherein:

the one or more hinges include a first continuous hinge having a first hinge portion, a second hinge portion, and a transition hinge portion extending from the first hinge portion to the second hinge portion, the transition hinge portion is disposed at a corner of the flange, and a width of the transition hinge portion is wider than a width of the first hinge portion and a width of the second hinge portion.

13. The tray of claim 1, wherein the flange further includes one or more non-continuous hinges.

14. The tray of claim 1, wherein multiple portions of the flange have a radial shape with each hinge of the one or more hinges separating a respective pair of the multiple portions of the flange.

15. The tray of claim 1, wherein the tray is arranged as a particular tray selected from the group consisting of a thermo-formed tray, an injection molded tray, and a compression molded tray.

16. The tray of claim 1, wherein the tray is made of a material selected from the group consisting of:

polyethylene terephthalate (PET),
amorphous polyethylene terephthalate (APET),
crystalline polyethylene terephthalate (CPET),
recycled polyethylene terephthalate (RPET),
polyethylene terephthalate glycol-modified (PETG),
polylactic acid (PLA),
polypropylene,
high impact polystyrene sheet (HIPS), and
pulp fiber.

17. The tray of claim 16, wherein the one or more hinges include at least one hinge selected from the group consisting of a hinge formed by coining the material, a hinge formed by creasing the material, a hinge formed by contacting the material with a serrated blade, a hinge formed by contacting the material with a heated serrated blade, a hinge formed by contacting the material with a creasing knife, a hinge formed by contacting the material with a heated creasing knife, and a hinge formed by contacting the material with a punch and die.

18. The tray of claim 1, wherein:

the flange is configured to be folded via an application of an overwrap material to the tray, and the trim edge does not contact the overwrap material during or after application of the overwrap material to the tray.

19. The tray of claim 1, wherein the flange is configured to be pre-folded before an overwrap material is applied to the tray.

20. The tray of claim 1, wherein the flange is configured to be folded downward so that the trim edge contacts the outer wall surface.

21. The tray of claim 1, wherein the tray is made of a moldable plastic.

22. The tray of claim 1, wherein the tray is made of a moldable fiber.

23. A method of manufacturing a tray, the method comprising:

forming a base having a base perimeter and a wall extending upward from the base perimeter, wherein the wall is continuous around the base perimeter, wherein the wall includes an inner wall surface and an outer wall surface, and wherein the wall includes a first end at the base perimeter and a second end opposite the first end; and forming a flange extending outward from the second end of the wall, wherein the flange includes one or more hinges, a top flange surface, a bottom flange surface, and a trim edge, wherein the flange and the one or more hinges extend continuously around the second end of the wall, and wherein at least a portion of the flange is configured to be folded downward such that at least a portion of the bottom flange surface is closer to the outer wall surface after being folded.

24. The method of manufacturing the tray of claim 23, wherein:

the tray is made of a material, and the one or more hinges include at least one hinge selected from the group consisting of a hinge formed by coining the material, a hinge formed by creasing the material, a hinge formed by contacting the material with a serrated blade, a hinge formed by contacting the material with a heated serrated blade, a hinge formed by thinning the material, a hinge formed by contacting the material with a creasing knife, a hinge formed by contacting the material with a heated creasing knife, and a hinge formed by contacting the material with a punch and die.

25. The method of manufacturing the tray of claim 24, wherein the material comprises a material selected from the group consisting of:

polyethylene terephthalate (PET),
amorphous polyethylene terephthalate (APET),
crystalline polyethylene terephthalate (CPET),
recycled polyethylene terephthalate (RPET),
polyethylene terephthalate glycol-modified (PETG),
polylactic acid (PLA),
polypropylene,
high impact polystyrene sheet (HIPS), and
pulp fiber.

26. The method of manufacturing the tray of claim 24, wherein the one or more hinges include interrupted cuts within the material.

27. The method of manufacturing the tray of claim 23, wherein forming the base, the wall, and the flange with the one or more hinges occurs at one or more stations.

28. An article of manufacture comprising:

a base having a base perimeter;

a wall extending away from the base perimeter, wherein the wall is continuous around the base perimeter, wherein the wall includes an inner wall surface and an outer wall surface, and wherein the wall includes a first end at the base perimeter and a second end opposite the first end; and a flange extending outward from the second end of the wall, wherein the flange includes one or more hinges, a top flange surface, a bottom flange surface, and a trim edge, wherein the flange and the one or more hinges extend continuously around the second end of the wall, and wherein at least a portion of the flange is configured to be folded downward such that at least a portion of the bottom flange surface is closer to the outer wall surface after being folded.

* * * * *